US009029054B2

(12) United States Patent
Okuda et al.

(10) Patent No.: US 9,029,054 B2
(45) Date of Patent: May 12, 2015

(54) ELECTROPHOTOGRAPHIC PHOTOSENSITIVE MEMBER, PROCESS CARTRIDGE, AND ELECTROPHOTOGRAPHIC APPARATUS

(71) Applicant: Canon Kabushiki Kaisha, Tokyo (JP)

(72) Inventors: Atsushi Okuda, Yokohama (JP); Michiyo Sekiya, Atami (JP); Kunihiko Sekido, Suntou-gun (JP); Kenichi Kaku, Newcastle Upon Tyne (GB); Nobuhiro Nakamura, Mishima (JP); Yota Ito, Mishima (JP); Yuka Ishiduka, Suntou-gun (JP); Hiroyuki Tomono, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/930,383

(22) Filed: Jun. 28, 2013

(65) Prior Publication Data

US 2014/0004454 A1 Jan. 2, 2014

(30) Foreign Application Priority Data

Jun. 29, 2012 (JP) ..... 2012-147157
Apr. 25, 2013 (JP) ..... 2013-093091
Jun. 21, 2013 (JP) ..... 2013-130997

(51) Int. Cl.

| | |
|---|---|
| ***G03G 5/05*** | (2006.01) |
| ***G03G 15/00*** | (2006.01) |
| ***G03G 5/06*** | (2006.01) |
| ***G03G 5/14*** | (2006.01) |
| ***G03G 5/147*** | (2006.01) |

(52) U.S. Cl.

CPC ..... *G03G 5/055* (2013.01); *G03G 15/751* (2013.01); *G03G 15/00* (2013.01); *G03G 5/0605* (2013.01); *G03G 5/0607* (2013.01); *G03G 5/0648* (2013.01); *G03G 2215/00957* (2013.01); *G03G 5/0542* (2013.01); *G03G 5/056* (2013.01); *G03G 5/0592* (2013.01); *G03G 5/0614* (2013.01); *G03G 5/0696* (2013.01); *G03G 5/142* (2013.01); *G03G 5/14708* (2013.01); *G03G 5/14752* (2013.01)

(58) Field of Classification Search

CPC ... G03G 5/055; G03G 5/0605; G03G 5/0607; G03G 5/0648; G03G 5/065; G03G 5/0614
USPC ..... 430/60, 63, 65, 58.25, 58.5, 58.7
See application file for complete search history.

(56) References Cited

U.S. PATENT DOCUMENTS

| | | | |
|---|---|---|---|
| 4,442,193 | A | 4/1984 | Chen et al. |
| 4,562,132 | A | 12/1985 | Ong et al. |
| 4,992,349 | A | 2/1991 | Chen et al. |
| 5,455,135 | A | 10/1995 | Maruyama et al. |
| 5,468,583 | A | 11/1995 | Gruenbaum et al. |
| 5,604,061 | A | 2/1997 | Sekido et al. |
| 5,693,443 | A | 12/1997 | Nakamura et al. |
| 5,863,688 | A | 1/1999 | Watanabe et al. |
| 6,110,628 | A | 8/2000 | Sekiya et al. |
| 6,228,546 | B1 | 5/2001 | Kashizaki et al. |
| 6,372,397 | B1 | 4/2002 | Maruyama et al. |
| 6,436,597 | B2 | 8/2002 | Maruyama et al. |
| 6,664,014 | B1 | 12/2003 | Kikuchi et al. |
| 6,991,881 | B2 | 1/2006 | Ogaki et al. |
| 6,994,941 | B2 | 2/2006 | Tanaka et al. |
| 7,001,699 | B2 | 2/2006 | Tanaka et al. |
| 7,045,261 | B2 | 5/2006 | Tanaka et al. |
| 7,141,341 | B2 | 11/2006 | Sekido et al. |
| 7,171,142 | B2 | 1/2007 | Kawakami et al. |
| 7,378,205 | B2 | 5/2008 | Sekiya et al. |
| 7,541,124 | B2 | 6/2009 | Molaire et al. |
| 7,585,604 | B2 | 9/2009 | Ogaki et al. |
| 7,645,547 | B2 | 1/2010 | Okuda et al. |
| 7,655,370 | B2 | 2/2010 | Kitamura et al. |
| 7,702,256 | B2 | 4/2010 | Nukada et al. |
| 7,910,274 | B2 | 3/2011 | Tanaka et al. |
| 7,927,774 | B2 | 4/2011 | Ogaki et al. |
| 8,088,541 | B2 | 1/2012 | Tanaka et al. |
| 8,343,699 | B2 | 1/2013 | Nagasaka et al. |

(Continued)

FOREIGN PATENT DOCUMENTS

| | | | |
|---|---|---|---|
| JP | 1-206349 | A | 8/1989 |
| JP | 5-279582 | A | 10/1993 |

(Continued)

OTHER PUBLICATIONS

English language machine translation of JP 2004-093801 (Mar. 2004).*

(Continued)

*Primary Examiner* — Christopher Rodee
(74) *Attorney, Agent, or Firm* — Fitzpatrick, Cella, Harper and Scinto

(57) ABSTRACT

An electron transporting layer is a cured layer including carbon atoms, nitrogen atoms and oxygen atoms. When ratios of the number of carbon atoms, ratios of the number of nitrogen atoms, and ratios of the number of oxygen atoms are analyzed at 10 points by an X-ray photoelectron spectroscopy (ESCA), the respective standard deviations, σ(C), σ(N) and σ(O), of the ratios of the number of carbon atoms, the ratios of the number of nitrogen atoms and the ratios of the number of oxygen atoms satisfy the following expressions (1) to (3):

$$\sigma(C) \leq 1.5 \quad (1),$$

$$\sigma(N) \leq 1.5 \quad (2),$$

and $$\sigma(O) \leq 1.5 \quad (3).$$

8 Claims, 4 Drawing Sheets

(56) References Cited

U.S. PATENT DOCUMENTS

| | | | | |
|---|---|---|---|---|
| 8,465,889 | B2 | 6/2013 | Sekido et al. | |
| 8,481,236 | B2 | 7/2013 | Tanaka et al. | |
| 8,524,430 | B2 | 9/2013 | Takagi et al. | |
| 8,546,050 | B2 | 10/2013 | Maruyama et al. | |
| 2007/0026332 | A1 * | 2/2007 | Ferrar et al. | 430/64 |
| 2010/0062171 | A1 | 3/2010 | Kaku et al. | |
| 2011/0143273 | A1 | 6/2011 | Sekido et al. | |
| 2011/0158683 | A1 | 6/2011 | Okuda et al. | |
| 2012/0033994 | A1 | 2/2012 | Tanaka et al. | |
| 2012/0230727 | A1 | 9/2012 | Sekido et al. | |
| 2012/0301181 | A1 | 11/2012 | Ogaki et al. | |
| 2012/0301182 | A1 | 11/2012 | Anezaki et al. | |
| 2013/0202326 | A1 | 8/2013 | Shida et al. | |
| 2013/0202327 | A1 | 8/2013 | Murai et al. | |
| 2013/0236823 | A1 | 9/2013 | Noguchi et al. | |

FOREIGN PATENT DOCUMENTS

| | | | | |
|---|---|---|---|---|
| JP | 7-70038 | A | | 3/1995 |
| JP | 9-151157 | A | | 6/1997 |
| JP | 2003-330209 | A | | 11/2003 |
| JP | 2004-93801 | A | | 3/2004 |
| JP | 2004093801 | A | * | 3/2004 |
| JP | 2006-30698 | A | | 2/2006 |
| JP | 2009-505156 | A | | 2/2009 |
| WO | WO 2012002516 | A1 | * | 1/2012 |

OTHER PUBLICATIONS

Diamond, Arthur S & David Weiss (eds.) Handbook of Imaging Materials, 2nd ed.. New York: Marcel-Dekker, Inc. (Nov. 2001) pp. 401-403.*

Yamashita, et al., "Crosslinking Agent Handbook", 1981, pp. 536-605.

Okuda, et al., U.S. Appl. No. 14/009,723, 371(c) Date: Oct. 3, 2013.

Okuda, et al., U.S. Appl. No. 14/009,721, 371(c) Date: Oct. 3, 2013.

Tokimitsu, et al., U.S. Appl. No. 13/913,910, filed Jun. 10, 2013.

Sekiya, et al., U.S. Appl. No. 13/930,341, filed Jun. 28, 2013.

Kaku, et al., U.S. Appl. No. 13/930,368, filed Jun. 28, 2013.

Fujii, et al.,.U.S. Appl. No. 13/972,688, filed Aug. 21, 2013.

Jones, et al., "Cyanonaphthalene Diimide Semiconductors for Air-Stable, Flexible, and Optically Transparent n-Channel Field-Effect Transistors", Chemistry of Materials, vol. 19, No. 11, May 29, 2007, pp. 2703-2705.

Callahan, et al., "Syntheses of Phencyclone Analogues. Applications for NMR Studies of Hindered Rotations and Magnetic Anisotropy in Crowded Diels-Alder Adducts", Chem. Educator, vol. 6, 2001, pp. 227-234.

Kato, et al., "Nitration of Phenanthrenequinone", Journal of Synthetic Organic Chemistry, Japan, vol. 15, 1957, pp. 29-32.

Kato, et al., "Syntheses of Amino-phenanthrenequinones by the Reduction of Nitro Compounds", Journal of Synthetic Organic Chemistry, Japan, vol. 15, 1957, pp. 32-34.

Yamada, et al., "Synthesis and Properties of Diamino-Substituted Dipyrido [3,2-a: 2',3'-c]phenazine", Bulletin of the Chemical Society of Japan, vol. 65, No. 4, 1992, pp. 1006-1011.

Qian, et al., "4-Amino-1, 8-dicyanonaphthalene derivatives as novel fluorophore and fluorescence switches: efficient synthesis and fluorescence enhancement induced by transition metal ions and protons", Tetrahedron Letters, vol. 43, 2002, pp. 2991-2994.

Xiao, et al., "Novel highly efficient fluoroionophores with a peri-effect and strong electron-donating receptors: TICT-promoted PET and signaling response to transition metal cations with low background emission", Tetrahedron Letters, vol. 44, 2003, pp. 2087-2091.

Miyamura, et al., "Polymer Incarcerated Gold Catalyzed Aerobic Oxidation of Hydroquinones and Their Derivatives", Chemistry Letters, vol. 37, No. 3, 2008, pp. 360-361.

Okada, et al., "Synthesis and Properties of a Novel Electron Transporting Compound, 3, 3'-dialkyl-4,4'-bisnaphthylquinone (DBNQ)", PPCI/Japan Hardcopy '98 Papers, 1998, pp. 207-210.

Jones, et al., "Tuning Orbital Energetics in Arylene Diimide Semiconductors. Materials Design for Ambient Stability of n-Type Charge Transport", J. Am. Chem. Soc., vol. 129, 2007, pp. 15259-15278.

* cited by examiner

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

1. Field of the Invention

The present invention relates to an electrophotographic photosensitive member, and a process cartridge and an electrophotographic apparatus having an electrophotographic photosensitive member.

2. Description of the Related Art

As electrophotographic photosensitive members used for process cartridges and electrophotographic apparatuses, electrophotographic photosensitive members containing an organic photoconductive substance have been broadly used in the market at present. The electrophotographic photosensitive member generally has a support and a photosensitive layer formed on the support. Then, an undercoating layer is provided between the support and the photosensitive layer in order to suppress the charge injection from the support side to the photosensitive layer (charge generating layer) side and to suppress the generation of image defects such as fogging.

Providing an undercoating layer, however, is liable to generate a potential variation in repeated use due to a resistance variation of the undercoating layer. Then, a technology to suppress the potential variation is disclosed in which an electron transporting substance is incorporated in an undercoating layer to thereby make the undercoating layer as a layer having an electron transporting capability (hereinafter, also referred to as an electron transporting layer). A technology is simultaneously proposed in which in order that an electron transporting substance does not dissolve out in formation of a photosensitive layer formed on an undercoating layer, in the case where the electron transporting substance is incorporated in the undercoating layer, the undercoating layer uses a curable material which is hardly soluble to a solvent of a coating liquid for the photosensitive layer.

Japanese Patent Application Laid-Open No. 2009-505156 discloses a condensed polymer (electron transporting substance) having an aromatic tetracarbonylbisimide skeleton and a crosslinking site, and an electron transporting layer containing a polymer with a crosslinking agent. Japanese Patent Application Laid-Open No. 2003-330209 discloses that a polymer of an electron transporting substance having a non-hydrolyzable polymerizable functional group is incorporated in an undercoating layer.

However, as a result of studies by the present inventors, it has been found that in the case where an undercoating layer is made to be an electron transporting layer, and a positive charge is applied on an electrophotographic photosensitive member, a positive memory image is generated by a positive charge remaining in the electron transporting layer in some cases. The positive memory image in an electrophotographic apparatus refers to an image in which the application of a positive charge on an electrophotographic photosensitive member in the rubbing time by transfer and cleaning units causes a potential difference between applied portions and non-applied portions and thereby generates a phenomenon of raising the image density.

Since the technologies disclosed in Japanese Patent Application Laid-Open Nos. 2009-505156 and 2003-330209 use a curable material for their electron transporting layer, the homogeneity of a charge transporting structure of the electron transporting layer decreases and the positive memory image is liable to occur in some cases, which have room for improvement.

SUMMARY OF THE INVENTION

It is an object of the present invention to provide an electrophotographic photosensitive member suppressed in the generation of the positive memory and suppressed in the potential variation in the long-term repeated use, and a process cartridge and an electrophotographic apparatus having the electrophotographic photosensitive member.

The present invention is an electrophotographic photosensitive member having: a support; an electron transporting layer formed on the support; and a photosensitive layer formed on the electron transporting layer, wherein the electron transporting layer is a cured layer including carbon atoms, nitrogen atoms and oxygen atoms; and the electron transporting layer satisfies the following expressions (1) to (3):

$$\sigma(C) \leq 1.5 \quad (1),$$

$$\sigma(N) \leq 1.5 \quad (2),$$

and $$\sigma(O) \leq 1.5 \quad (3),$$

where, in the expressions (1) to (3), $\sigma(C)$ represents a standard deviation of 10 values of a ratio (atomic %) of the number of carbon atoms based on the number of all atoms except hydrogen atoms in the electron transporting layer, the 10 values being obtained by X-ray photoelectron spectroscopy (ESCA) at 10 points;

$\sigma(N)$ represents a standard deviation of 10 values of a ratio (atomic %) of the number of nitrogen atoms based on the number of all atoms except hydrogen atoms in the electron transporting layer, the 10 values being obtained by X-ray photoelectron spectroscopy (ESCA) at 10 points; and $\sigma(O)$ represents a standard deviation of 10 values of a ratio (atomic %) of the number of oxygen atoms based on the number of all atoms except hydrogen atoms in the electron transporting layer, the 10 values being obtained by X-ray photoelectron spectroscopy (ESCA) at 10 points, the 10 points consisting of an upper end point and a lower end point of the electron transporting layer, and 8 points dividing the electron transporting layer equally into 9 parts in the depth direction.

The present invention relates also to a process cartridge in which the electrophotographic photosensitive member and at least one unit selected from the group consisting of a charging unit, a developing unit, a transfer unit and a cleaning unit are integrally supported, and which is detachably attached to an electrophotographic apparatus body.

The present invention relates also to an electrophotographic photosensitive member, and an electrophotographic apparatus having a charging unit, a light irradiation unit, a developing unit and a transfer unit.

The present invention can provide an electrophotographic photosensitive member suppressed in the generation of the positive memory and suppressed in the potential variation in the long-term repeated use, and a process cartridge and an electrophotographic apparatus having the electrophotographic photosensitive member.

Further features of the present invention will become apparent from the following description of exemplary embodiments with reference to the attached drawings.

DESCRIPTION OF THE EMBODIMENTS

Figure 1A:
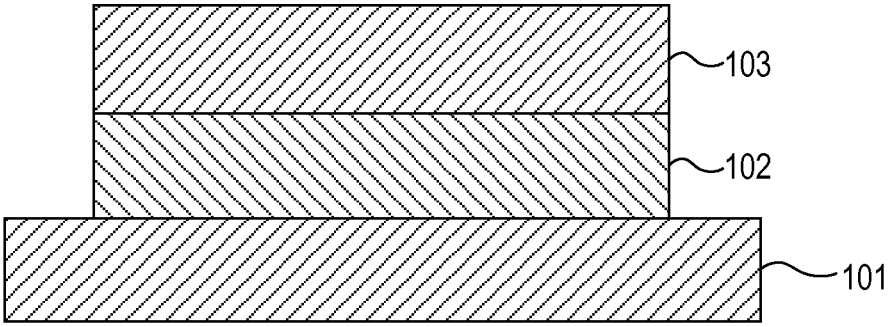
FIG. 1A is a diagram illustrating one example of a layer structure of an electrophotographic photosensitive member.

Preferred embodiments of the present invention will now be described in detail in accordance with the accompanying drawings.

First, a measurement method (hereinafter, referred to as "evaluation method according to the present invention") of evaluating whether or not an electrophotographic photosensitive member satisfies the above expression (1) according to the present invention, and an electrophotographic photosensitive member (hereinafter, referred to as "electrophotographic photosensitive member for determination") used for the evaluation method according to the present invention will be described.

In the present invention, ratios of the number of a carbon element (the number of carbon atoms), ratios of the number of an oxygen element (the number of oxygen atoms) and ratios of the number of a nitrogen element (the number of nitrogen atoms) at 10 points in an electron transporting layer are each analyzed by X-ray photoelectron spectroscopy (ESCA). The respective standard deviations, $\sigma(C)$, $\sigma(N)$ and $\sigma(O)$, of the ratios (atomic %) of the number of carbon atoms, the ratios (atomic %) of the number of nitrogen atoms and the ratios (atomic %) of the number of oxygen atoms at the 10 points at this time are calculated. The 10 points consists of an upper end point and a lower end point of the electron transporting layer, and 8 points dividing the electron transporting layer equally into 9 parts in the depth direction.

A method for dividing the thickness of an electron transporting layer equally into 9 parts in the depth direction from a photosensitive layer side includes a method in which a photosensitive layer is peeled off and the ratios of the number of the each atom of the electron transporting layer in the depth direction are analyzed using ESCA, and a method in which with the photosensitive layer being laminated, the ratios of the number of the each atom of the electron transporting layer in the depth direction are analyzed using ESCA. The method in which a photosensitive layer is peeled off and the analysis is then carried out is simpler because the time of etching in the depth direction using ESCA can be largely reduced. In the case where the etching is carried out in the depth direction from above a photosensitive layer using ESCA and the analysis of the ratios of the number of the each atom is carry out, the time point at which peculiar atoms which the photosensitive layer contains (for example, metal atoms which a charge generating substance has) come not to be measured is considered to correspond to a surface of an electron transporting layer. In determination of an interface between a support or a conductive layer described later and an electron transporting layer, up to a measurement point immediately before peculiar atoms which the support or the conductive layer contains (for example, in the case where the support is made of aluminum, the atom is Al, and in the case of the conductive layer, the atom is a metal atom which a conductive particle has) are measured, is considered the electron transporting layer.

A photosensitive layer may be a single-layer type photosensitive layer, or a laminate type (function-separation type) photosensitive layer in which a charge generating layer containing a charge generating substance and a hole transporting layer containing a hole transporting substance are separated.

A method for peeling a photosensitive layer includes a method in which an electrophotographic photosensitive member is immersed in a solvent which dissolves the photosensitive layer and hardly dissolves an electron transporting layer to thereby peel the photosensitive layer, and a method in which the photosensitive layer is ground. In the case where a laminate type photosensitive layer having a charge generating layer and a hole transporting layer, the photosensitive layer can be peeled with a solvent optimum to each of the charge generating layer and the hole transporting layer, and solvents used for a coating liquid for the charge generating layer and a coating liquid for the hole transporting layer can be used. The kinds of the solvent will be described later. An electrophotographic photosensitive member is immersed in the solvent for a photosensitive layer to be dissolved, and thereafter dried to thereby obtain an electrophotographic photosensitive member for determination. That a photosensitive layer may have been peeled off can be confirmed, for example, by that no resin components of the photosensitive layer cannot be observed by the ATR method (total reflection method) in the FTIR measuring method.

A method of grinding a photosensitive layer involves, for example, using a drum tape grinding apparatus made by Canon Inc. and using a wrapping tape (C2000, made by Fujifilm Corp.). At this time, the measurement can be carried out at the time when the photosensitive layer all disappears while the thickness of the photosensitive layer is successively measured so as not to be ground up to a electron transporting layer due to excessive grinding of the hole transporting layer and the surface of an electrophotographic photosensitive member is being observed.

Then, a method for analyzing ratios of the number of the each atom in the depth direction using an X-ray photoelectron spectroscopy (ESCA) will be described. Hereinafter, examples of an apparatus and the condition to be used will be shown.

An apparatus to be used: made by PHI Inc. (Physical Electronics Industries, Inc.), Quantum 2000 Scanning ESCA Microprobe Surfacemost and after-etching interior measurement conditions:

X-ray source: Al Ka, 1486.6 eV (25 W, 15 kV), measurement area: 100 μm,

Spectroscopic region: 1,500×300 μm, Angle: 45°,

Pass energy: 117.40 eV.

Etching Condition:

Ion gun C60 (10 kV, 2 mm×2 mm), Angle: 70°.

Figure 2:
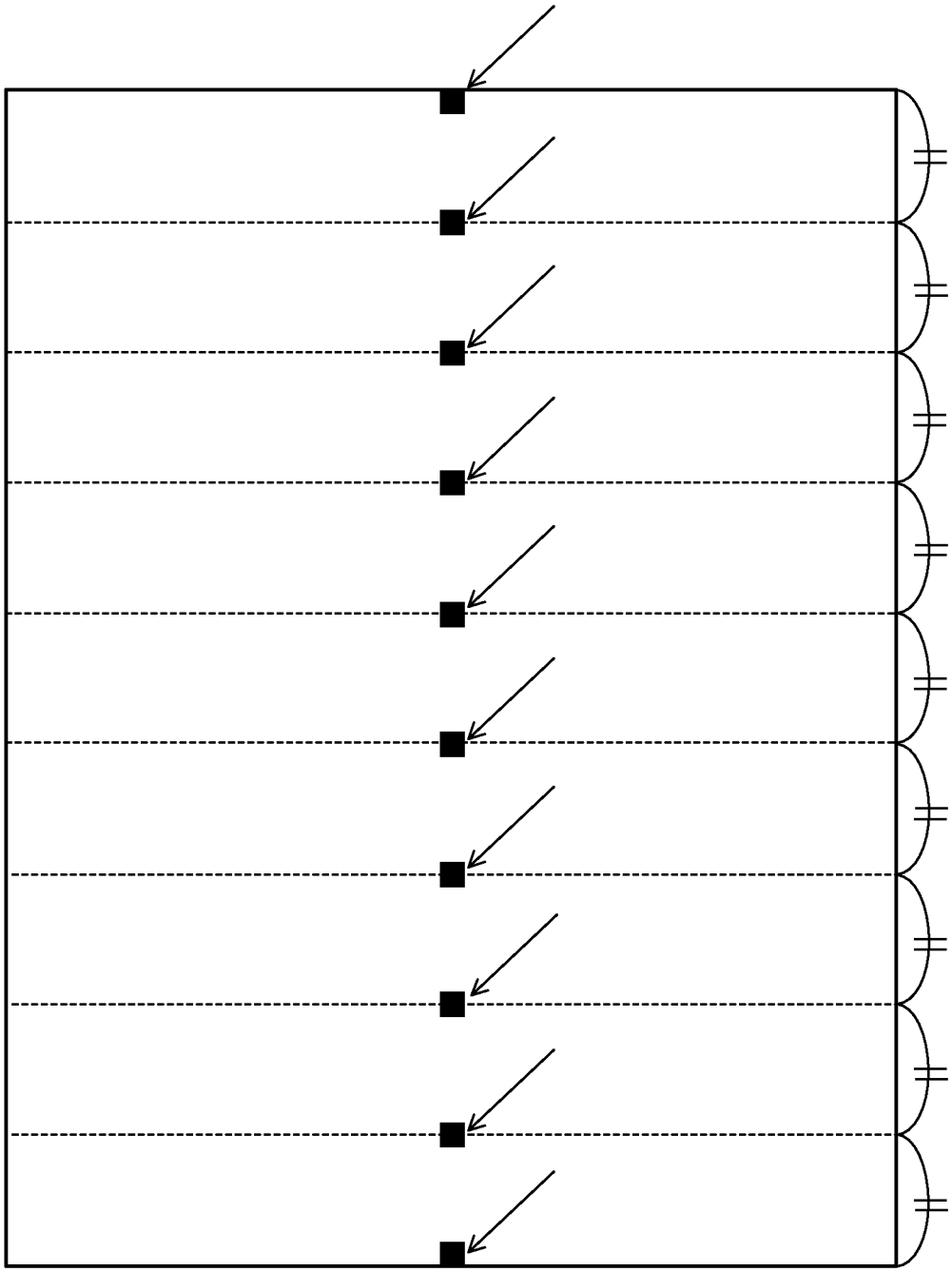
FIG. 2 is a diagram illustrating a positional relationship of 10 points at which a ratio of the number of carbon atoms, a ratio of the number of nitrogen atoms and a ratio of the number of oxygen atoms in an electron transporting layer are measured by X-ray photoelectron spectroscopy (ESCA).

The etching time required for obtaining a depth of 0.5 μm of an electron transporting layer was 30 min (0.5 μm/30 min). After the etching of the electron transporting layer, the depth was identified by a cross-sectional observation using a cross-sectional FIB-SEM (FB-2000C, made by Hitachi High-Technologies Corp.). The present invention analyzes ratios of the number of the each atom at 10 points in total consisting of an upper end point and a lower end point of an electron transporting layer, and 8 points dividing the electron transporting layer equally into 9 parts in the depth direction. As illustrated in FIG. 2, ratios of the number of the each atom are analyzed at 10 points in total of black points indicated by arrows. A method for determining an etching time includes a method in which the thickness of an electron transporting layer to be measured is measured in advance by an FIB-SEM cross-sectional observation, and the etching time is determined corresponding to the measurement. Alternatively, the analysis of ratios of the number of the each atom may be such that the analysis is carried out at every 30 sec of the etching time; up to a measurement point immediately before peculiar atoms which a support or a conductive layer contains are measured is considered an electron transporting layer; and all acquired measurement points are divided equally into 9 parts and 10 points are selected. If the analysis is carried out at every 30 sec of the etching time, for an electron transporting layer having a thickness of about 0.1 μm or more, ratios of the number of the each atom can be analyzed at 10 points equally in the depth direction.

Surface atom densities (atomic %) are calculated from peak intensities of carbon atoms, nitrogen atoms and oxygen atoms as measured under the above condition by using the relative sensitivity factors which PHI Inc. provides. The measurement peak top ranges of carbon atoms, nitrogen atoms and oxygen atoms are as follows.

C1s: 278 to 298 eV

O1s: 525 to 545 eV

N1s: 390 to 410 eV

An electron transporting layer contains carbon atoms, nitrogen atoms and oxygen atoms, but may contain atoms except those atoms. Although in order to enhance the electron withdrawability, atoms including halogen atoms such as fluorine, chlorine and bromine, silicon atoms, phosphorus atoms and sulfur atoms may be incorporated in the structure of an electron transporting layer (electron transporting substance), the contents of these atoms accounted for in the structure of the electron transporting substance is very low. Therefore, since the ratios of the number of the each atom are very low even if the ratios are analyzed by ESCA, the atoms are not suitable for determination of the standard deviations. Here, hydrogen atoms exhibit no measurement sensitivity in ESCA. Therefore, carbon atoms, oxygen atoms and nitrogen atoms are selected as atoms constituting an electron transporting layer, and standard deviations ($\sigma(C)$, $\sigma(N)$ and $\sigma(O)$) derived from the 10 respective values of the ratio of the number of carbon atoms, the ratio of the number of nitrogen atoms and the ratio of the number of oxygen atoms, respectively, are calculated. If all the standard deviations ($\sigma(C)$, $\sigma(N)$ and $\sigma(O)$) of the ratios of the number of carbon atoms, the ratios of the number of nitrogen atoms and the ratios of the number of oxygen atoms satisfy the following expressions (1) to (3), it means that carbon atoms, nitrogen atoms and oxygen atoms in an electron transporting layer are homogeneously present, and means that the electron transporting layer has high homogeneity.

$$\sigma(C) \leq 1.5 \quad (1),$$

$$\sigma(N) \leq 1.5 \quad (2),$$

and $$\sigma(O) \leq 1.5 \quad (3)$$

where, in the expressions (1) to (3), $\sigma(C)$ represents a standard deviation of 10 values of a ratio (atomic %) of the number of carbon atoms based on the number of all atoms except hydrogen atoms in the electron transporting layer, the 10 values being obtained by X-ray photoelectron spectroscopy (ESCA) at 10 points; $\sigma(N)$ represents a standard deviation of 10 values of a ratio (atomic %) of the number of nitrogen atoms based on the number of all atoms except hydrogen atoms in the electron transporting layer, the 10 values being obtained by X-ray photoelectron spectroscopy (ESCA) at 10 points; and $\sigma(O)$ represents a standard deviation of 10 values of a ratio (atomic %) of the number of oxygen atoms based on the number of all atoms except hydrogen atoms in the electron transporting layer, the 10 values being obtained by X-ray photoelectron spectroscopy (ESCA) at 10 points.

The present inventors presume the reason that if the standard deviations (σ(C), σ(N) and σ(O)) of the ratios of the number of carbon atoms, the ratios of the number of nitrogen atoms and the ratios of the number of oxygen atoms satisfy the expressions (1) to (3), it suppresses the generation of the positive memory, as follows.

If an electron transporting layer is not a cured layer but an electron transporting layer which dissolves in a solvent of a photosensitive layer, an electron transporting substance is liable to dissolve out in the photosensitive layer as an upper layer when the photosensitive layer is formed, and the injection of electrons from the photosensitive layer side to the electron transporting layer side is liable to be suppressed. Thereby, the sensitivity is liable to decrease and the memory is liable to be generated due to retention of a large amount of charge in the photosensitive layer. Therefore, making an electron transporting layer of a cured layer is suitable.

However, if an electron transporting layer is made of a cured layer, substances having the same structure used in formation of the electron transporting layer cohere, being liable to generate the component unevenness in the electron transporting layer. As a result, in the case where a positive charge is applied, the charge is liable to be retained in the electron transporting layer and the positive memory image is liable to be generated.

An electron transporting layer as a cured layer has a feature of transferring only electrons generated in a photosensitive layer to a support side and suppressing the injection of a positive charge from the support side to the photosensitive layer side. However, if a positive charge is injected from the photosensitive layer side by an application of a positive charge, electrons hardly transfer to the support side as compared to an undercoating layer, which has no electron transporting capability, conceivably making the positive memory image liable to be generated.

Then, satisfaction of the above expressions (1) to (3) conceivably indicates homogeneous presence of each of carbon atoms, nitrogen atoms and oxygen atoms in an electron transporting layer. The carbon atoms, the nitrogen atoms and the oxygen atoms are major constituting atoms in all constituting atoms of an electron transporting layer, and homogeneous presence of these three constituting atoms conceivably means the formation of the electron transporting layer having high homogeneity. Then, an electron transporting layer being homogeneous, even if a positive charge is applied and a positive charge is injected from the photosensitive layer side, suppresses a decrease in the transfer of electrons to the support side and makes the transfer of electrons to be smooth. It is presumed that the generation of the positive memory is thereby suppressed.

In an electron transporting layer, the sum (atomic %) of the ratio (atomic %) of the number of carbon atoms, the ratio (atomic %) of the number of nitrogen atoms and the ratio (atomic %) of the number of oxygen atoms can be 50% or more and 100% or less (excluding hydrogen atoms, which exhibit no measurement sensitivity in ESCA), and is more preferably 90% or more and 100% or less.

The electrophotographic photosensitive member according to the present invention is an electrophotographic photosensitive member having a support, an electron transporting layer formed on the support, a charge generating layer formed on the electron transporting layer and a hole transporting layer formed on the charge generating layer. The electrophotographic photosensitive member is alternatively an electrophotographic photosensitive member having a support, an electron transporting layer formed on the support, and a photosensitive layer formed on the electron transporting layer. The photosensitive layer can be a laminate-type (function-separation type) photosensitive layer in which a charge generating layer containing a charge generating substance and a hole transporting layer containing a hole transporting substance are separated.

Figure 1B:
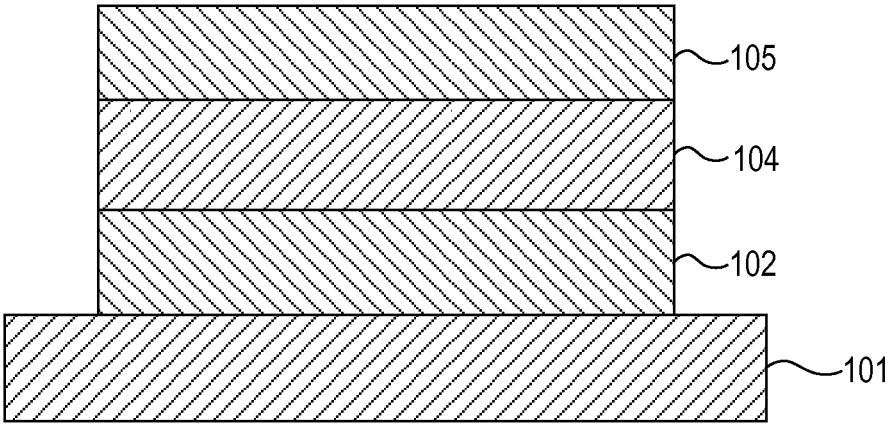
FIG. 1B is a diagram illustrating one example of a layer structure of an electrophotographic photosensitive member.

FIGS. 1A and 1B are a diagram illustrating one example of a layer constitution of the electrophotographic photosensitive member according to the present invention. In FIGS. 1A and 1B, reference numeral 101 denotes a support; reference numeral 102 denotes an electron transporting layer; reference numeral 103 denotes a photosensitive layer; reference numeral 104 denotes a charge generating layer; and reference numeral 105 denotes a hole transporting layer.

As a usual electrophotographic photosensitive member, a cylindrical electrophotographic photosensitive member in which a photosensitive layer (a charge generating layer, a hole transporting layer) are formed on a cylindrical support is broadly used, but an otherwise shaped one such as a belt-shaped or sheet-shaped one may be used.

[Electron Transporting Layer]

The electron transporting layer according to the present invention is a cured layer containing carbon atoms, nitrogen atoms and oxygen atoms as constituting atoms. From the viewpoint of the homogeneity of the electron transporting layer, the electron transporting layer can contain a polymer obtained by polymerizing a composition containing an electron transporting substance having polymerizable functional groups, a thermoplastic resin having polymerizable functional groups, and a crosslinking agent.

If the respective standard deviations, σ(C), σ(N) and σ(O), of the ratios of the number of carbon atoms, the ratios of the number of oxygen atoms and the ratios of the number of nitrogen atoms at the above-mentioned 10 points satisfy the following expressions (4) to (6), the homogeneity of an electron transporting structure of an electron transporting layer is improved and an effect of more reducing the generation of the positive memory is acquired, which is therefore preferable.

$$\sigma(C) \leq 1.0 \quad (4),$$

$$\sigma(N) \leq 1.0 \quad (5),$$

and $$\sigma(O) \leq 1.0 \quad (6)$$

[Electron Transporting Substance]

Examples of electron transporting substances include quinone compounds, imide compounds, benzimidazole compounds and cyclopentadienylidene compounds. An electron transporting substance can be an electron transporting substance having polymerizable functional groups. The polymerizable functional group includes a hydroxy group, a thiol group, an amino group, a carboxyl group and a methoxy group.

The molecular weight of an electron transporting substance having polymerizable functional groups closer to the molecular weight of a crosslinking agent more enhances the homogeneity of the electron transporting layer, which is therefore preferable. The ratio of the molecular weight of an electron transporting substance and the molecular weight of a crosslinking agent can be in the range of 0.5 to 1.5, and is more preferably in the range of 0.8 to 1.2. In the case where the molecular weight (Mw) of an electron transporting substance is 1,000 or less, the electron transporting substance homogeneously bonds with a thermoplastic resin having polymerizable functional groups, and an effect of reducing the positive memory image can be acquired, which is therefore preferable. The molecular weight is more preferably 200 or more and 840 or less.

Hereinafter, specific examples of the electron transporting substance are shown. The electron transporting substance includes compounds represented by one of the following formulae (A1) to (A9).

(A1)

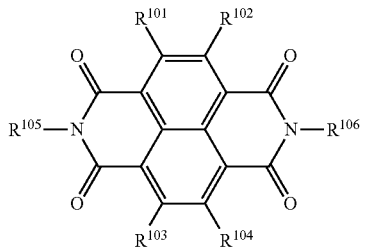

-continued (A2)

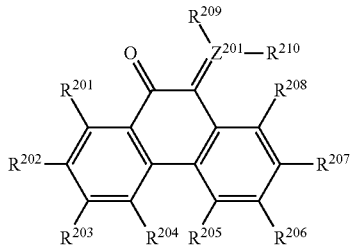

(A3)

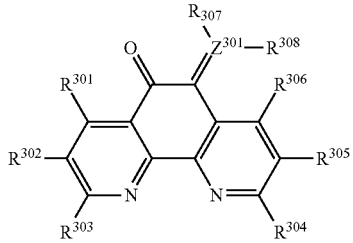

(A4)

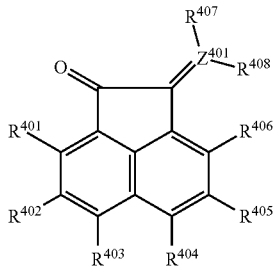

(A5)

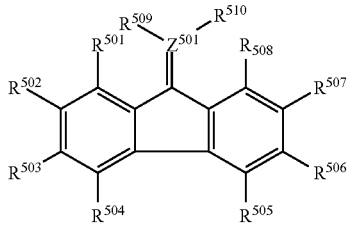

(A6)

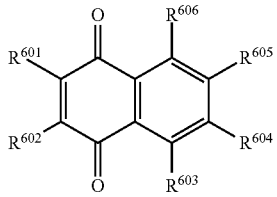

(A7)

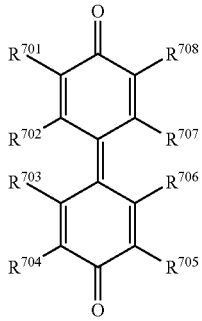

-continued (A8)

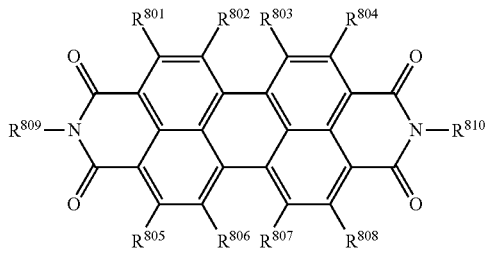

(A9)

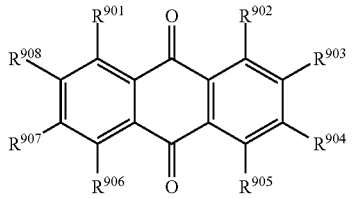

In the formulae (A1) to (A9), $R^{101}$ to $R^{111}$, $R^{201}$ to $R^{210}$, $R^{301}$ to $R^{308}$, $R^{401}$ to $R^{408}$, $R^{501}$ to $R^{510}$, $R^{601}$ to $R^{606}$, $R^{701}$ to $R^{708}$, $R^{801}$ to $R^{810}$ and $R^{901}$ to $R^{908}$ each independently represent a monovalent group represented by the following formula (A), a hydrogen atom, a cyano group, a nitro group, a halogen atom, an alkoxycarbonyl group, a substituted or unsubstituted alkyl group, a substituted or unsubstituted aryl group or a substituted or unsubstituted heterocycle. One of carbon atoms in the main chain of the alkyl group may be replaced by O, S, NH or $NR^{1001}$ ($R^{1001}$ is an alkyl group). The substituent of the substituted alkyl group is an alkyl group, an aryl group, an alkoxycarbonyl group, or a halogen atom. The substituents of the substituted aryl group or the substituted heterocyclic group are a halogen atom, a nitro group, a cyano group, an alkyl group and a halogen-substituted alkyl group. $Z^{201}$, $Z^{301}$, $Z^{401}$ and $Z^{501}$ each independently represent a carbon atom, a nitrogen atom or an oxygen atom. In the case where $Z^{201}$ is an oxygen atom, $R^{209}$ and $R^{210}$ are not present, and in the case where $Z^{201}$ is a nitrogen atom, $R^{210}$ is not present. In the case where $Z^{301}$ is an oxygen atom, $R^{307}$ and $R^{308}$ are not present, and in the case where $Z^{301}$ is a nitrogen atom, $R^{308}$ is not present. In the case where $Z^{401}$ is an oxygen atom, $R^{407}$ and $R^{408}$ are not present, and in the case where $Z^{401}$ is a nitrogen atom, $R^{408}$ is not present. In the case where $Z^{501}$ is an oxygen atom, $R^{509}$ and $R^{510}$ are not present, and in the case where $Z^{501}$ is a nitrogen atom, $R^{510}$ is not present.

$$-(\alpha)_l-(\beta)_m\gamma \quad \text{(A)}$$

In the formula (A), at least one of α, β and γ is a group having a substituent, and the substituent is at least one group selected from the group consisting of a hydroxy group, a thiol group, an amino group, a carboxyl group and a methoxy group. l and m are each independently 0 or 1, and the sum of 1 and m is 0 to 2.

α represents an alkylene group having 1 to 6 atoms in the main chain, an alkylene group having 1 to 6 atoms in the main chain and being substituted with an alkyl group having 1 to 6 carbon atoms, an alkylene group having 1 to 6 atoms in the main chain and being substituted with a benzyl group, an alkylene group having 1 to 6 atoms in the main chain and being substituted with an alkoxycarbonyl group, or an alkylene group having 1 to 6 atoms in the main chain and being substituted with a phenyl group, and these groups may have at least one substituent selected from the group consisting of a hydroxy group, a thiol group, an amino group, a carboxyl group and a methoxy group. One of carbon atoms in the main chain of the alkylene group may be replaced by O, S, NH or $NR^{19}$ ($R^{19}$ is an alkyl group).

β represents a phenylene group, a phenylene group substituted with an alkyl having 1 to 6 carbon atoms, a nitro-substituted phenylene group, a halogen-substituted phenylene group or an alkoxy group-substituted phenylene group, and these groups may have at least one substituent selected from the group consisting of a hydroxy group, a thiol group, an amino group, a carboxyl group and a methoxy group.

γ represents a hydrogen atom, an alkyl group having 1 to 6 atoms in the main chain, or an alkyl group having 1 to 6 atoms in the main chain and being substituted with an alkyl group having 1 to 6 carbon atoms, and these groups may have at least one substituent selected from the group consisting of a hydroxy group, a thiol group, an amino group, a carboxyl group and a methoxy group. One of carbon atoms in the main chain of the alkyl group may be replaced by O, S, NH or $NR^{1003}$ ($R^{1003}$ is an alkyl group).

Among electron transporting substances represented by one of the above formulae (A-1) to (A-9), electron transporting substances are more preferable which have a polymerizable functional group being a monovalent group represented by the above formula (A) for at least one of $R^{101}$ to $R^{106}$, at least one of $R^{201}$ to $R^{210}$, at least one of $R^{301}$ to $R^{308}$, at least one of $R^{401}$ to $R^{408}$, at least one of $R^{501}$ to $R^{510}$, at least one of $R^{601}$ to $R^{606}$, at least one of $R^{701}$ to $R^{708}$, at least one of $R^{801}$ to $R^{810}$ and at least one of $R^{901}$ to $R^{908}$.

An electron transporting layer can involve forming a coating film of a coating liquid for the electron transporting layer containing a composition containing an electron transporting substance having polymerizable functional groups, a thermoplastic resin having polymerizable functional groups and a crosslinking agent, and drying the coating film by heating to polymerize the composition to thereby form the electron transporting layer. After the formation of the coating film, the crosslinking agent and the polymerizable functional groups of the thermoplastic resin and the electron transporting substance are polymerized by the chemical reaction, and the chemical reaction is promoted by heating at this time to thereby promote the polymerization. The heating temperature when the coating film of a coating liquid for an electron transporting layer is dried by heating can be 100 to 200° C.

In the Tables, the symbol A' is represented by the same structure as the symbol A, and specific examples of the monovalent group are shown in the columns of A and A'.

Hereinafter, specific examples of electron transporting substances having polymerizable functional groups will be described. Specific examples of compounds represented by the above formula (A1) are shown in Table 1-1, Table 1-2, Table 1-3, Table 1-4, Table 1-5 and Table 1-6. In the Tables, the case where γ is "-" indicates a hydrogen atom, and the hydrogen atom for the γ is incorporated into the structure given in the column of α or β.

TABLE 1-1
| Compound | | | | | | | A | | |
|---|---|---|---|---|---|---|---|---|---|
| Example | $R^{101}$ | $R^{102}$ | $R^{103}$ | $R^{104}$ | $R^{105}$ | $R^{106}$ | α | β | γ |
| A101 | H | H | H | H | 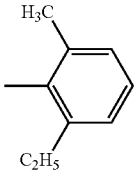 | A | 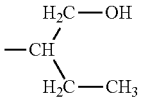 | — | — |
| A102 | H | H | H | H | 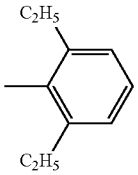 | A | 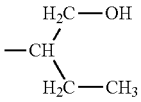 | — | — |
| A103 | H | H | H | H | 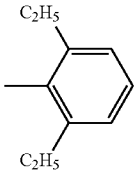 | A | — | 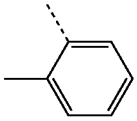 | 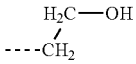 |
| A104 | H | H | H | H | 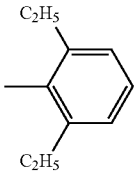 | A | — | 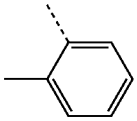 | 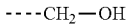 |
| A105 | H | H | H | H | 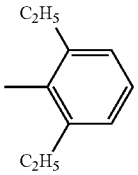 | A | — | 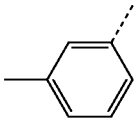 | 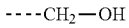 |
| A106 | H | H | H | H | 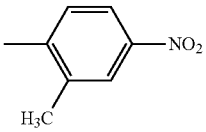 | A | 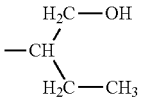 | — | — |
| A107 | H | H | H | H | 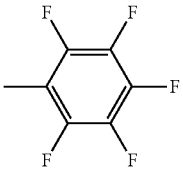 | A | 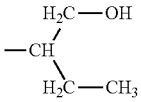 | — | — |
| A108 | H | H | H | H | 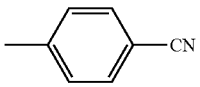 | A | 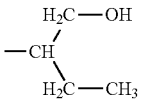 | — | — |

TABLE 1-1-continued
| Compound | | | | | | | A | | |
|---|---|---|---|---|---|---|---|---|---|
| Example | $R^{101}$ | $R^{102}$ | $R^{103}$ | $R^{104}$ | $R^{105}$ | $R^{106}$ | α | β | γ |
| A109 | H | H | H | H | 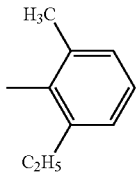 | A | —$C_5H_{10}$—OH | — | — |
| A110 | H | H | H | H | —$C_6H_{13}$ | A | 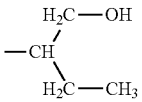 | — | — |
| A111 | H | H | H | H | 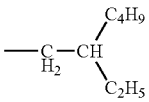 | A | — | 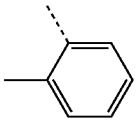 | 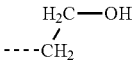 |
| A112 | H | H | H | H | 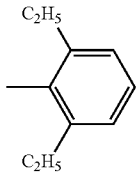 | A | — | 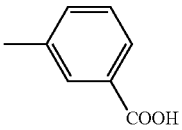 | — |
| A113 | H | H | H | H | 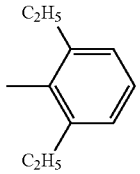 | A | — | 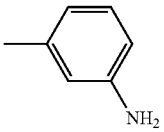 | — |
| A114 | H | H | H | H | 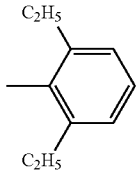 | A | — | 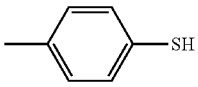 | — |
| A115 | H | H | H | H | 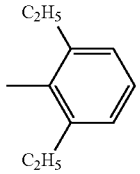 | A | — | 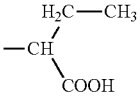 | — |
| A116 | H | H | H | H | 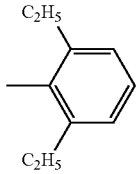 | A | — | 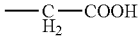 | — |

TABLE 1-2
| | | | | | | | | | |
|---|---|---|---|---|---|---|---|---|---|
| A117 | H | H | H | H | 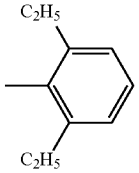 | A | — | 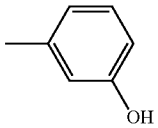 | — |
| A118 | H | H | H | H | 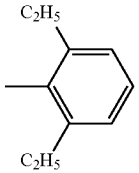 | A | — | 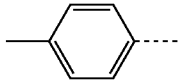 | 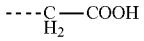 |
| A119 | 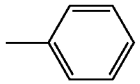 | H | H | 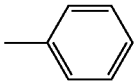 | 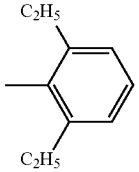 | A | 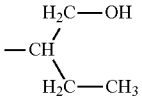 | — | — |
| A120 | CN | H | H | CN | 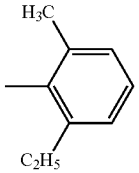 | A | 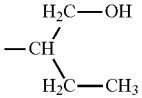 | — | — |
| A121 | A | H | H | H | 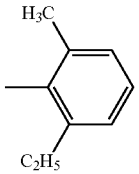 | 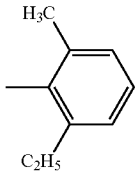 | — | — | —COOH |

TABLE 1-2-continued
| | | | | | | | | | |
|---|---|---|---|---|---|---|---|---|---|
| A122 | H | NO2 | H | NO2 | 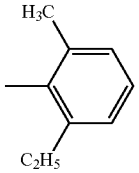 | A | 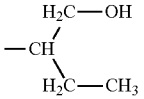 | — | — |
| A123 | H | H | H | H | 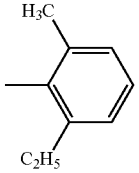 | A | 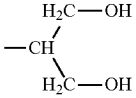 | — | — |
| A124 | H | H | H | H | A | A | 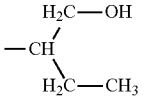 | — | — |
| A125 | H | H | H | H | A | A | — | 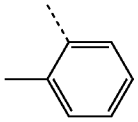 | ----$CH_2$—OH |
| A126 | H | H | H | H | A | A | — | 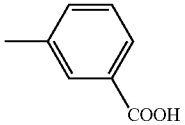 | — |
| A127 | H | H | H | H | A | A | — | 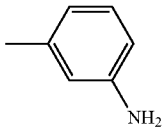 | — |
| A128 | H | H | H | H | A | A | — | 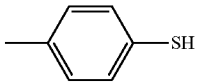 | — |

TABLE 1-2-continued
| | | | | | | | | | |
|---|---|---|---|---|---|---|---|---|---|
| A129 | H | H | H | H | A | A | — | 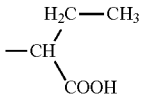 | — |
| A130 | H | H | H | H | A | A | — | 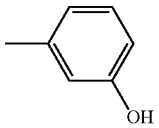 | — |
| A131 | H | H | H | H | 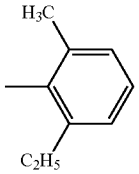 | A | 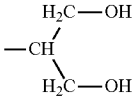 | — | — |
| A132 | H | H | H | H | 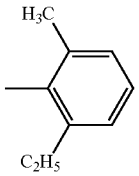 | A | 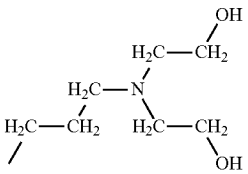 | — | — |
| A133 | H | H | H | H | 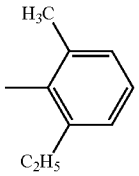 | A | 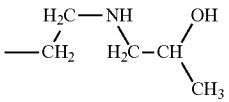 | — | — |

TABLE 1-3
| | | | | | | | | | |
|---|---|---|---|---|---|---|---|---|---|
| A134 | H | H | H | H | 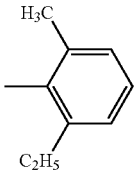 | A | 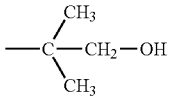 | — | — |
| A135 | H | H | H | H | A | A | 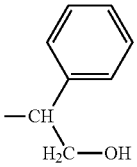 | — | — |
| A136 | H | H | H | H | A | A | 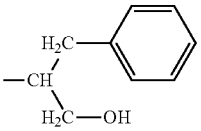 | — | — |
| A137 | H | H | H | H | A | A | 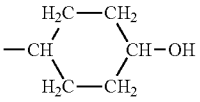 | — | — |
| A138 | H | H | H | H | A | A | — | 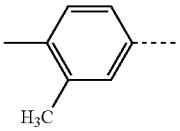 | 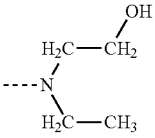 |
| A139 | H | H | H | H | 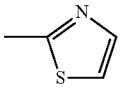 | A | 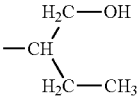 | — | — |
| A140 | H | H | H | H | 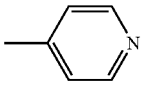 | H | 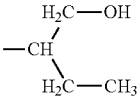 | — | — |
| A141 | H | H | H | H | 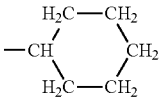 | A | 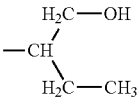 | — | — |
| A142 | H | H | H | H | A | A | 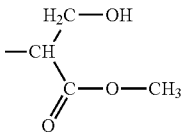 | — | — |
| A143 | CN | H | H | CN | 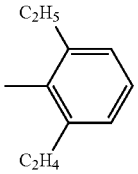 | A | 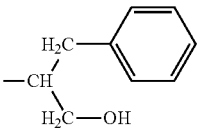 | — | — |

TABLE 1-3-continued

| | | | | | | | | | |
|---|---|---|---|---|---|---|---|---|---|
| A144 | H | H | H | H | $—C_2H_4—O—C_2H_5$ | A | $H_2C—OH$ / $—CH$ / $H_2C—CH_3$ | — | — |
| A145 | H | H | H | H | $CF_3$ | A | $—C_2H_4—O—C_2H_4—OH$ | — | — |
| A146 | H | H | H | H | A | A | $H_2C—OH$ / $—CH$ / $COOH$ | — | — |
| A147 | H | H | H | H | $—CH_2CH_2—$ | A | $H_2C—OH$ / $—CH$ / $H_2C—CH_3$ | — | — |
| A148 | H | H | H | H | O, NH, O, NH, O | A | $—C_2H_4—O—C_2H_4—OH$ | — | — |
| A149 | H | H | H | H | F | A | $—CH_2CH_2$ - - - | - - - OH | — |
| A150 | H | H | H | H | $OCH_3$ | A | — | COOH, COOH | — |
| A151 | H | H | H | H | A | A | — | | - - - $CH_2—OH$ |

TABLE 1-4

| Compound | | | | | | | A | | |
|---|---|---|---|---|---|---|---|---|---|
| Example | $R^{101}$ | $R^{102}$ | $R^{103}$ | $R^{104}$ | $R^{105}$ | $R^{106}$ | α | β | γ |
| A152 | H | H | H | H | A | A' | $H_2C—OH$ / $—CH$ / $H_2C—CH_3$ | — | — |
| A153 | H | H | H | H | A | A' | — | | - - - $CH_2—OH$ |

TABLE 1-4-continued
| | | | | | | | | | |
|---|---|---|---|---|---|---|---|---|---|
| A154 | H | H | H | H | A | A' | — | 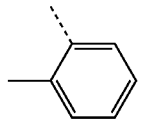 | ----C(H$_2$)—COOH |
| A155 | H | H | H | H | A | A' | — | —OCH$_3$ | — |
| A156 | H | H | H | H | A | A' | 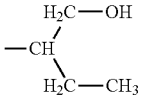 | — | — |
| Compound | A' | | |
|---|---|---|---|
| Example | α | β | γ |
| A152 | —(CH$_2$)$_5$—OH | — | — |
| A153 | —(CH$_2$)$_5$—OH | — | — |
| A154 | ----C(H$_2$)—COOH | — | — |
| A155 | 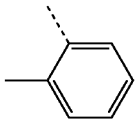 | ----CH$_2$—OH | — |
| A156 | 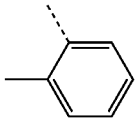 | ----CH$_2$—OH | — |
TABLE 1-5
| Compound | | | | | | | A | | | A' | | |
|---|---|---|---|---|---|---|---|---|---|---|---|---|
| Example | $R^{101}$ | $R^{102}$ | $R^{103}$ | $R^{104}$ | $R^{105}$ | $R^{106}$ | α | β | γ | α | β | γ |
| A157 | H | H | H | H | A | A' | 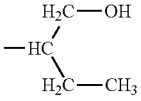 | — | — | 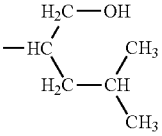 | — | — |
| A158 | H | H | H | H | A | A' | —C$_2$H$_4$—O—C$_2$H$_4$—OH | — | — | 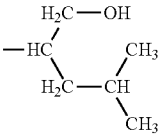 | — | — |
| A159 | H | H | H | H | A | A' | —C$_6$H$_{12}$—OH | — | — | 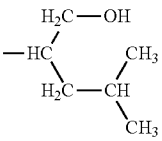 | — | — |

TABLE 1-5-continued
| Compound | | | | | | | A | | | A' | | |
|---|---|---|---|---|---|---|---|---|---|---|---|---|
| Example | $R^{101}$ | $R^{102}$ | $R^{103}$ | $R^{104}$ | $R^{105}$ | $R^{106}$ | α | β | γ | α | β | γ |
| A160 | H | H | H | H | A | A' | —$C_3H_6$—N(H)—$C_2H_4$—OH | — | — | 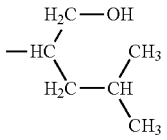 | — | — |
| A161 | H | H | H | H | A | A' | —$C_2H_4$—O—$C_2H_4$—OH | — | — | 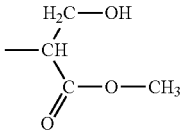 | — | — |
| A162 | H | H | H | H | A | A' | —$C_2H_4$—O—$C_2H_4$—OH | — | — | 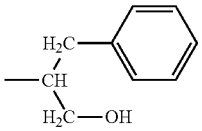 | — | — |
| A163 | H | H | H | H | A | A' | —$C_2H_4$—S—$C_2H_4$—OH | — | — | 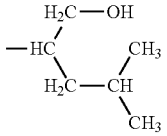 | — | — |
| A164 | H | H | H | H | A | A' | 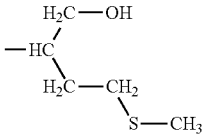 | — | — | 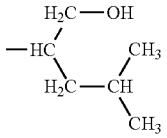 | — | — |
| A165 | H | H | H | H | A | A' | 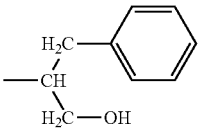 | — | — | 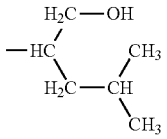 | — | — |
| A166 | H | H | H | H | A | A' | 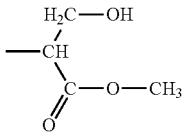 | — | — | 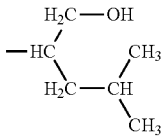 | — | — |
| A167 | H | H | H | H | A | A' | —$C_2H_4$—S—$C_2H_4$—OH | — | — | 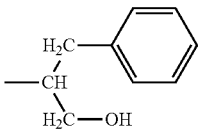 | — | — |

TABLE 1-6
| Compound Example | $R^{101}$ | $R^{102}$ | $R^{103}$ | $R^{104}$ | $R^{105}$ | $R^{106}$ | A α | A β | A γ |
|---|---|---|---|---|---|---|---|---|---|
| A168 | H | H | H | H | A | A | 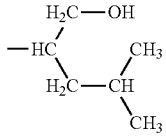 | — | — |
| A169 | H | H | H | H | A | A | 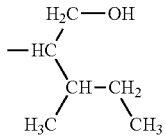 | — | — |
| A170 | H | H | H | H | A | A | 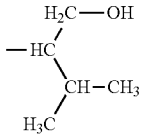 | — | — |
| A171 | H | H | H | H | $—C_6H_{12}—OH$ | A | 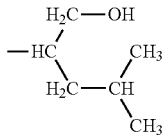 | — | — |
| A172 | H | H | H | H | 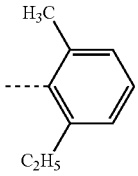 | A | 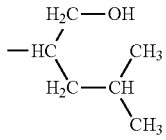 | — | — |
| A173 | H | H | H | H | A | A | 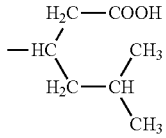 | — | — |
| A174 | H | H | H | H | 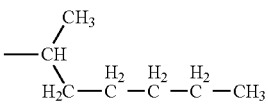 | A | $—C_2H_4—S—C_2H_4—OH$ | — | — |

TABLE 1-6-continued

| Compound Example | $R^{101}$ | $R^{102}$ | $R^{103}$ | $R^{104}$ | $R^{105}$ | $R^{106}$ | A α | A β | A γ |
|---|---|---|---|---|---|---|---|---|---|
| A175 | H | H | H | H | A | A | 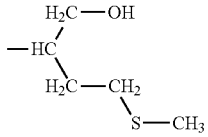 | — | — |
| A176 | H | H | H | H | A | A | 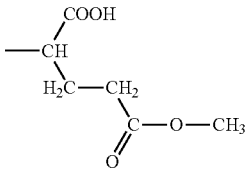 | — | — |
| A177 | H | H | H | H | $—C_2H_4—O—C_2H_5$ | A | 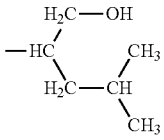 | — | — |
| A178 | H | H | H | H | $—C_2H_4—S—C_2H_5$ | A | 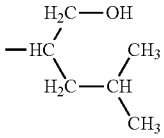 | — | — |
| A179 | H | H | H | H | $—C_2H_4—\overset{H}{N}—C_4H_9$ | A | 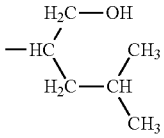 | — | — |
| A180 | H | H | H | H | 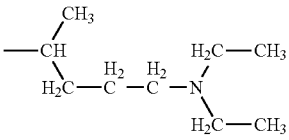 | A | 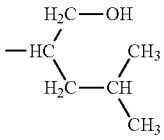 | — | — |
| A181 | H | H | H | H | 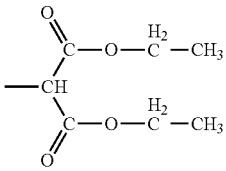 | A | 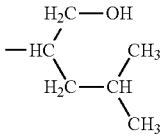 | — | — |

Specific examples of compounds represented by the above formula (A2) are shown in Table 2-1, Table 2-2 and Table 2-3.

In the Tables, the case where γ is "-" indicates a hydrogen atom, and the hydrogen atom for the γ is incorporated into the structure given in the column of α or β.

TABLE 2-1
| Compound Example | $R^{201}$ | $R^{202}$ | $R^{203}$ | $R^{204}$ | $R^{205}$ | $R^{206}$ | $R^{207}$ | $R^{208}$ | $R^{209}$ | $R^{210}$ | $Z^{201}$ | A α | A β | A γ |
|---|---|---|---|---|---|---|---|---|---|---|---|---|---|---|
| A201 | H | H | A | H | H | H | H | H | — | — | O | — | 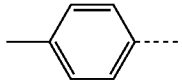 | ----$CH_2$—OH |
| A202 | H | H | A | H | H | H | H | H | — | — | O | — | 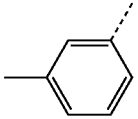 | ----$CH_2$—OH |
| A204 | H | H | A | H | H | H | H | H | — | — | O | — | 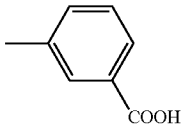 | — |
| A205 | H | H | A | H | H | H | H | H | — | — | O | — | 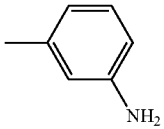 | — |
| A206 | H | H | A | H | H | H | H | H | — | — | O | — | 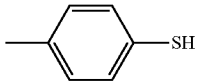 | — |

TABLE 2-1-continued
| Compound Example | $R^{201}$ | $R^{202}$ | $R^{203}$ | $R^{204}$ | $R^{205}$ | $R^{206}$ | $R^{207}$ | $R^{208}$ | $R^{209}$ | $R^{210}$ | $Z^{201}$ | A α | A β | A γ |
|---|---|---|---|---|---|---|---|---|---|---|---|---|---|---|
| A207 | H | H | H | H | H | H | H | H | A | — | N | — | 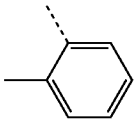 | 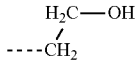 |
| A208 | H | H | H | H | H | H | H | H | A | — | N | — | 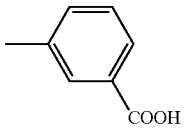 | — |
| A209 | H | H | H | H | H | H | H | H | A | — | N | — | 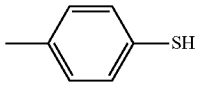 | — |
| A210 | H | H | H | H | H | H | H | H | A | — | N | 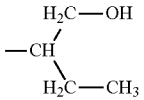 | — | — |
| A211 | CH3 | H | H | H | H | H | H | $CH_3$ | A | — | N | — | 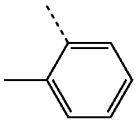 | 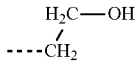 |

TABLE 2-1-continued
| Compound Example | $R^{201}$ | $R^{202}$ | $R^{203}$ | $R^{204}$ | $R^{205}$ | $R^{206}$ | $R^{207}$ | $R^{208}$ | $R^{209}$ | $R^{210}$ | $Z^{201}$ | A α | A β | A γ |
|---|---|---|---|---|---|---|---|---|---|---|---|---|---|---|
| A212 | H | Cl | H | H | H | H | Cl | H | A | — | N | — | 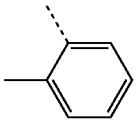 | 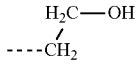 |
| A213 | H | H | 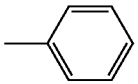 | H | H | 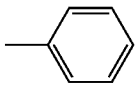 | H | H | A | — | N | — | 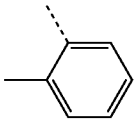 | 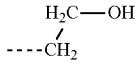 |
| A214 | H | H | 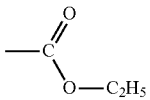 | H | H | 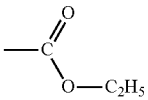 | H | H | A | — | N | — | 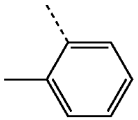 | 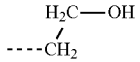 |
| A215 | H | H | H | $NO_2$ | $NO_2$ | H | H | H | A | — | N | — | 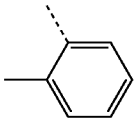 | 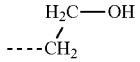 |
| A216 | H | H | A | H | H | A | H | H | — | — | O | — | 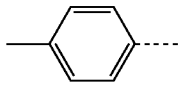 | 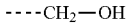 |
| A217 | H | H | A | H | H | A | H | H | — | — | O | — | 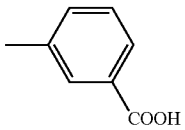 | — |

TABLE 2-2
| | | | | | | | | | | |
|---|---|---|---|---|---|---|---|---|---|---|
| A218 | H | H | A | H | H | A | H | H | — | — |
| A219 | H | H | A | H | H | A | H | H | — | — |
| A220 | H | H | A | H | H | A | H | H | — | — |
| A221 | H | H | A | H | H | A | H | H | — | — |
| A222 | H | H | A | H | H | A | H | H | — | — |
| A223 | H | H | A | H | H | A | H | H | — | — |
| A224 | H | A | H | H | H | H | A | H | — | — |
| A225 | H | H | A | H | H | A | H | H | CN | CN |
| A226 | H | H | A | H | H | A | H | H | CN | CN |
| A227 | H | H | A | H | H | A | H | H | CN | CN |
| A228 | H | H | A | H | H | A | H | H | CN | CN |
| A229 | H | H | A | H | H | A | H | H | CN | 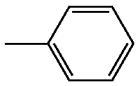 |
| A230 | H | H | A | H | H | A | H | H | 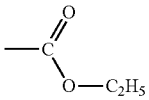 | 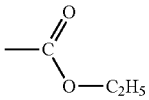 |
| A231 | H | H | H | H | H | H | H | H | A | A |
| A232 | H | $NO_2$ | H | H | H | H | $NO_2$ | H | A | — |
| A233 | H | H | | H | H | A | H | H | — | — |
| | | | | |
|---|---|---|---|---|
| A218 | O | — | 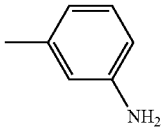 | — |
| A219 | O | — | 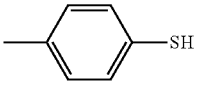 | — |
| A220 | O | 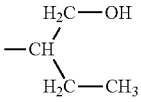 | — | — |
| A221 | O | 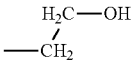 | — | — |
| A222 | O | — | — | COOH |
| A223 | O | — | — | $NH_2$ |
| A224 | O | — | 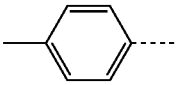 | ----$CH_2$—OH |
| A225 | C | — | 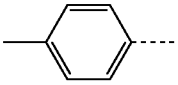 | ----$CH_2$—OH |
| A226 | C | — | 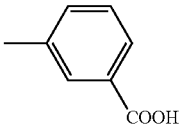 | — |
| A227 | C | — | 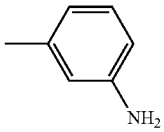 | — |

TABLE 2-2-continued
| | | | | |
|---|---|---|---|---|
| A228 | C | — | 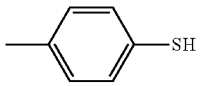 | — |
| A229 | C | — | 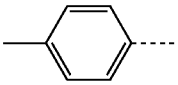 | ----$CH_2$—OH |
| A230 | C | — | 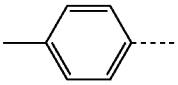 | ----$CH_2$—OH |
| A231 | C | — | — | COOH |
| A232 | N | — | 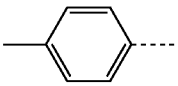 | $H_2C$—OH / ----$CH_2$ |
| A233 | O | — | 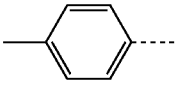 | ----$CH_2$—OH |
TABLE 2-3
| Compound Example | $R^{201}$ | $R^{202}$ | $R^{203}$ | $R^{204}$ | $R^{205}$ | $R^{206}$ | $R^{207}$ | $R^{208}$ | $R^{209}$ | $R^{210}$ | $Z^{201}$ | A α | A β | A γ |
|---|---|---|---|---|---|---|---|---|---|---|---|---|---|---|
| A234 | H | A | H | H | H | H | A' | H | — | — | O | $H_2C$—OH / —CH \ $H_2C$—$CH_3$ | — | — |
| A235 | H | A | H | H | H | H | A' | H | — | — | O | — | 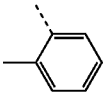 | ---$CH_2$—OH |
| A236 | H | A' | H | H | H | H | A' | H | — | — | O | — | 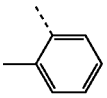 | --C—COOH ($H_2$) |
| Compound Example | κ α | κ β | κ γ |
|---|---|---|---|
| A234 | — | 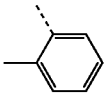 | ---$CH_2$—OH |
| A235 | —$(CH_2)_5$OH | — | — |
| A236 | --C—COOH ($H_2$) | — | — |

Specific examples of compounds represented by the above formula (A3) are shown in Table 3-1 and Table 3-2. In the Tables, the case where γ is "-" indicates a hydrogen atom, and the hydrogen atom for the γ is incorporated into the structure given in the column of α or β.

TABLE 3-1

| Compound Example | $R^{301}$ | $R^{302}$ | $R^{303}$ | $R^{304}$ | $R^{305}$ | $R^{306}$ | $R^{307}$ | $R^{308}$ | $Z^{301}$ |
|---|---|---|---|---|---|---|---|---|---|
| A301 | H | A | H | H | H | H | — | — | O |
| A302 | H | A | H | H | H | H | — | — | O |
| A303 | H | A | H | H | H | H | — | — | O |
| A304 | H | A | H | H | H | H | — | — | O |
| A305 | H | A | H | H | H | H | — | — | O |
| A306 | H | H | H | H | H | H | A | — | N |
| A307 | H | H | H | H | H | H | A | — | N |
| A308 | H | H | H | H | H | H | A | — | N |
| A309 | $CH_3$ | H | H | H | H | $CH_3$ | A | — | N |
| A310 | H | H | Cl | Cl | H | H | A | — | N |
| A311 | H | 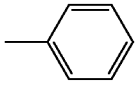 | H | H | 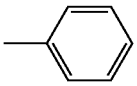 | H | A | — | N |
| A312 | H | 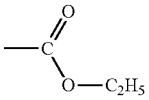 | H | H | 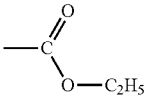 | H | A | — | N |
| A313 | H | H | H | H | H | H | A | — | N |
| A314 | H | A | H | H | A | H | — | — | O |
| A315 | H | A | H | H | A | H | — | — | O |

| Compound Example | A α | A β | A γ |
|---|---|---|---|
| A301 | — | 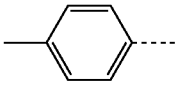 | ----$CH_2$—OH |
| A302 | — | 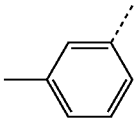 | ----$CH_2$—OH |
| A303 | — | 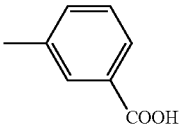 | — |
| A304 | — | 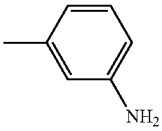 | — |
| A305 | — | 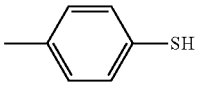 | — |
| A306 | — | 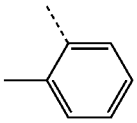 | 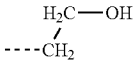 |

TABLE 3-1-continued
| | | | |
|---|---|---|---|
| A307 | — | 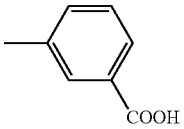 | — |
| A308 | 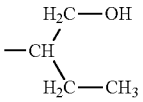 | — | — |
| A309 | — | 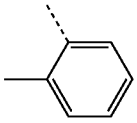 | 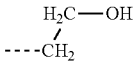 |
| A310 | — | 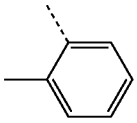 | 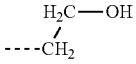 |
| A311 | — | 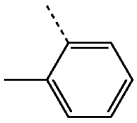 | 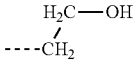 |
| A312 | — | 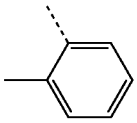 | 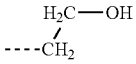 |
| A313 | — | 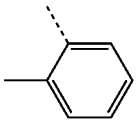 | 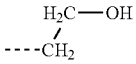 |
| A314 | — | 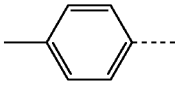 | 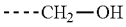 |
| A315 | — | 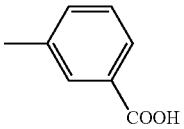 | — |
TABLE 3-2
| | | | | | | | | | | | |
|---|---|---|---|---|---|---|---|---|---|---|---|
| A316 | H | A | H | H | A | H | — | — | O | — | 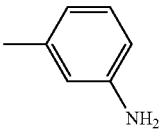 | — |
| A317 | H | A | H | H | A | H | — | — | O | — | 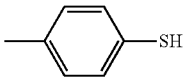 | — |

TABLE 3-2-continued
| | | | | | | | | | | | | |
|---|---|---|---|---|---|---|---|---|---|---|---|---|
| A318 | H | A | H | H | A | H | — | — | O | $H_2C—OH$ / $—CH$ \ $H_2C—CH_3$ | — | — |
| A319 | H | A | H | H | A | H | — | — | O | $H_2C—OH$ / $—CH_2$ | — | — |
| A320 | H | A | H | H | A | H | — | — | O | — | — | COOH |
| A321 | H | A | H | H | A | H | — | — | O | — | — | $NH_2$ |
| A322 | H | H | A | A | H | H | — | — | O | — | 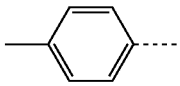 | ----$CH_2—OH$ |
| A323 | H | A | H | H | A | H | CN | CN | C | — | 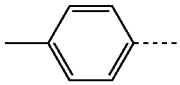 | ----$CH_2—OH$ |
| A324 | H | A | H | H | A | H | CN | CN | C | — | 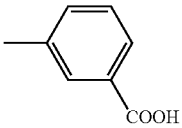 | — |
| A325 | H | A | H | H | A | H | CN | CN | C | — | 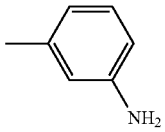 | — |
| A326 | H | A | H | H | A | H | CN | CN | C | — | 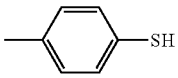 | — |
| A327 | H | A | H | H | A | H | CN | 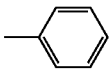 | C | — | 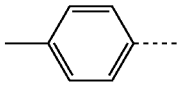 | ----$CH_2—OH$ |
| A328 | H | A | H | H | A | H | 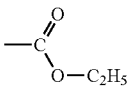 | 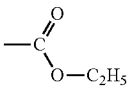 | C | — | 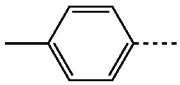 | ----$CH_2—OH$ |
| A329 | H | H | H | H | H | H | A | A | C | — | — | COOH |
| A330 | H | H | H | H | H | H | A | — | N | — | 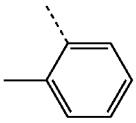 | $H_2C—OH$ / ----$CH_2$ |

TABLE 3-3
| Compound | | | | | | | | | | A | | | A' | | |
|---|---|---|---|---|---|---|---|---|---|---|---|---|---|---|---|
| Example | $R^{301}$ | $R^{302}$ | $R^{303}$ | $R^{304}$ | $R^{305}$ | $R^{306}$ | $R^{307}$ | $R^{308}$ | $Z^{301}$ | α | β | γ | α | β | γ |
| A331 | H | A | H | H | A' | H | H | H | O | 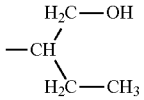 | — | — | — | 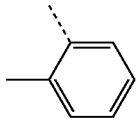 | ----$CH_2$—OH |
| A332 | H | A' | H | H | A | H | H | H | O | — | 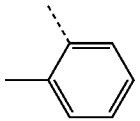 | ----$CH_2$—OH | —$(CH_2)_5$—OH | — | — |
| A333 | H | A | H | H | A' | H | H | H | O | — | 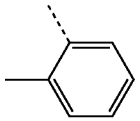 | ----C—COOH ($H_2$) | ----C—COOH ($H_2$) | — | — |

Specific examples of compounds represented by the above formula (A4) are shown in Table 4-1 and Table 4-2. In the Tables, the case where γ is "-" indicates a hydrogen atom, and the hydrogen atom for the γ is incorporated into the structure given in the column of α or β.

TABLE 4-1

| Compound Example | $R^{401}$ | $R^{402}$ | $R^{403}$ | $R^{404}$ | $R^{405}$ | $R^{406}$ | $R^{407}$ | $R^{408}$ | $Z^{401}$ |
|---|---|---|---|---|---|---|---|---|---|
| A401 | H | H | A | H | H | H | CN | CN | C |
| A402 | H | H | A | H | H | H | CN | CN | C |
| A403 | H | H | A | H | H | H | CN | CN | C |
| A404 | H | H | A | H | H | H | CN | CN | C |
| A405 | H | H | A | H | H | H | CN | CN | C |
| A406 | H | H | H | H | H | H | A | — | N |
| A407 | H | H | H | H | H | H | A | — | N |
| A408 | H | H | H | H | H | H | A | — | N |
| A409 | H | H | H | H | H | H | A | — | N |
| A410 | $CH_3$ | H | H | H | H | $CH_3$ | A | — | N |
| A411 | H | Cl | H | H | Cl | H | A | — | N |
| A412 | H | H | 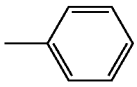 | 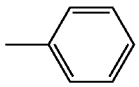 | H | H | A | — | N |
| A413 | H | H | 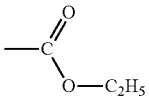 | 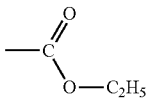 | H | H | A | — | N |
| A414 | H | H | H | H | H | H | A | — | N |
| A415 | H | H | A | A | H | H | CN | CN | C |

| Compound Example | A | | |
|---|---|---|---|
| | α | β | γ |
| A401 | — | 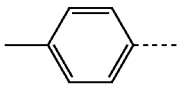 | ----$CH_2$—OH |
| A402 | — | 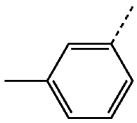 | ----$CH_2$—OH |
| A403 | — | 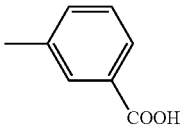 | — |
| A404 | — | 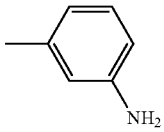 | — |
| A405 | — | 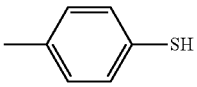 | — |

TABLE 4-1-continued
| | | | |
|---|---|---|---|
| A406 | — | 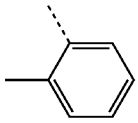 | 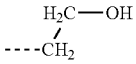 |
| A407 | — | 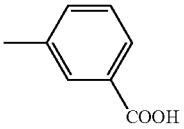 | — |
| A408 | — | 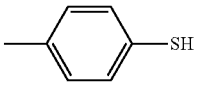 | — |
| A409 | 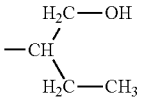 | — | — |
| A410 | — | 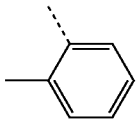 | 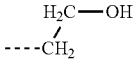 |
| A411 | — | 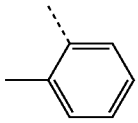 | 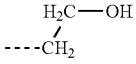 |
| A412 | — | 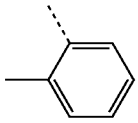 | 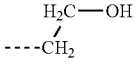 |
| A413 | — | 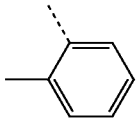 | 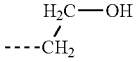 |
| A414 | — | 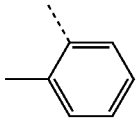 | 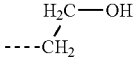 |
| A415 | — | 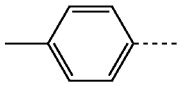 | 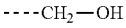 |

TABLE 4-2
| | | | | | | | | | | | | |
|---|---|---|---|---|---|---|---|---|---|---|---|---|
| A416 | H | H | A | A | H | H | CN | CN | C | — | 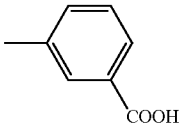 | — |
| A417 | H | H | A | A | H | H | CN | CN | C | — | 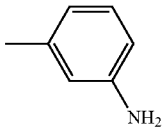 | — |
| A418 | H | H | A | A | H | H | CN | CN | C | — | 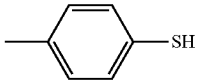 | — |
| A419 | H | H | A | A | H | H | CN | CN | C | 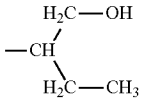 | — | — |
| A420 | H | H | A | A | H | H | CN | CN | C | 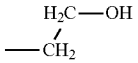 | — | — |
| A421 | H | H | A | A | H | H | CN | CN | C | — | — | COOH |
| A422 | H | H | A | A | H | H | CN | CN | C | — | — | $NH_2$ |
| A423 | H | A | H | H | A | H | CN | CN | C | — | 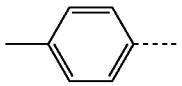 | ----$CH_2$—OH |
| A423 | H | H | A | A | H | H | — | — | O | — | 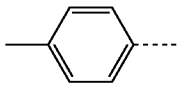 | ----$CH_2$—OH |

TABLE 4-2-continued
| | | | | | | | | | | | |
|---|---|---|---|---|---|---|---|---|---|---|---|
| A424 | H | H | A | A | H | H | — | — | O | — | 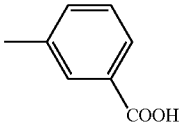 | — |
| A425 | H | H | A | A | H | H | — | — | O | — | 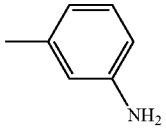 | — |
| A426 | H | H | A | A | H | H | — | — | O | — | 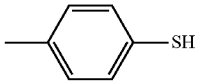 | — |
| A427 | H | H | A | A | H | H | CN | 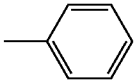 | C | — | 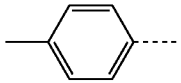 | ----$CH_2$—OH |
| A428 | H | H | A | A | H | H | 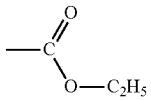 | 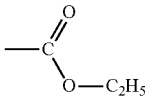 | C | — | 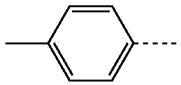 | ----$CH_2$—OH |
| A429 | H | H | H | H | H | H | A | A | C | — | — | COOH |
| A430 | H | H | H | A | H | H | CN | CN | C | — | 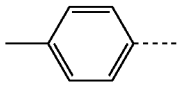 | $H_2C$—OH<br>----$CH_2$ |
| A431 | H | H | 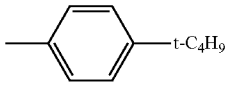 | A | H | H | 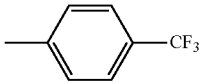 | — | N | — | 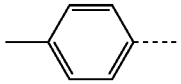 | $H_2C$—OH<br>----$CH_2$ |

Specific examples of compounds represented by the above formula (A5) are shown in Table 5-1 and Table 5-2. In the Tables, the case where γ is "-" indicates a hydrogen atom, and the hydrogen atom for the γ is incorporated into the structure given in the column of α or β.

TABLE 5-1
| Compound Example | $R^{501}$ | $R^{502}$ | $R^{503}$ | $R^{504}$ | $R^{505}$ | $R^{506}$ | $R^{507}$ | $R^{508}$ | $R^{509}$ | $R^{510}$ | $Z^{501}$ | A α | A β | A γ |
|---|---|---|---|---|---|---|---|---|---|---|---|---|---|---|
| A501 | H | A | H | H | H | H | H | H | CN | CN | C | — | 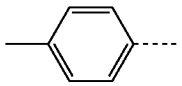 | ----$CH_2$—OH |
| A502 | H | A | H | H | H | H | H | H | CN | CN | C | — | 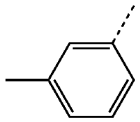 | ----$CH_2$—OH |
| A503 | H | A | H | H | H | H | H | H | CN | CN | C | — | 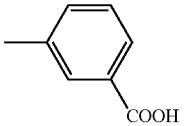 | — |
| A504 | H | A | H | H | H | H | H | H | CN | CN | C | — | 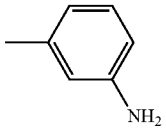 | — |
| A505 | H | A | H | H | H | H | H | H | CN | CN | C | — | 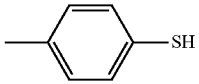 | — |
| A506 | H | $NO_2$ | H | H | $NO_2$ | H | $NO_2$ | H | A | — | N | — | 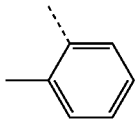 | $H_2C$—OH<br>----$CH_2$ |
| A507 | H | H | H | H | H | H | H | H | A | — | N | — | 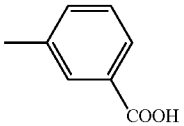 | — |

TABLE 5-1-continued
| Compound Example | $R^{501}$ | $R^{502}$ | $R^{503}$ | $R^{504}$ | $R^{505}$ | $R^{506}$ | $R^{507}$ | $R^{508}$ | $R^{509}$ | $R^{510}$ | $Z^{501}$ | A α | A β | A γ |
|---|---|---|---|---|---|---|---|---|---|---|---|---|---|---|
| A508 | H | H | H | H | H | H | H | H | A | — | N | — | 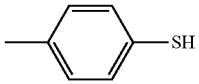 | — |
| A509 | H | H | H | H | H | H | H | H | A | — | N | 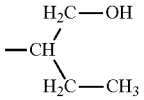 | — | — |
| A510 | $CH_3$ | H | H | H | H | H | H | $CH_3$ | A | — | N | — | 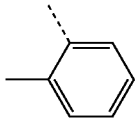 | 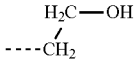 |
| A511 | H | H | Cl | H | H | Cl | H | H | A | — | N | — | 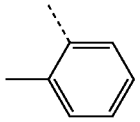 | 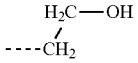 |
| A512 | H | 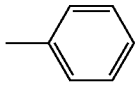 | H | H | H | H | 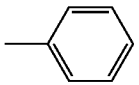 | H | A | — | N | — | 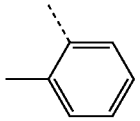 | 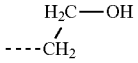 |
| A513 | H | 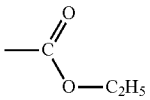 | H | H | H | H | 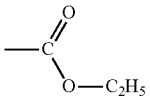 | H | A | — | N | — | 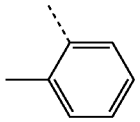 | 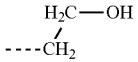 |
| A514 | H | $NO_2$ | H | H | $NO_2$ | H | $NO_2$ | H | A | — | N | — | 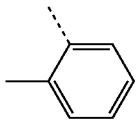 | 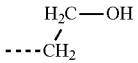 |

TABLE 5-1-continued
| Compound Example | $R^{501}$ | $R^{502}$ | $R^{503}$ | $R^{504}$ | $R^{505}$ | $R^{506}$ | $R^{507}$ | $R^{508}$ | $R^{509}$ | $R^{510}$ | $Z^{501}$ | A α | A β | A γ |
|---|---|---|---|---|---|---|---|---|---|---|---|---|---|---|
| A515 | H | A | H | H | H | H | A | H | CN | CN | C | — | 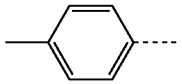 | ----$CH_2$—OH |
| A516 | H | A | H | H | H | H | A | H | CN | CN | C | — | 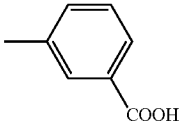 | — |

TABLE 5-2
| | | | | | | | | | | | | | | |
|---|---|---|---|---|---|---|---|---|---|---|---|---|---|---|
| A517 | H | A | H | H | H | H | A | H | CN | CN | C | — | 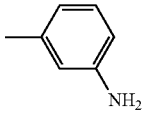 | — |
| A518 | H | A | H | H | H | H | A | H | CN | CN | C | — | 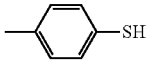 | — |
| A519 | H | A | H | H | H | H | A | H | CN | CN | C | 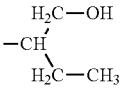 | — | — |
| A520 | H | A | H | H | H | H | A | H | CN | CN | C | 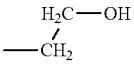 | — | — |
| A521 | H | A | H | H | H | H | A | H | CN | CN | C | — | — | COOH |
| A522 | H | A | H | H | H | H | A | H | CN | CN | C | — | — | NH2 |
| A523 | H | H | A | H | H | A | H | H | CN | CN | C | — | 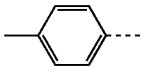 | ----$CH_2$—OH |
| A524 | H | A | H | H | H | H | A | H | — | — | O | — | 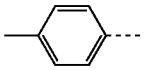 | ----$CH_2$—OH |
| A525 | H | A | H | H | H | H | A | H | — | — | O | — | 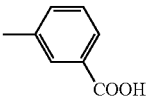 | — |
| A526 | H | A | H | H | H | H | A | H | — | — | O | — | 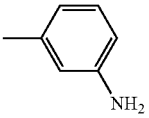 | — |
| A527 | H | A | H | H | H | H | A | H | — | — | O | — | 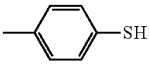 | — |
| A528 | H | A | H | H | H | H | A | H | CN | 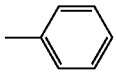 | C | — | 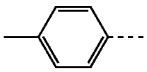 | ----$CH_2$—OH |
| A529 | H | A | H | H | H | H | A | H | 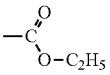 | 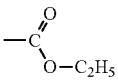 | C | — | 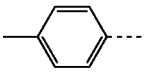 | ----$CH_2$—OH |
| A530 | H | H | H | H | H | H | H | H | A | A | C | — | — | COOH |
| A531 | H | A | H | H | H | H | A | H | CN | CN | C | — | 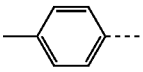 | ----$CH_2$—OH |
| A532 | H | A | H | H | H | H | — | — | 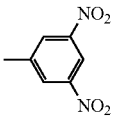 | — | N | — | 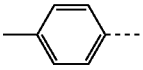 | ----$CH_2$—OH |

Specific examples of compounds represented by the above formula (A6) are shown in Table 6. In the Table, the case where γ is "-" indicates a hydrogen atom, and the hydrogen atom for the γ is incorporated into the structure given in the column of α or β.

TABLE 6

| Compound | | | | | | | A | | |
|---|---|---|---|---|---|---|---|---|---|
| Example | $R^{601}$ | $R^{602}$ | $R^{603}$ | $R^{604}$ | $R^{605}$ | $R^{606}$ | α | β | γ |
| A601 | A | H | H | H | H | H | — | 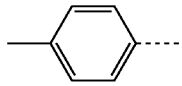 | ----$CH_2$—OH |
| A602 | A | H | H | H | H | H | — | 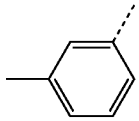 | ----$CH_2$—OH |
| A603 | A | H | H | H | H | H | — | 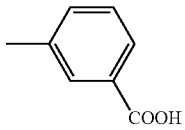 | — |
| A604 | A | H | H | H | H | H | — | 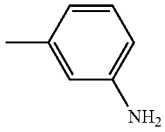 | — |
| A605 | A | H | H | H | H | H | — | 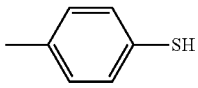 | — |
| A606 | A | H | H | H | H | H | 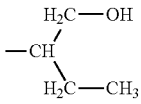 | — | — |
| A607 | A | H | H | H | H | H | 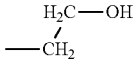 | — | — |
| A608 | A | H | H | H | H | H | — | — | COOH |
| A609 | A | H | H | H | H | H | — | — | $NH_2$ |
| A610 | A | CN | H | H | H | H | — | — | $NH_2$ |
| A611 | CN | CN | A | H | H | H | — | — | $NH_2$ |
| A612 | A | H | H | H | H | H | — | — | OH |
| A613 | H | H | A | H | H | H | — | — | OH |
| A614 | $CH_3$ | H | A | H | H | H | — | — | OH |
| A615 | H | H | A | H | H | A | — | — | OH |
| A616 | A | A | H | H | H | H | — | 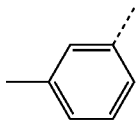 | ----$CH_2$—OH |
| A617 | A | A | H | H | H | H | 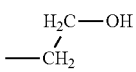 | — | — |

TABLE 6-continued

| Compound Example | $R^{601}$ | $R^{602}$ | $R^{603}$ | $R^{604}$ | $R^{605}$ | $R^{606}$ | A α | A β | A γ |
|---|---|---|---|---|---|---|---|---|---|
| A618 | A | A | H | H | H | H | $H_2C—OH$ / —CH \ $H_2C—CH_3$ | — | — |
| A619 | A | A | H | H | H | H | — | — | COOH |

Specific examples of compounds represented by the above formula (A7) are shown in Table 7-1, Table 7-2 and Table 7-3. In the Tables, the case where γ is "-" indicates a hydrogen atom, and the hydrogen atom for the γ is incorporated into the structure given in the column of α or β.

TABLE 7-1

| Compound Example | $R^{701}$ | $R^{702}$ | $R^{703}$ | $R^{704}$ | $R^{705}$ | $R^{706}$ | $R^{707}$ | $R^{708}$ | A α | A β | A γ |
|---|---|---|---|---|---|---|---|---|---|---|---|
| A701 | A | H | H | H | H | H | H | H | — | 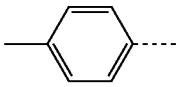 | ----$CH_2$—OH |
| A702 | A | H | H | H | H | H | H | H | — | 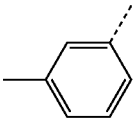 | ----$CH_2$—OH |
| A703 | A | H | H | H | H | H | H | $NO_2$ | — | 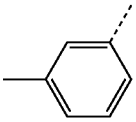 | ----$CH_2$—OH |
| A704 | A | H | H | H | H | H | H | H | — | 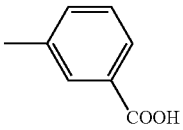 | — |
| A705 | A | H | H | H | H | H | H | H | — | 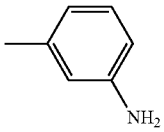 | — |
| A706 | A | H | H | H | H | H | H | H | — | 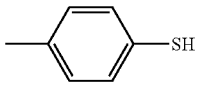 | — |
| A707 | A | H | H | H | H | H | H | H | $H_2C—OH$ / —CH \ $H_2C—CH_3$ | — | — |
| A708 | A | H | H | H | H | H | H | H | — | — | COOH |
| A709 | A | H | H | H | 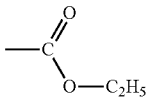 | H | H | H | — | — | COOH |

TABLE 7-1-continued
| Compound Example | $R^{701}$ | $R^{702}$ | $R^{703}$ | $R^{704}$ | $R^{705}$ | $R^{706}$ | $R^{707}$ | $R^{708}$ | A α | A β | A γ |
|---|---|---|---|---|---|---|---|---|---|---|---|
| A710 | A | H | H | H | A | H | H | H | — | 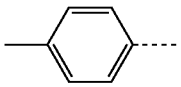 | ----$CH_2$—OH |
| A711 | A | H | H | H | A | H | H | H | — | 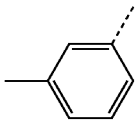 | ----$CH_2$—OH |
| A712 | A | H | H | $NO_2$ | A | H | H | $NO_2$ | — | 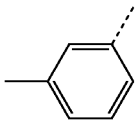 | ----$CH_2$—OH |
| A713 | A | H | F | H | A | H | F | H | — | 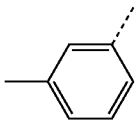 | ----$CH_2$—OH |
| A714 | A | H | H | H | A | H | H | H | — | 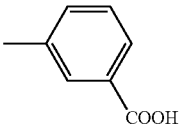 | — |
| A715 | A | H | H | H | A | H | H | H | — | 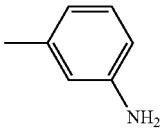 | — |
TABLE 7-2
| | | | | | | | | | | | |
|---|---|---|---|---|---|---|---|---|---|---|---|
| A716 | A | H | H | H | A | H | H | H | — | 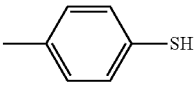 | — |
| A717 | A | H | H | H | A | H | H | H | 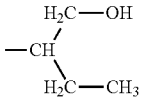 | — | — |
| A718 | A | H | H | H | A | H | H | H | — | — | COOH |
| A719 | H | A | H | H | H | A | H | H | — | — | COOH |
| A720 | A | H | H | H | A | F | H | H | — | — | COOH |
| A721 | A | H | H | $CH_3$ | $CH_3$ | H | H | H | — | — | COOH |
| A722 | A | H | H | $C_4H_9$ | $C_4H_9$ | H | H | H | — | — | COOH |
| A723 | A | H | H | 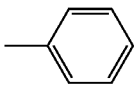 | 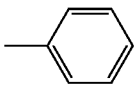 | H | H | H | — | — | COOH |
| A724 | A | H | H | $CH_3$ | $CH_3$ | H | H | H | — | 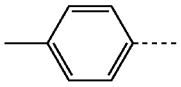 | ----$CH_2$—OH |

TABLE 7-2-continued
| | | | | | | | | | | | |
|---|---|---|---|---|---|---|---|---|---|---|---|
| A725 | A | H | H | $C_4H_9$ | $C_4H_9$ | H | H | H | — | 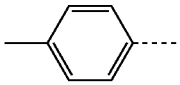 | ----$CH_2$—OH |
| A726 | A | H | H | 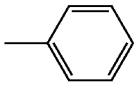 | 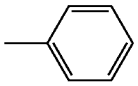 | H | H | H | — | 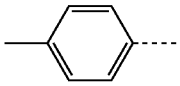 | ----$CH_2$—OH |
| A727 | A | H | H | $C_4H_9$ | $C_4H_9$ | H | H | H | — | 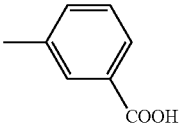 | — |
| A728 | A | H | H | $C_4H_9$ | $C_4H_9$ | H | H | H | — | 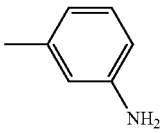 | — |
| A729 | A | H | H | $C_4H_9$ | $C_4H_9$ | H | H | H | — | 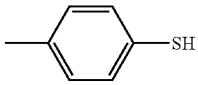 | — |
TABLE 7-3
| Compound | | | | | | | | | A | | |
|---|---|---|---|---|---|---|---|---|---|---|---|
| Example | $R^{701}$ | $R^{702}$ | $R^{703}$ | $R^{704}$ | $R^{705}$ | $R^{706}$ | $R^{707}$ | $R^{708}$ | α | β | γ |
| A730 | A | H | H | H | A' | H | H | H | 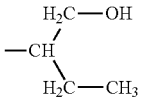 | — | — |
| A731 | A | H | H | H | A' | H | H | H | — | 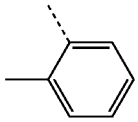 | ----$CH_2$—OH |
| A733 | A | H | H | H | A' | H | H | H | — | 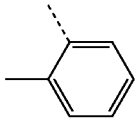 | ----C($H_2$)—COOH |
| Compound | A | | |
|---|---|---|---|
| Example | α | β | γ |
| A730 | — | 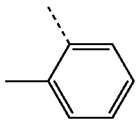 | ----$CH_2$—OH |
| A731 | —($CH_2$)$_5$—OH | — | — |
| A733 | ----C($H_2$)—COOH | — | — |

Specific examples of compounds represented by the above formula (A8) are shown in Table 8-1, Table 8-2 and Table 8-3. In the Tables, the case where γ is "-" indicates a hydrogen atom, and the hydrogen atom for the γ is incorporated into the structure given in the column of α or β.

TABLE 8-1

| Compound Example | $R^{801}$ | $R^{802}$ | $R^{803}$ | $R^{804}$ | $R^{805}$ | $R^{806}$ | $R^{807}$ | $R^{808}$ | $R^{809}$ | $R^{810}$ |
|---|---|---|---|---|---|---|---|---|---|---|
| A801 | H | H | H | H | H | H | H | H | 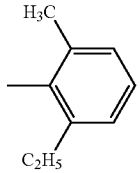 | A |
| A802 | H | H | H | H | H | H | H | H | 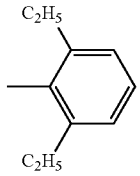 | A |
| A803 | H | H | H | H | H | H | H | H | 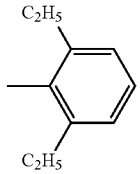 | A |
| A804 | H | H | H | H | H | H | H | H | 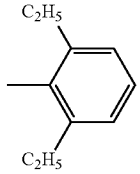 | A |
| A805 | H | H | H | H | H | H | H | H | 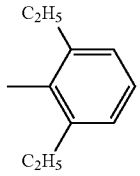 | A |
| A806 | H | H | H | H | H | H | H | H | 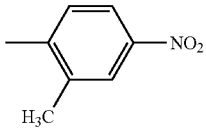 | A |
| A807 | H | H | H | H | H | H | H | H | 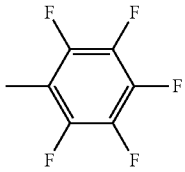 | A |
| A808 | H | H | H | H | H | H | H | H | 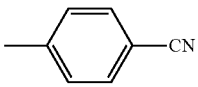 | A |

TABLE 8-1-continued
| | | | | | | | | | | |
|---|---|---|---|---|---|---|---|---|---|---|
| A809 | H | H | H | H | H | H | H | H | 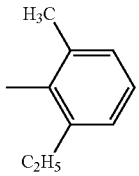 | A |
| A810 | H | H | H | H | H | H | H | H | $—C_6H_{13}$ | A |
| A811 | H | H | H | H | H | H | H | H | 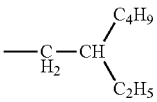 | A |
| A812 | H | H | H | H | H | H | H | H | 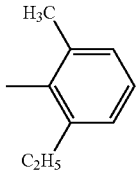 | A |
| A813 | H | H | H | H | H | H | H | H | 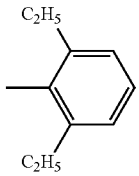 | A |
| A814 | H | H | H | H | H | H | H | H | 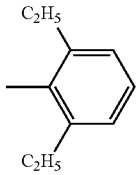 | A |
| A815 | H | H | H | H | H | H | H | H | 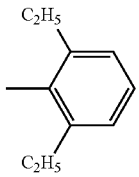 | A |
| Compound | A | | |
|---|---|---|---|
| Example | α | β | γ |
| A801 | 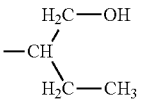 | — | — |
| A802 | 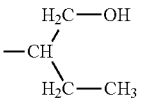 | — | — |
| A803 | — | 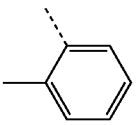 | 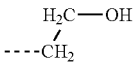 |

TABLE 8-1-continued
| | | | |
|---|---|---|---|
| A804 | — | 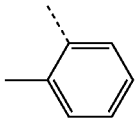 | ----$CH_2$—OH |
| A805 | — | 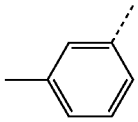 | ----$CH_2$—OH |
| A806 | 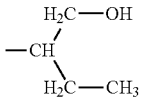 | — | — |
| A807 | 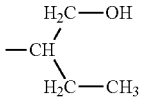 | — | — |
| A808 | 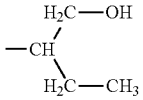 | — | — |
| A809 | —$C_5H_{10}$—OH | — | — |
| A810 | 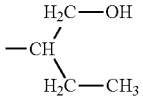 | — | — |
| A811 | — | 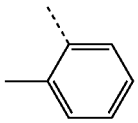 | 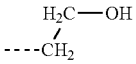 |
| A812 | — | 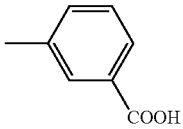 | — |
| A813 | — | 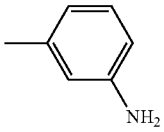 | — |
| A814 | — | 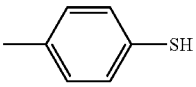 | — |
| A815 | — | 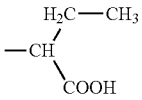 | — |

TABLE 8-2
| | | | | | | | | | | | | |
|---|---|---|---|---|---|---|---|---|---|---|---|---|
| A816 | H | H | H | H | H | H | H | H | 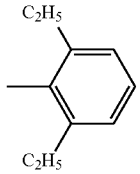 | A | — | 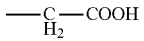 | — |
| A817 | H | H | H | H | H | H | H | H | 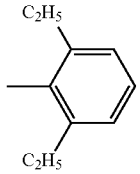 | A | — | 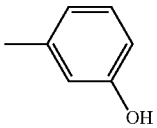 | — |
| A818 | H | H | H | H | H | H | H | H | 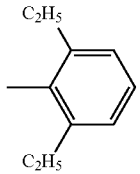 | A | — | 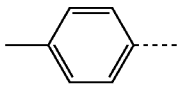 | 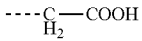 |
| A819 | H | CN | H | H | H | H | CN | H | 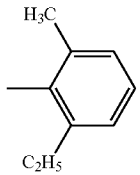 | A | 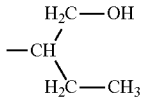 | — | — |
| A820 | H | 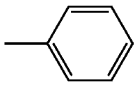 | H | H | H | H | 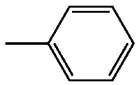 | H | 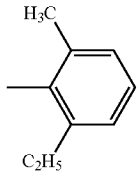 | A | 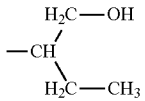 | — | — |

TABLE 8-2-continued
| | | | | | | | | | | | | | |
|---|---|---|---|---|---|---|---|---|---|---|---|---|---|
| A821 | H | A | H | H | H | H | H | H | 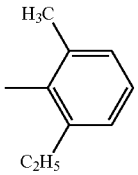 | 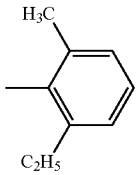 | — | — | —COOH |
| A822 | H | Cl | Cl | H | H | Cl | Cl | H | 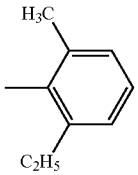 | A | 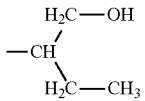 | — | — |
| A823 | H | H | H | H | H | H | H | H | 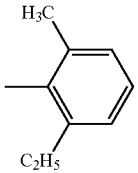 | A | 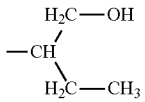 | — | — |
| A824 | H | H | H | H | H | H | H | H | A | A | 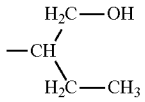 | — | — |
| A825 | H | H | H | H | H | H | H | H | A | A | — | 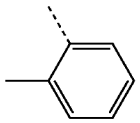 | 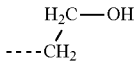 |
| A826 | H | H | H | H | H | H | H | H | A | A | — | 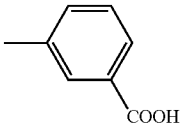 | — |

TABLE 8-2-continued
| | | | | | | | | | | | | | |
|---|---|---|---|---|---|---|---|---|---|---|---|---|---|
| A827 | H | H | H | H | H | H | H | H | A | A | — | 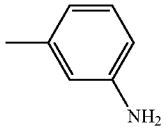 | — |
| A828 | H | H | H | H | H | H | H | H | A | A | — | 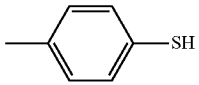 | — |
| A829 | H | H | H | H | H | H | H | H | A | A | — | 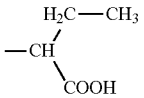 | — |
| A830 | H | H | H | H | H | H | H | H | A | A | — | 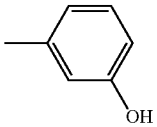 | — |
| A831 | H | 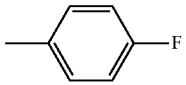 | H | H | H | H | 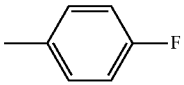 | H | 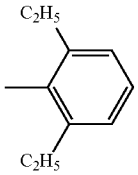 | A | — | 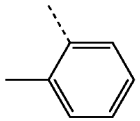 | 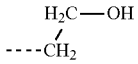 |

TABLE 8-3
| Compound | | | | | | | | | | | A | | | A' | | |
|---|---|---|---|---|---|---|---|---|---|---|---|---|---|---|---|---|
| Example | $R^{801}$ | $R^{802}$ | $R^{803}$ | $R^{804}$ | $R^{805}$ | $R^{806}$ | $R^{807}$ | $R^{808}$ | $R^{809}$ | $R^{810}$ | α | β | γ | α | β | γ |
| A832 | H | H | H | H | H | H | H | H | A | A' | $H_2C—OH$ <br> —CH <br> $H_2C—CH_3$ | — | — | $—(CH_2)_5—OH$ | — | — |
| A833 | H | H | H | H | H | H | H | H | A | A' | — | 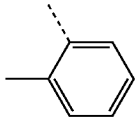 | ----$CH_2—OH$ | $—(CH_2)_5—OH$ | — | — |
| A834 | H | H | H | H | H | H | H | H | A | A' | — | 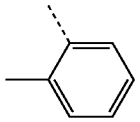 | ----$C(H_2)—COOH$ | ----$C(H_2)—COOH$ | — | — |
| A835 | H | H | H | H | H | H | H | H | A | A' | — | 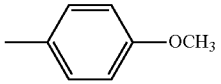 | — | 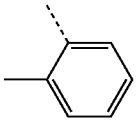 | ----$CH_2—OH$ | — |

Specific examples of compounds represented by the above formula (A9) are shown in Table 9-1 and Table 9-2. In the Tables, the case where γ is "-" indicates a hydrogen atom, and is shown in the column of α or β.

TABLE 9-1

| Compound Example | $R^{901}$ | $R^{902}$ | $R^{903}$ | $R^{904}$ | $R^{905}$ | $R^{906}$ | $R^{907}$ | $R^{908}$ |
|---|---|---|---|---|---|---|---|---|
| A901 | A | H | H | H | H | H | H | H |
| A902 | A | H | H | H | H | H | H | H |
| A903 | A | H | H | H | 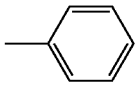 | H | H | H |
| A904 | A | 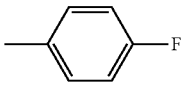 | H | H | 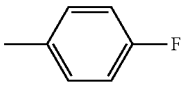 | H | H | H |
| A905 | A | $NO_2$ | H | H | H | $NO_2$ | H | H |
| A906 | A | H | H | H | H | A | H | H |
| A907 | A | H | H | H | A | H | H | H |
| A908 | A | H | H | H | A | H | H | H |
| A909 | A | H | H | A | H | H | H | H |
| A910 | A | H | H | A | H | H | H | H |
| A911 | H | H | H | H | H | H | H | A |
| A912 | H | H | H | H | H | H | H | A |
| A913 | H | $NO_2$ | H | H | H | $NO_2$ | H | A |
| A914 | H | H | H | H | H | H | H | A |
| A915 | H | H | H | H | H | H | H | A |
| A916 | H | H | H | H | H | H | H | A |
| A917 | H | H | H | H | H | H | H | A |
| A918 | H | H | H | H | H | H | H | A |
| A919 | H | CN | H | H | H | H | CN | A |
| A920 | A | A | H | H | H | H | H | H |
| A921 | A | A | H | $NO_2$ | H | H | $NO_2$ | H |
| A922 | H | A | A | H | H | H | H | H |
| A923 | H | H | A | H | H | H | H | H |
| A924 | H | H | A | H | H | H | H | A |

| Compound Example | A α | A β | A γ |
|---|---|---|---|
| A901 | $—CH_2—OH$ | — | — |
| A902 | $—(CH_2)_2—OH$ | — | — |
| A903 | $—(CH_2)_2—OH$ | — | — |
| A904 | $—(CH_2)_2—OH$ | — | — |
| A905 | $—(CH_2)_2—OH$ | — | — |
| A906 | $—(CH_2)_2—OH$ | — | — |
| A907 | $—(CH_2)_2—OH$ | — | — |
| A908 | — | 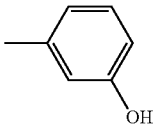 | — |
| A909 | $—(CH_2)_2—OH$ | — | — |
| A910 | — | 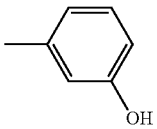 | — |

TABLE 9-1-continued
| | | | |
|---|---|---|---|
| A911 | —$CH_2$—OH | — | — |
| A912 | —$(CH_2)_2$—OH | — | — |
| A913 | —$(CH_2)_2$—OH | — | — |
| A914 | — | 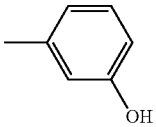 | — |
| A915 | — | 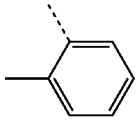 | 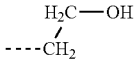 |
| A916 | — | 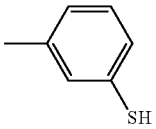 | — |
| A917 | — | 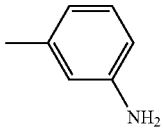 | — |
| A918 | — | 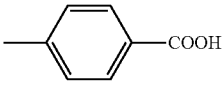 | — |
| A919 | — | 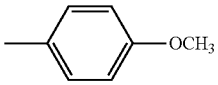 | — |
| A920 | —$(CH_2)_2$—OH | — | — |
| A921 | —$(CH_2)_2$—OH | — | — |
| A922 | — | — | OH |
| A923 | —$(CH_2)_6$—OH | — | — |
| A924 | — | 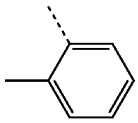 | 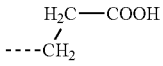 |

TABLE 9-2

| Compound | | | | | | | | | A | | | A' | | |
|---|---|---|---|---|---|---|---|---|---|---|---|---|---|---|
| Example | $R^{901}$ | $R^{902}$ | $R^{903}$ | $R^{904}$ | $R^{905}$ | $R^{906}$ | $R^{907}$ | $R^{908}$ | α | β | γ | α | β | γ |
| A925 | A | H | H | H | A' | H | H | H | $-(CH_2)_2-OH$ | — | — | — | 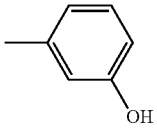 | — |
| A926 | A | H | H | A' | H | H | H | H | $-(CH_2)_2-OH$ | — | — | — | 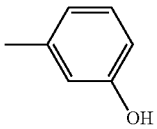 | — |
| A927 | H | A' | H | H | H | H | H | A | $-(CH_2)_6-OH$ | — | — | — | 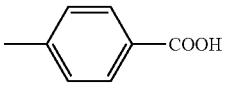 | — |

A derivative (derivative of an electron transporting substance) having a structure of (A1) can be synthesized by a well-known synthesis method described, for example, in U.S. Pat. Nos. 4,442,193, 4,992,349 and 5,468,583 and Chemistry of Materials, Vol. 19, No. 11, 2703-2705 (2007). The derivative can also be synthesized by a reaction of a naphthalenetetracarboxylic dianhydride and a monoamine derivative, which are commercially available from Tokyo Chemical Industry Co., Ltd., Sigma-Aldrich Japan Co., Ltd. and Johnson Matthey Japan Inc.

A compound represented by (A1) has polymerizable functional groups (a hydroxy group, a thiol group, an amino group, a carboxyl group and a methoxy group) polymerizable with a crosslinking agent. A method for incorporating these polymerizable functional groups in a derivative having an (A1) structure includes a method of directly incorporating the polymerizable functional groups in a derivative having an (A1) structure, and a method of incorporating structures having the polymerizable functional groups or functional groups capable of becoming precursors of polymerizable functional groups. Examples of the latter method include, based on a halide of a naphthylimide derivative, a method of incorporating a functional group-containing aryl group for example, by using a cross coupling reaction using a palladium catalyst and a base, a method of incorporating a functional group-containing alkyl group by using a cross coupling reaction using an $FeCl_3$ catalyst and a base and a method of incorporating a hydroxyalkyl group and a carboxyl group by making an epoxy compound or $CO_2$ to act after lithiation. There is a method of using a naphthalenetetracarboxylic dianhydride derivative or a monoamine derivative having the polymerizable functional groups or functional groups capable of becoming precursors of polymerizable functional groups as a raw material for synthesis of the naphthylimide derivative.

Derivatives (derivative of an electron transporting substance) having an (A2) structure are commercially available, for example, from Tokyo Chemical Industry Co., Ltd., Sigma-Aldrich Japan Co., Ltd. and Johnson Matthey Japan Inc. The derivatives can also be synthesized based on a phenanthrene derivative or a phenanthroline derivative by synthesis methods described in Chem. Educator No. 6, 227-234 (2001), Journal of Synthetic Organic Chemistry, Japan, vol. 15, 29-32 (1957) and Journal of Synthetic Organic Chemistry, Japan, vol. 15, 32-34 (1957). A dicyanomethylene group can also be incorporated by a reaction with malononitrile.

A compound represented by (A2) has polymerizable functional groups (a hydroxy group, a thiol group, an amino group, a carboxyl group and a methoxy group) polymerizable with a crosslinking agent. A method for incorporating these polymerizable functional groups in a derivative having an (A2) structure includes a method of directly incorporating the polymerizable functional groups in a derivative having an (A2) structure, and a method of incorporating structures having the polymerizable functional groups or functional groups capable of becoming precursors of polymerizable functional groups. Examples of the latter method include, based on a halide of phenathrenequinone, a method of incorporating a functional group-containing aryl group by using a cross coupling reaction using a palladium catalyst and a base, a method of incorporating a functional group-containing alkyl group by using a cross coupling reaction using an $FeCl_3$ catalyst and a base and a method of incorporating a hydroxyalkyl group and a carboxyl group by making an epoxy compound or $CO_2$ to act after lithiation.

Derivatives (derivative of an electron transporting substance) having an (A3) structure are commercially available from Tokyo Chemical Industry Co., Ltd., Sigma-Aldrich Japan Co., Ltd. and Johnson Matthey Japan Inc. The derivatives can also be synthesized based on a phenanthrene derivative or a phenanthroline derivative by a synthesis method described in Bull. Chem. Soc., Jpn., Vol. 65, 1006-1011 (1992). A dicyanomethylene group can also be incorporated by a reaction with malononitrile.

A compound represented by (A3) has polymerizable functional groups (a hydroxy group, a thiol group, an amino group, a carboxyl group and a methoxy group) polymerizable with a crosslinking agent. A method for incorporating these polymerizable functional groups in a derivative having the structure of the above formula (A3) includes a method of directly incorporating the polymerizable functional groups in a derivative having the structure of the formula (A3), and a method of incorporating structures having the polymerizable functional groups or functional groups capable of becoming precursors of polymerizable functional groups. Examples of the latter method include, based on a halide of phenathrolinequinone, a method of incorporating a functional group-containing aryl group by using a cross coupling reaction using a palladium catalyst and a base, a method of incorporating a functional group-containing alkyl group by using a cross coupling reaction using an $FeCl_3$ catalyst and a base and a method of incorporating a hydroxyalkyl group and a carboxyl group by making an epoxy compound or $CO_2$ to act after lithiation.

Derivatives (derivative of an electron transporting substance) having an (A4) structure are commercially available, for example, from Tokyo Chemical Industry Co., Ltd., Sigma-Aldrich Japan Co., Ltd. and Johnson Matthey Japan Inc. The derivatives can also be synthesized based on an acenaphthenequinone derivative by synthesis methods described in Tetrahedron Letters, 43 (16), 2991-2994 (2002) and Tetrahedron Letters, 44 (10), 2087-2091 (2003). A dicyanomethylene group can also be incorporated by a reaction with malononitrile.

A compound represented by (A4) has polymerizable functional groups (a hydroxy group, a thiol group, an amino group, a carboxyl group and a methoxy group) polymerizable with a crosslinking agent. A method for incorporating these polymerizable functional groups in a derivative having an (A4) structure includes a method of directly incorporating the polymerizable functional groups in a derivative having an (A4) structure, and a method of incorporating structures having the polymerizable functional groups or functional groups capable of becoming precursors of polymerizable functional groups. Examples of the latter method include, based on a halide of acenaphthenequinone, a method of incorporating a functional group-containing aryl group for example, by using a cross coupling reaction using a palladium catalyst and a base, a method of incorporating a functional group-containing alkyl group by using a cross coupling reaction using an $FeCl_3$ catalyst and a base and a method of incorporating a hydroxyalkyl group and a carboxyl group by making an epoxy compound or $CO_2$ to act after lithiation.

Derivatives (derivative of an electron transporting substance) having an (A5) structure are commercially available, for example, from Tokyo Chemical Industry Co., Ltd., Sigma-Aldrich Japan Co., Ltd. and Johnson Matthey Japan Inc. The derivatives can also be synthesized using a fluorenone derivative and malononitrile by a synthesis method described in U.S. Pat. No. 4,562,132. The derivatives can also be synthesized using a fluorenone derivative and an aniline derivative by synthesis methods described in Japanese Patent Application Laid-Open Nos. H05-279582 and H07-70038.

A compound represented by (A5) has polymerizable functional groups (a hydroxy group, a thiol group, an amino group, a carboxyl group and a methoxy group) polymerizable with a crosslinking agent. A method for incorporating these polymerizable functional groups in a derivative having an (A5) structure includes a method of directly incorporating the polymerizable functional groups in a derivative having an (A5) structure, and a method of incorporating structures having the polymerizable functional groups or functional groups capable of becoming precursors of polymerizable functional groups. Examples of the latter method include, based on a halide of fluorenone, a method of incorporating a functional group-containing aryl group for example, by using a cross coupling reaction using a palladium catalyst and a base, a method of incorporating a functional group-containing alkyl group by using a cross coupling reaction using an $FeCl_3$ catalyst and a base and a method of incorporating a hydroxyalkyl group and a carboxyl group by making an epoxy compound or $CO_2$ to act after lithiation.

Derivatives (derivative of an electron transporting substance) having an (A6) structure can be synthesized by synthesis methods described in, for example, Chemistry Letters, 37(3), 360-361 (2008) and Japanese Patent Application Laid-Open No. H09-151157. The derivatives are commercially available from Tokyo Chemical Industry Co., Ltd., Sigma-Aldrich Japan Co., Ltd. and Johnson Matthey Japan Inc.

A compound represented by (A6) has polymerizable functional groups (a hydroxy group, a thiol group, an amino group, a carboxyl group and a methoxy group) polymerizable with a crosslinking agent. A method for incorporating these polymerizable functional groups in a derivative having an (A6) structure includes a method of directly incorporating the polymerizable functional groups in a derivative having an (A6) structure, and a method of incorporating structures having the polymerizable functional groups or functional groups capable of becoming precursors of polymerizable functional groups in a derivative having an (A6) structure. Examples of the latter method include, based on a halide of naphthoquinone, a method of incorporating a functional group-containing aryl group for example, by using a cross coupling reaction using a palladium catalyst and a base, a method of incorporating a functional group-containing alkyl group by using a cross coupling reaction using an $FeCl_3$ catalyst and a base and a method of incorporating a hydroxyalkyl group and a carboxyl group by making an epoxy compound or $CO_2$ to act after lithiation.

Derivatives (derivative of an electron transporting substance) having an (A7) structure can be synthesized by synthesis methods described in Japanese Patent Application Laid-Open No. H01-206349 and Proceedings of PPCI/Japan Hard Copy '98, p. 207 (1998). The derivatives can be synthesized, for example, using phenol derivatives commercially available from Tokyo Chemical Industry Co., Ltd., or Sigma-Aldrich Japan Co., Ltd., as a raw material.

A compound represented by (A7) has polymerizable functional groups (a hydroxy group, a thiol group, an amino group, a carboxyl group and a methoxy group) polymerizable with a crosslinking agent. A method for incorporating these polymerizable functional groups in a derivative having an (A7) structure includes a method of incorporating structures having the polymerizable functional groups or functional groups capable of becoming precursors of polymerizable functional groups. Examples of the method include, based on a halide of diphenoquinone, a method of incorporating a functional group-containing aryl group for example, by using a cross coupling reaction using a palladium catalyst and a base, a method of incorporating a functional group-containing alkyl group by using a cross coupling reaction using an $FeCl_3$ catalyst and a base and a method of incorporating a hydroxyalkyl group and a carboxyl group by making an epoxy compound or $CO_2$ to act after lithiation.

Derivatives (derivative of an electron transporting substance) having an (A8) structure can be synthesized by a well-known synthesis method described in, for example, Journal of the American Chemical Society, Vol. 129, No. 49, 15259-78 (2007). The derivatives can also be synthesized by a reaction of perylenetetracarboxylic dianhydride and a monoamine derivative commercially available from Tokyo Chemical Industry Co., Ltd., Sigma-Aldrich Japan Co., Ltd. and Johnson Matthey Japan Inc.

A compound represented by (A8) has polymerizable functional groups (a hydroxy group, a thiol group, an amino group, a carboxyl group and a methoxy group) polymerizable with a crosslinking agent. A method for incorporating these polymerizable functional groups in a derivative having an (A8) structure includes a method of directly incorporating the polymerizable functional groups in a derivative having an (A8) structure, and a method of incorporating structures having the polymerizable functional groups or functional groups capable of becoming precursors of polymerizable functional groups. Examples of the latter method include, based on a halide of a peryleneimide derivative, a method of using a cross coupling reaction using a palladium catalyst and a base and a method of using a cross coupling reaction using an $FeCl_3$ catalyst and a base. There is a method of using perylenetetracarboxylic dianhydride derivative or a monoamine derivative having the polymerizable functional groups or functional groups capable of becoming precursors of polymerizable functional groups as a raw material for synthesis of the peryleneimide derivative.

Derivatives (derivative of an electron transporting substance) having an (A9) structure are commercially available, for example, from Tokyo Chemical Industry Co., Ltd., Sigma-Aldrich Japan Co., Ltd. and Johnson Matthey Japan Inc.

A compound represented by (A9) has polymerizable functional groups (a hydroxy group, a thiol group, an amino group, a carboxyl group and a methoxy group) polymerizable with a crosslinking agent. A method for incorporating these polymerizable functional groups in a derivative having an (A9) structure includes a method of incorporating structures having the polymerizable functional groups or functional groups capable of becoming precursors of polymerizable functional groups, in a derivative having an (A9) structure commercially available. Examples of the method include, based on a halide of anthraquinone, a method of incorporating a functional group-containing aryl group for example, by using a cross coupling reaction using a palladium catalyst and a base, a method of incorporating a functional group-containing alkyl group by using a cross coupling reaction using an $FeCl_3$ catalyst and a base and a method of incorporating a hydroxyalkyl group and a carboxyl group by making an epoxy compound or $CO_2$ to act after lithiation.

Further the electron transporting layer according to the present invention is more preferably a three-dimensional cured layer having, in addition to an electron transporting substance having polymerizable functional groups and a crosslinking agent, a thermoplastic resin having polymerizable functional groups. That the thermoplastic resin having polymerizable functional groups, the electron transporting substance having polymerizable functional groups and the crosslinking agent bond through the functional groups can form a cured layer which can transport electrons, is insoluble in a solvent of an upper layer (photosensitive layer) and is suitable as an electron transporting layer of an electrophotographic photosensitive member. Further that a thermoplastic resin having polymerizable functional groups is present can make a cured layer having more homogeneous components. The reason therefor is that since the crosslinking agents are not adjacent and have a bulky large volume, when the functional groups of the crosslinking agent and the functional groups of the resin are polymerized and crosslinked, the crosslinking agent pushes the resin chains aside to thereby suppress the cohesion of the resin chains. Since a form is made in which an electron transporting substance having at least one polymerizable functional group selected from the group consisting of a hydroxy group, a thiol group, an amino group, a carboxyl group and a methoxy group bonds with a crosslinking agent which bonds to the resin chain without being unevenly distributed in such a manner, the electron transporting substance results in being not unevenly distributed and being homogeneously present in the cured layer. It is therefore conceivable that the electron transporting layer has no moieties where electrons are retained and a higher-level effect of suppressing the positive memory is provided also in the electron transporting layer.

In this case, the thermoplastic resin having polymerizable functional groups preferably has a some length of the resin chain, and more preferably has a weight-average molecular weight (Mw) of 5,000 or more and 300,000 or less. If the molecular weight is 5,000 or more and 300,000 or less, the homogeneity of the structure originated from a crosslinking agent and an electron transporting substance is enhanced, and a larger effect of reducing the positive memory can be provided.

[Crosslinking Agent]

Then, a crosslinking agent will be described. As a crosslinking agent, a compound can be used which polymerizes with or crosslinks with an electron transporting substance having polymerizable functional groups and a thermoplastic resin having polymerizable functional groups. Specifically, compounds described in "Crosslinking Agent Handbook", edited by Shinzo Yamashita, Tosuke Kaneko, published by Taiseisha Ltd. (1981) (in Japanese), and the like can be used.

Crosslinking agents used for an electron transporting layer can be isocyanate compounds and amine compounds. The crosslinking agents are more preferably crosslinking agents (isocyanate compounds, amine compounds) having 3 to 6 groups of an isocyanate group, a blocked isocyanate group or a monovalent group represented by $—CH_2—OR^1$ from the viewpoint of providing a uniform layer of a polymer. From the viewpoint of improving the homogeneity of an electron transporting layer, the molecular weight of a crosslinking agent can be in the range of 200 to 1,300. The molecular weight thereof is more preferably 1,000 or less.

An isocyanate compound having 3 to 6 isocyanate groups or blocked isocyanate groups can further be used. Examples of the isocyanate compound include isocyanurate modifications, biuret modifications, allophanate modifications and trimethylolpropane or pentaerythritol adduct modifications of triisocyanatobenzene, triisocyanatomethylbenzene, triphenylmethane triisocyanate, lysine triisocyanate, and additionally, diisocyanates such as tolylene diisocyanate, hexamethylene diisocyanate, dicyclohexylmethane diisocyanate, naphthalene diisocyanate, diphenylmethane diisocyanate, isophorone diisocyanate, xylylene diisocyanate, 2,2,4-trimethylhexamethylene diisocyanate, methyl-2,6-diisocyanate hexanoate and norbornane diisocyanate. Above all, the modified isocyanurate and the modified adducts are more preferable.

A blocked isocyanate group is a group having a structure of $—NHCOX^1$ ($X^1$ is a blocking group). $X^1$ may be any blocking group as long as $X^1$ can be incorporated to an isocyanate group, but is more preferably a group represented by the following formulae (H1) to (H7).

(H1)

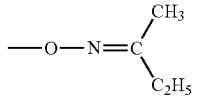

(H2)

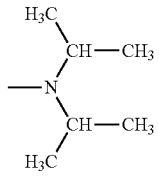

-continued
(H3)
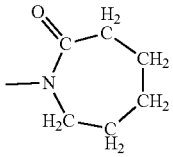
(H4)
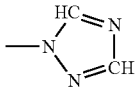
(H5)
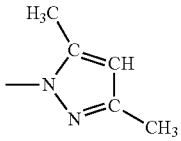
-continued
(H6)
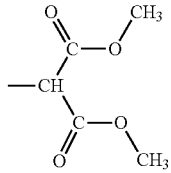
(H7)
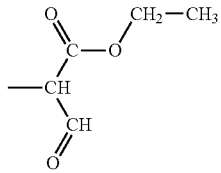
Hereinafter, specific examples of isocyanate compounds will be described.
(B1)
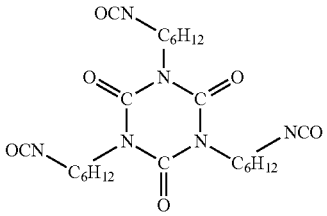
(B2)
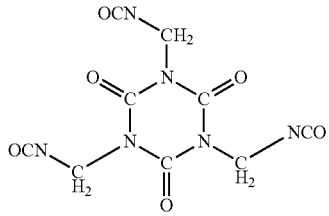
(B3)
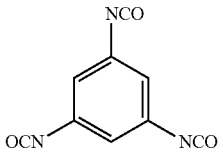
(B4)
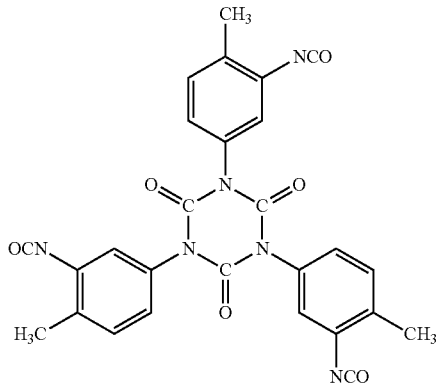
(B5)
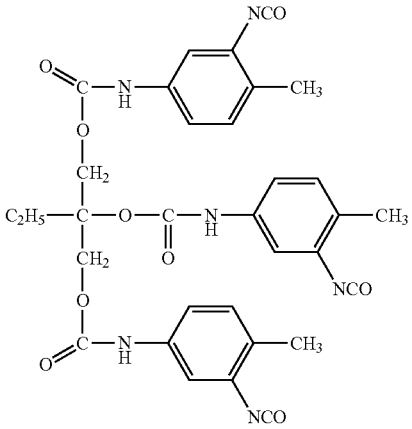
(B6)
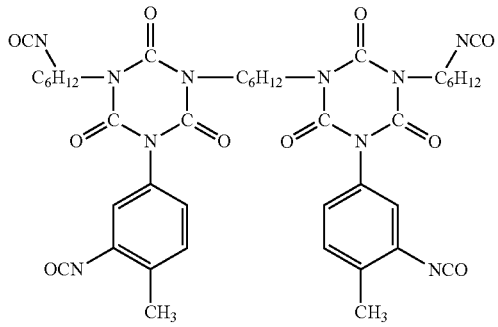

-continued
(B7)
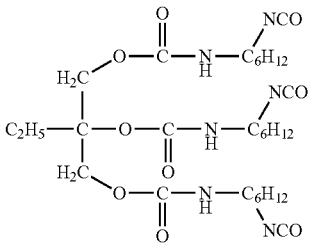
(B8)
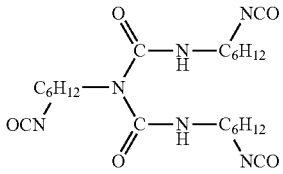
(B9)
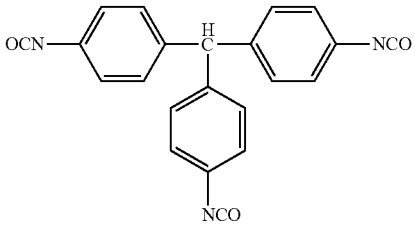
(B10)
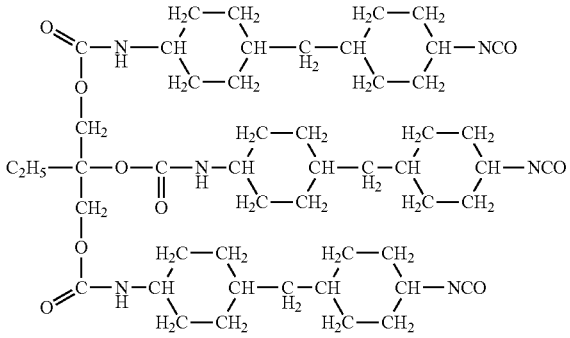
(B11)
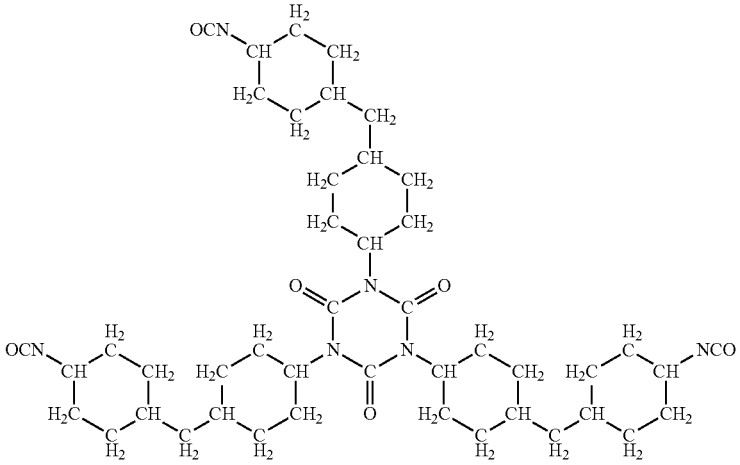
(B12)
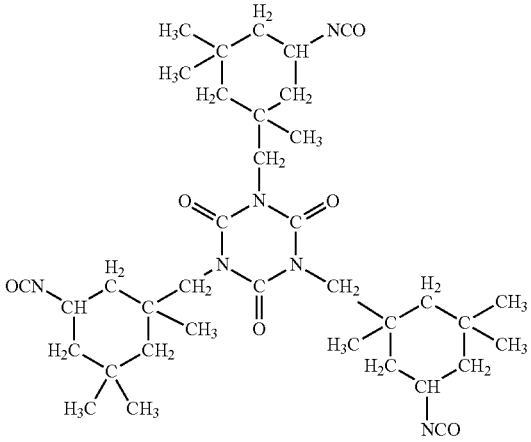

-continued
(B13)
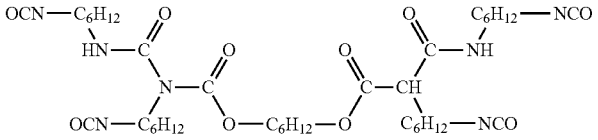
(B14)
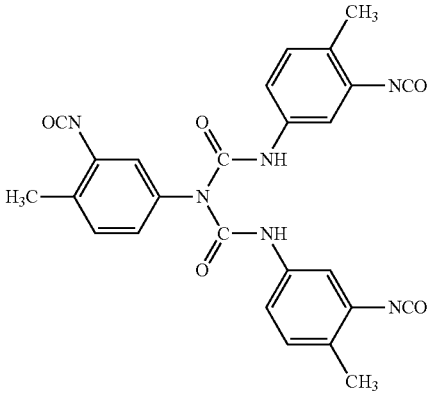
(B15)
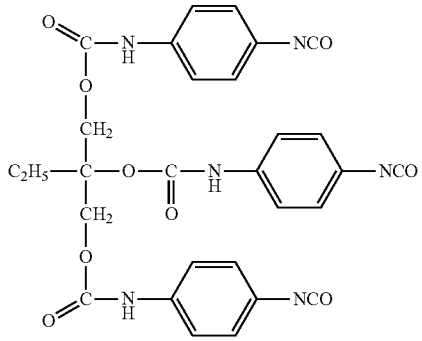
(B16)
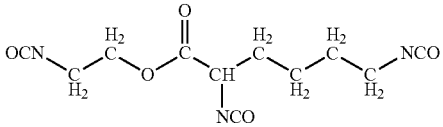
(B17)
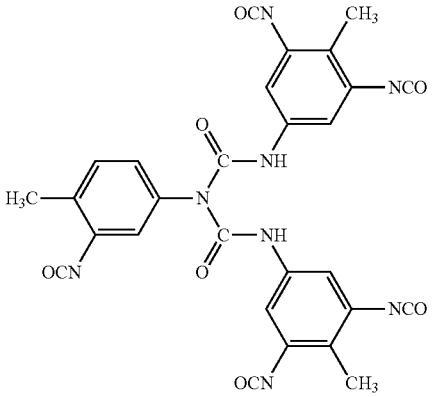
(B18)
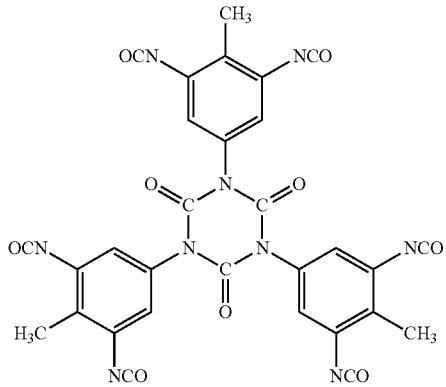
(B19)
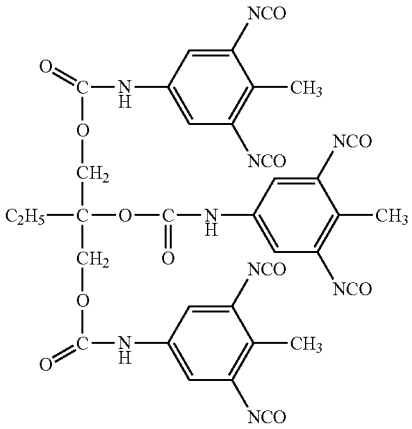

-continued (B20)

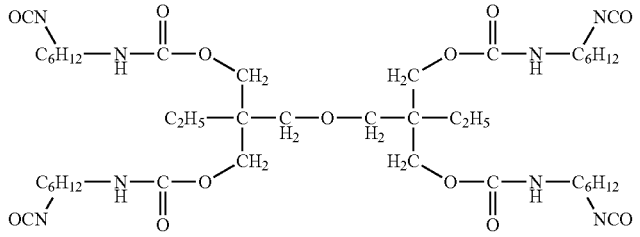

(B21)

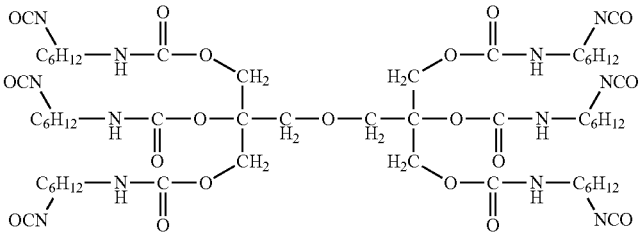

The amine compound can be at least one selected from the group consisting of compounds represented by the following formula (C1), oligomers of compounds represented by the following formula (C1), compounds represented by the following formula (C2), oligomers of compounds represented by the following formula (C2), compounds represented by the following formula (C3), oligomers of compounds represented by the following formula (C3), compounds represented by the following formula (C4), oligomers of compounds represented by the following formula (C4), compounds represented by the following formula (C5), and oligomers of compounds represented by the following formula (C5).

(C1)

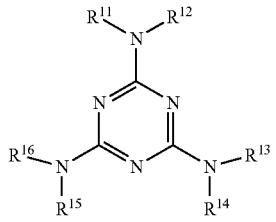

(C2)

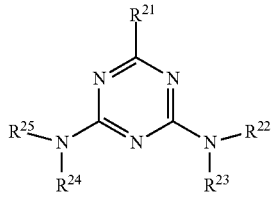

(C3)

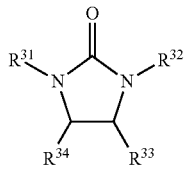

-continued (C4)

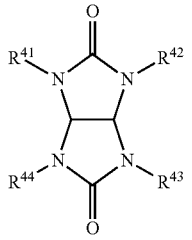

(C5)

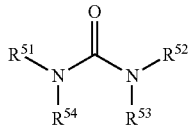

In the formulae (C1) to (C5), $R^{11}$ to $R^{16}$, $R^{22}$ to $R^{25}$, $R^{31}$ to $R^{34}$, $R^{41}$ to $R^{44}$ and $R^{52}$ to $R^{54}$ each independently represent a hydrogen atom, a hydroxy group, an acyl group or a monovalent group represented by $—CH_2—OR^1$; at least one of $R^{11}$ to $R^{16}$, at least one of $R^{22}$ to $R^{25}$, at least one of $R^{31}$ to $R^{34}$, at least one of $R^{41}$ to $R^{44}$, and at least one of $R^{52}$ to $R^{54}$ are a monovalent group represented by $—CH_2—OR^1$; $R^1$ represents a hydrogen atom or an alkyl group having 1 to 10 carbon atoms; the alkyl group can be a methyl group, an ethyl group, a propyl group (n-propyl group, iso-propyl group) or a butyl group (n-butyl group, iso-butyl group, tert-butyl group) from the viewpoint of the polymerizability; $R^{21}$ represents an aryl group, an alkyl group-substituted aryl group, a cycloalkyl group or an alkyl group-substituted cycloalkyl group.

Hereinafter, specific examples of compounds represented by one of formulae (C1) to (C5) will be described. Oligomers (multimers) of compounds represented by one of formulae (C1) to (C5) may be contained. Compounds (monomers) represented by one of formulae (C1) to (C5) can be contained in 10% by mass or more in the total mass of the amine compounds from the viewpoint of providing a uniform layer of a polymer. The degree of polymerization of the above-mentioned multimer can be 2 or more and 100 or less. The above-mentioned multimer and monomer may be used as a mixture of two or more.

Examples of compounds represented by the above formula (C1) usually commercially available include Supermelami No. 90 (made by NOF Corp.), Superbekamine(R) TD-139-60, L-105-60, L127-60, L110-60, J-820-60 and G-821-(made by DIC Corporation), Yuban 2020 (made by Mitsui Chemicals Inc.), Sumitex Resin M-3 (made by Sumitomo Chemical Co., Ltd.), and Nikalac MW-30, MW-390 and MX-750LM (Nihon Carbide Industries, Co., Inc.). Examples of compounds represented by the above formula (C2) usually commercially available include Superbekamine(R) L-148-55, 13-535, L-145-60 and TD-126 (made by Dainippon Ink and Chemicals, Inc,), and Nikalac BL-60 and BX-4000 (Nihon Carbide Industries, Co., Inc.). Examples of compounds represented by the above formula (C3) usually commercially available include Nikalac MX-280 (Nihon Carbide Industries, Co., Inc.). Examples of compounds represented by the above formula (C4) usually commercially available include Nikalac MX-270 (Nihon Carbide Industries, Co., Inc.). Examples of compounds represented by the above formula (C5) usually commercially available include Nikalac MX-290 (Nihon Carbide Industries, Co., Inc.).

Hereinafter, specific examples of compounds represented by any of the formulae (C1) to (C5) will be described.

(C1-1)

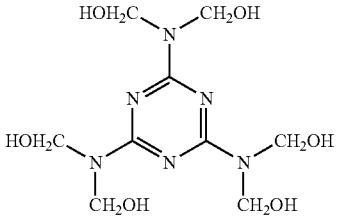

(C1-2)

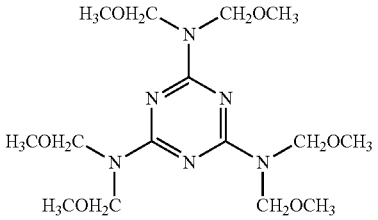

(C1-3)

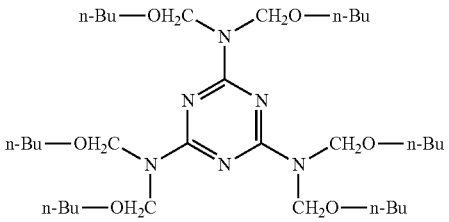

(C1-4)

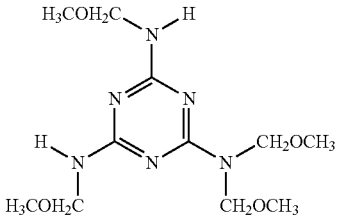

-continued (C1-5)

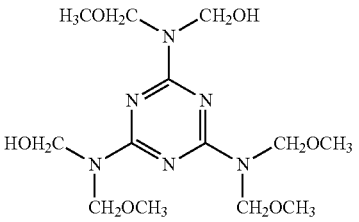

(C1-6)

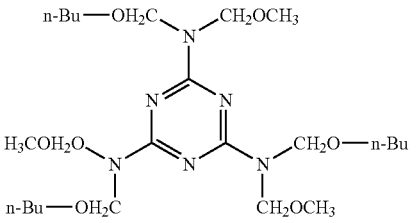

(C1-7)

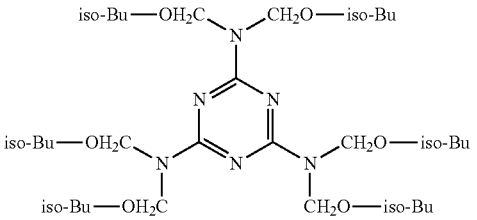

(C1-8)

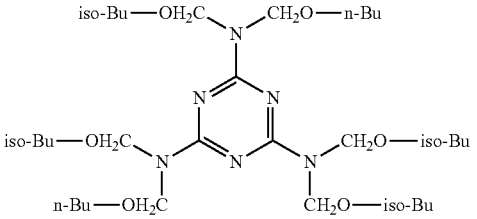

(C1-9)

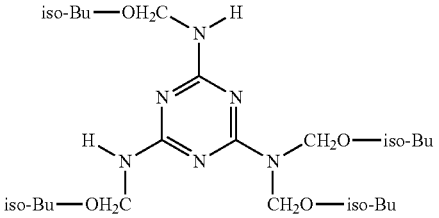

(C1-10)

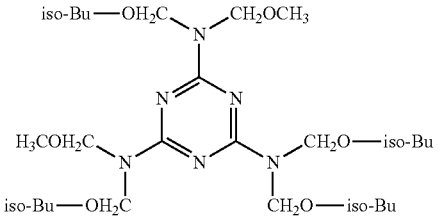

(C1-11)

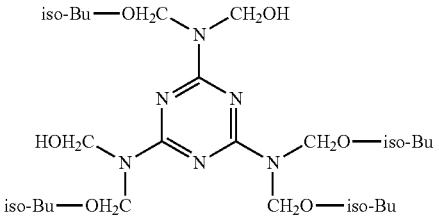

-continued
(C1-12)
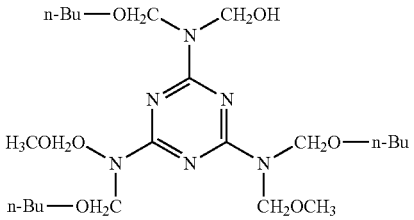
(C2-1)
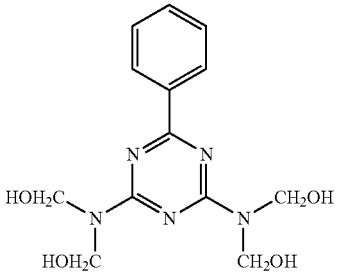
(C2-2)
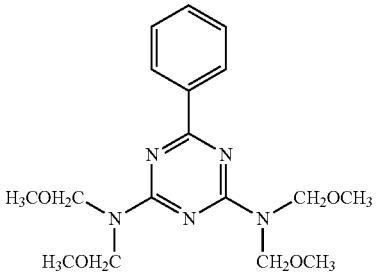
(C2-3)
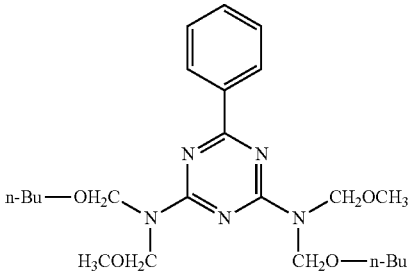
(C2-4)
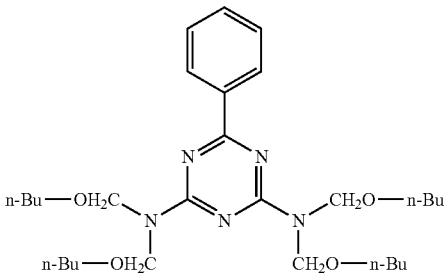
-continued
(C2-5)
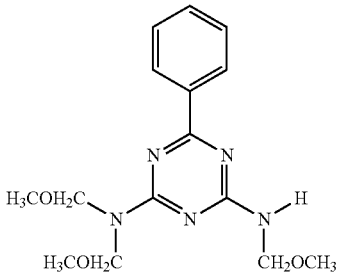
(C2-7)
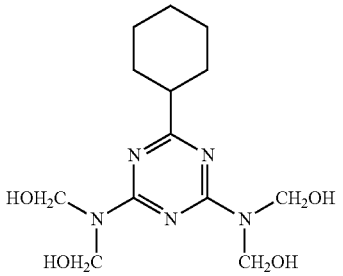
(C2-8)
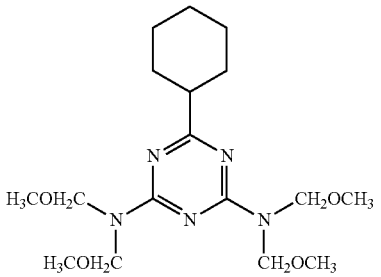
(C2-9)
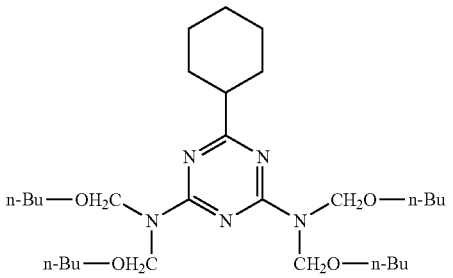
(C2-10)
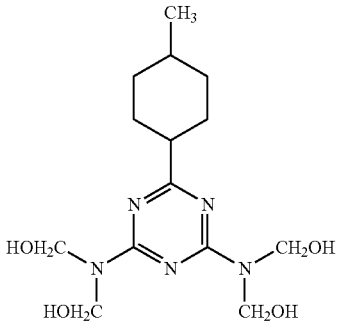

-continued
(C2-11)
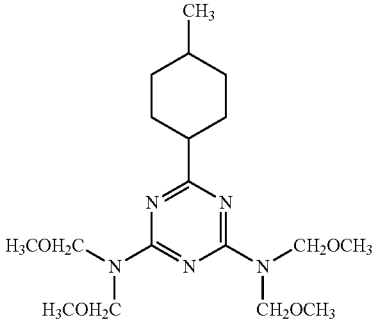
(C2-12)
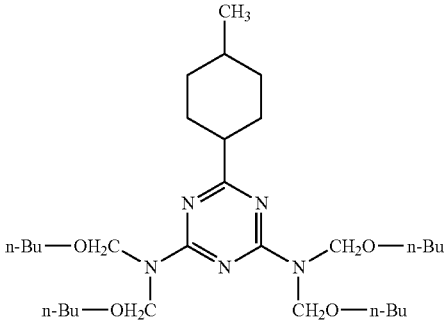
(C2-13)
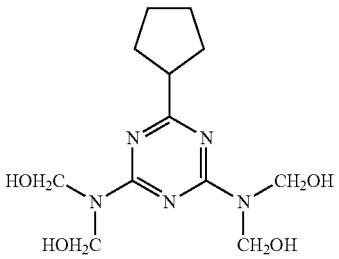
(C2-14)
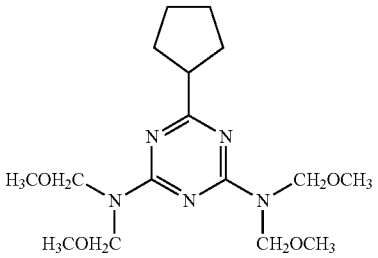
(C2-15)
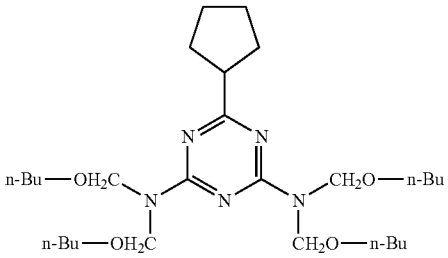
-continued
(C2-16)
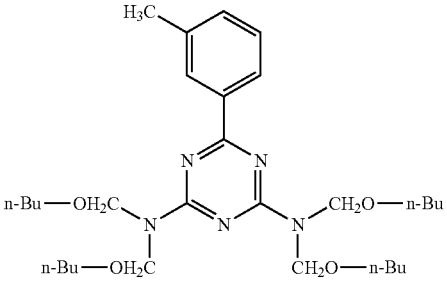
(C2-17)
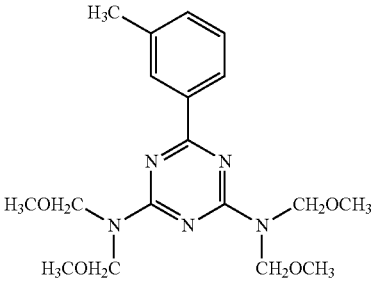
(C2-18)
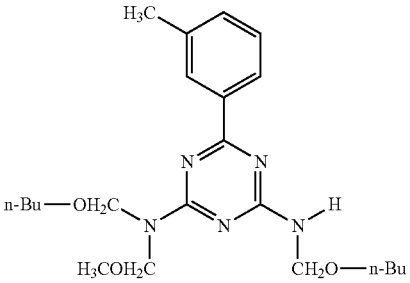
(C3-1)
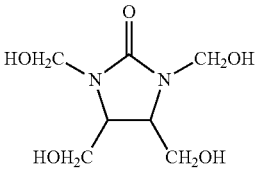
(C3-2)
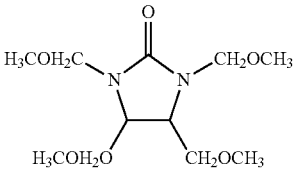
(C3-3)
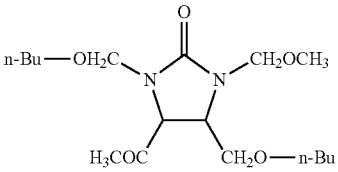
(C3-4)
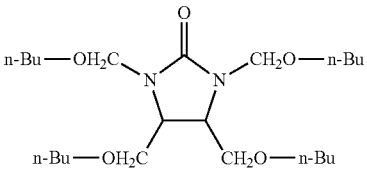

-continued (C3-5)

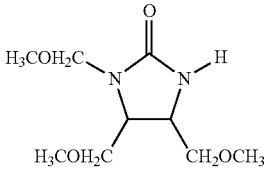

(C3-6)

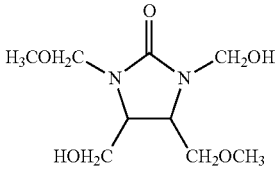

(C4-1)

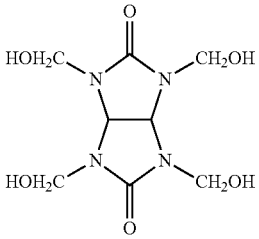

(C4-2)

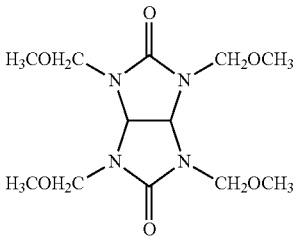

(C4-3)

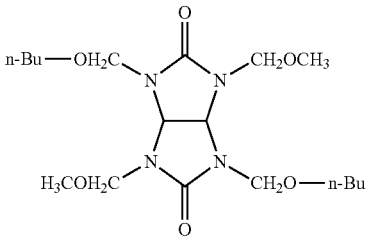

(C4-4)

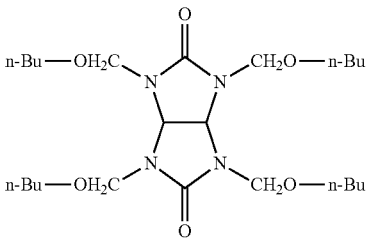

(C4-5)

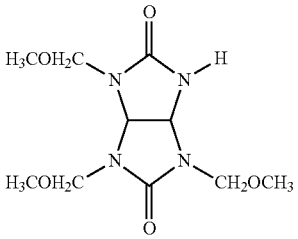

-continued (C4-6)

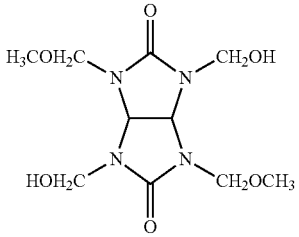

(C5-1)

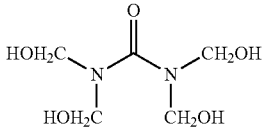

(C5-2)

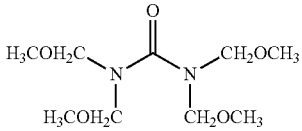

(C5-3)

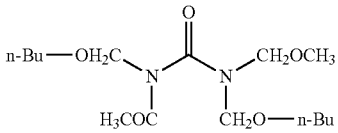

(C5-4)

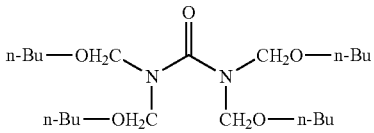

(C5-5)

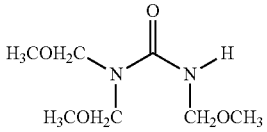

(C5-6)

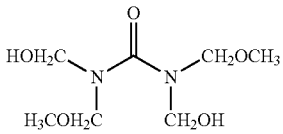

[Resin]

Then, the thermoplastic resin having polymerizable functional groups will be described. The thermoplastic resin having polymerizable functional groups can be a thermoplastic resin having a structural unit represented by the following formula (D).

(D)

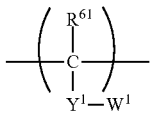

In the formula (D), $R^{61}$ represents a hydrogen atom or an alkyl group; $Y^1$ represents a single bond, an alkylene group or a phenylene group; and $W^1$ represents a hydroxy group, a thiol group, an amino group, a carboxyl group or a methoxy group.

A resin (hereinafter, also referred to as a resin D) having a structural unit represented by the formula (D) can be obtained by polymerizing, for example, a monomer commercially available from Sigma-Aldrich Japan Co., Ltd. and Tokyo Chemical Industry Co., Ltd. and having a polymerizable functional group (a hydroxy group, a thiol group, an amino group, a carboxyl group or a methoxy group).

The resins are usually commercially available. Examples of resins commercially available include polyether polyol-based resins such as AQD-457 and AQD-473 made by Nippon Polyurethane Industry Co., Ltd., and Sunnix GP-400, GP-700 and the like made by Sanyo Chemical Industries, Ltd., polyester polyol-based resins such as Phthalkid W2343 made by Hitachi Chemical Co., Ltd., Watersol S-118 and CD-520 and Beckolite M-6402-50 and M-6201-401M made by DIC Corporation, Haridip WH-1188 made by Harima Chemicals Group, Inc. and ES3604, ES6538 and the like made by Japan UPICA Co., Ltd., polyacryl polyol-based resins such as Burnock WE-300 and WE-304 made by DIC Corporation, polyvinylalcohol-based resins such as Kuraray Poval PVA-203 made by Kuraray Co., Ltd., polyvinyl acetal-based resins such as BX-1, BM-1, KS-1 and KS-5 made by Sekisui Chemical Co., Ltd., polyamide-based resins such as Toresin FS-350 made by Nagase ChemteX Corp., carboxyl group-containing resins such as Aqualic made by Nippon Shokubai Co., Ltd. and Finelex SG2000 made by Namariichi Co., Ltd., polyamine resins such as Rackamide made by DIC Corporation, and polythiol resins such as QE-340M made by Toray Industries, Inc. Above all, polyvinyl acetal-based resins, polyester polyol-based resins and the like are more preferable from the viewpoint of the polymerizability and the uniformity of an electron transporting layer.

The weight-average molecular weight (Mw) of a resin D can be in the range of 5,000 or more and 400,000 or less, and is more preferably in the range of 5,000 or more and 300,000 or less. The reason therefor is that when the above-mentioned crosslinking agent and the resin D are polymerized (crosslinked), the cohesion of the molecular chains of the resin D is suppressed. This is conceivably because since the cohesion of the molecular chains of the resin is suppressed and the uneven distribution of the above-mentioned crosslinking agent is also suppressed, electron transporting substance moieties are not unevenly distributed and can be present homogeneously in an undercoating layer.

Examples of a method for quantifying a polymerizable functional group in the resin include the titration of a carboxyl group using potassium hydroxide, the titration of an amino group using sodium nitrite, the titration of a hydroxy group using acetic anhydride and potassium hydroxide, the titration of a thiol group using 5,5'-dithiobis(2-nitrobenzoic acid), and a calibration curve method using IR spectra of samples in which the incorporation ratio of a polymerizable functional group is varied.

In Table 10 hereinafter, specific examples of the resin D will be described.

TABLE 10

| | Structure | | | Mol Number per 1 g | | Weight-average |
|---|---|---|---|---|---|---|
| | $R^{61}$ | $Y^1$ | $W^1$ | of Functional Group | Another Site | molecular weight |
| D1 | H | single bond | OH | 3.3 mmol | butyral | $1 \times 10^5$ |
| D2 | H | single bond | OH | 3.3 mmol | butyral | $4 \times 10^4$ |
| D3 | H | single bond | OH | 3.3 mmol | butyral | $2 \times 10^4$ |
| D4 | H | single bond | OH | 1.0 mmol | polyolefin | $1 \times 10^5$ |
| D5 | H | single bond | OH | 3.0 mmol | ester | $8 \times 10^4$ |
| D6 | H | single bond | OH | 2.5 mmol | polyether | $5 \times 10^4$ |
| D7 | H | single bond | OH | 2.8 mmol | cellulose | $3 \times 10^4$ |
| D8 | H | single bond | COOH | 3.5 mmol | polyolefin | $6 \times 10^4$ |
| D9 | H | single bond | $NH_2$ | 1.2 mmol | polyamide | $2 \times 10^5$ |
| D10 | H | single bond | SH | 1.3 mmol | polyolefin | $9 \times 10^3$ |
| D11 | H | phenylene | OH | 2.8 mmol | polyolefin | $4 \times 10^3$ |
| D12 | H | single bond | OH | 3.0 mmol | butyral | $7 \times 10^4$ |
| D13 | H | single bond | OH | 2.9 mmol | polyester | $2 \times 10^4$ |
| D14 | H | single bond | OH | 2.5 mmol | polyester | $6 \times 10^3$ |
| D15 | H | single bond | OH | 2.7 mmol | polyester | $8 \times 10^4$ |
| D16 | H | single bond | COOH | 1.4 mmol | polyolefin | $2 \times 10^5$ |
| D17 | H | single bond | COOH | 2.2 mmol | polyester | $9 \times 10^3$ |
| D18 | H | single bond | COOH | 2.8 mmol | polyester | $8 \times 10^2$ |
| D19 | $CH_3$ | alkylene | OH | 1.5 mmol | polyester | $2 \times 10^4$ |
| D20 | $C_2H_5$ | alkylene | OH | 2.1 mmol | polyester | $1 \times 10^4$ |
| D21 | $C_2H_5$ | alkylene | OH | 3.0 mmol | polyester | $5 \times 10^4$ |
| D22 | H | single bond | $OCH_3$ | 2.8 mmol | polyolefin | $7 \times 10^3$ |
| D23 | H | single bond | OH | 3.3 mmol | butyral | $2.7 \times 10^5$ |
| D24 | H | single bond | OH | 3.3 mmol | butyral | $4 \times 10^5$ |
| D25 | H | single bond | OH | 2.5 mmol | acetal | $3.4 \times 10^5$ |

An electron transporting substance having polymerizable functional groups can be 30% by mass or more and 70% by mass or less with respect to the total mass of a composition containing the electron transporting substance having polymerizable functional groups, a crosslinking agent and a resin having polymerizable functional groups.

If the ratio of functional groups (an isocyanate group or a monovalent group represented by $—CH_2—OR^1$) of a crosslinking agent, and the total functional groups of polymerizable functional groups of a resin and polymerizable functional groups of an electron transporting substance is 1:0.5 to 1:3.0, the proportion of reacting functional groups becomes high, which is therefore preferable. In an electron transporting layer in this case, according to the analysis of the ratios of the each atom in the depth direction by ESCA, the respective standard deviations of the ratios of the number of carbon atoms, the ratios of the number of nitrogen atoms and the ratios of the number of oxygen atoms satisfy the above expressions (1) to (3), and the electron transporting structure does not cohere in the electron transporting layer and is homogeneously present, which is therefore preferable.

An electron transporting layer may contain roughening particles in the range of satisfying the above expressions (1) to (3). Examples of the roughening particle include particles of curable resins such as curable rubber, polyurethane resins, epoxy resins, alkyd resins, phenol resins, polyester resins, silicone resins and acryl-melamine resins. Examples of the roughening particle also include metal oxide particles such as particles of titanium oxide, zinc oxide, tin oxide and zirconium oxide, but the roughening particle is preferably not a metal oxide particle having the same metal atom as a conductive particle contained in a conductive layer in order to determine an interface between the conductive layer and the electron transporting layer. In order to exhibit the leveling effect and improve the adhesivity, a silicone oil, a surfactant, a silane compound and the like may be incorporated in the range of satisfying the above expressions (1) to (3). The content of these additives can be 5% by mass or less based on the total mass of an electron transporting layer from the viewpoint of the homogeneity of the electron transporting layer. The thickness of the electron transporting layer according to the present invention can be 0.1 μm or more and 5.0 μm or less.

Identification of compounds and polymers contained in an electron transporting layer was carried out by the following methods.

Mass Analysis

The molecular weight was measured by using a mass analyzer (MALDI-TOF MS: Ultraflex, made by Bruker Daltonics GmbH) under the conditions of acceleration voltage: 20 kV, mode: Reflector, and molecular weight standard: fullerene C60. The identification was carried out using acquired peak top values.

NMR Analysis

The structure was identified by $^{1}$H-NMR and $^{13}$C-NMR analysis (FT-NMR: JNM-EX400, made by JEOL Ltd.) in 1,1,2,2-tetrachloroethane (d2) or dimethylsulfoxide (d6) at 120° C.

GPC Analysis

The identification was carried out by measurement and calculation in terms of polystyrene using gel permeation chromatography "HLC-8120" made by Tosoh Corp.

[Support]

A support can be a support having conductivity (conductive support), and for example, supports made of a metal or an alloy of aluminum, nickel, copper, gold, iron or the like can be used. The support includes supports in which a metal thin film of aluminum, silver, gold or the like is formed on an insulating support of a polyester resin, a polycarbonate resin, a polyimide resin, a glass or the like, and supports in which a conductive material thin film of indium oxide, tin oxide or the like is formed.

The surface of a support may be subjected to a treatment such as an electrochemical treatment such as anodic oxidation, a wet honing treatment, a blast treatment and a cutting treatment, in order to improve electric properties and suppress interference fringes.

A conductive layer may be provided between a support and an electron transporting layer. The conductive layer is obtained by forming a coating film of a coating liquid for a conductive layer in which a conductive particle is dispersed in a resin, on the support, and drying the coating film. Examples of the conductive particle include carbon black, acetylene black, metal powders such as aluminum, nickel, iron, nichrome, copper, zinc and silver, and metal oxide powders such as conductive tin oxide and ITO. A conductive layer may be formed in the order of an electron transporting layer and the conductive layer.

Examples of the resin include polyester resins, polycarbonate resins, polyvinyl butyral resins, acryl resins, silicone resin, epoxy resins, melamine resins, urethane resins, phenol resins and alkid resins.

Examples of a solvent of a coating liquid for a conductive layer include etheric solvents, alcoholic solvents, ketonic solvents and aromatic hydrocarbon solvents. The thickness of a conductive layer can be 0.2 μm or more and 40 μm or less, is more preferably 1 μm or more and 35 μm or less, and still more preferably 5 μm or more and 30 μm or less.

[Photosensitive Layer]

A charge generating layer is provided on an electron transporting layer. A charge generating substance includes azo pigments, perylene pigments, anthraquinone derivatives, anthoanthrone derivatives, dibenzopyrenequinone derivatives, pyranthrone derivatives, violanthrone derivatives, isoviolanthrone derivatives, indigo derivatives, thioindigo derivatives, phthalocyanine pigments such as metal phthalocyanines and non-metal phthalocyanines, and bisbenzimidazole derivatives. Above all, at least one of azo pigments and phthalocyanine pigments can be used. Among phthalocyanine pigments, oxytitanium phthalocyanine, chlorogallium phthalocyanine and hydroxygallium phthalocyanine can be used.

When a photosensitive layer is a laminate type photosensitive layer, examples of a binding resin used for a charge generating layer include polymers and copolymers of vinyl compounds such as styrene, vinyl acetate, vinyl chloride, acrylic ester, methacrylic ester, vinylidene fluoride and trifluoroethylene, polyvinyl alcohol resins, polyvinyl acetal resins, polycarbonate resins, polyester resins, polysulfone resins, polyphenylene oxide resins, polyurethane resins, cellulosic resins, phenol resins, melamine resins, silicon resins and epoxy resins. Above all, polyester resins, polycarbonate resins and polyvinyl acetal resins can be used, and polyvinyl acetal is more preferable.

In a charge generating layer, the ratio (charge generating substance/binding resin) of a charge generating substance and a binding resin can be in the range of 10/1 to 1/10, and is more preferably in the range of 5/1 to 1/5. A solvent used for a coating liquid for a charge generating layer includes alcoholic solvents, sulfoxide-based solvents, ketonic solvents, etheric solvents, esteric solvents and aromatic hydrocarbon solvents. The thickness of a charge generating layer can be 0.05 μm or more and 5 μm or less.

When a photosensitive layer is a laminate type photosensitive layer, A hole transporting layer is provided on a charge generating layer.

Examples of a hole transporting substance include polycyclic aromatic compounds, heterocyclic compounds, hydrazone compounds, styryl compounds, benzidine compounds, and triarylamine compounds, triphenylamine, and polymers having a group derived from these compounds in the main chain or side chain. Above all, triarylamine compounds, benzidine compounds and styryl compounds can be used.

Examples of a binding resin used for a hole transporting layer include polyester resins, polycarbonate resins, polymethacrylic ester resins, polyarylate resins, polysulfone resins and polystyrene resins. Above all, polycarbonate resins and polyarylate resins can be used. With respect to the molecular weight thereof, the weight-average molecular weight (Mw) can be in the range of 10,000 to 300,000.

In a hole transporting layer, the ratio (hole transporting substance/binding resin) of a hole transporting substance and a binding resin can be 10/5 to 5/10, and is more preferably 10/8 to 6/10. The thickness of a hole transporting layer can be 3 μm or more and 40 μm or less. The thickness is more preferably 5 μm or more and 16 μm or less from the viewpoint of the thickness of the electron transporting layer. A solvent used for a coating liquid for a hole transporting layer includes alcoholic solvents, sulfoxide-based solvents, ketonic solvents, etheric solvents, esteric solvents and aromatic hydrocarbon solvents.

Another layer such as a second undercoating layer which does not contain a polymer according to the present invention may be provided between a support and the electron transporting layer and between the electron transporting layer and a charge generating layer.

A surface protecting layer may be provided on a hole transporting layer. The surface protecting layer contains a conductive particle or a charge transporting substance and a binding resin. The surface protecting layer may further contain additives such as a lubricant. The binding resin itself of the protecting layer may have conductivity and charge transportability; in this case, the protecting layer does not need to contain a conductive particle and a charge transporting substance other than the binding resin. The binding resin of the protecting layer may be a thermoplastic resin, and may be a curable resin capable of being polymerized by heat, light, radiation (electron beams) or the like.

A method for forming each layer such as an electron transporting layer, a charge generating layer and a hole transporting layer constituting an electrophotographic photosensitive member can be a method in which a coating liquid obtained by dissolving and/or dispersing a material constituting the each layer in a solvent is applied, and the obtained coating film is dried and/or cured. Examples of a method of applying the coating liquid include an immersion coating method, a spray coating method, a curtain coating method and a spin coating method. Above all, an immersion coating method can be used from the viewpoint of efficiency and productivity.

[Process Cartridge and Electrophotographic Apparatus]

Figure 3:
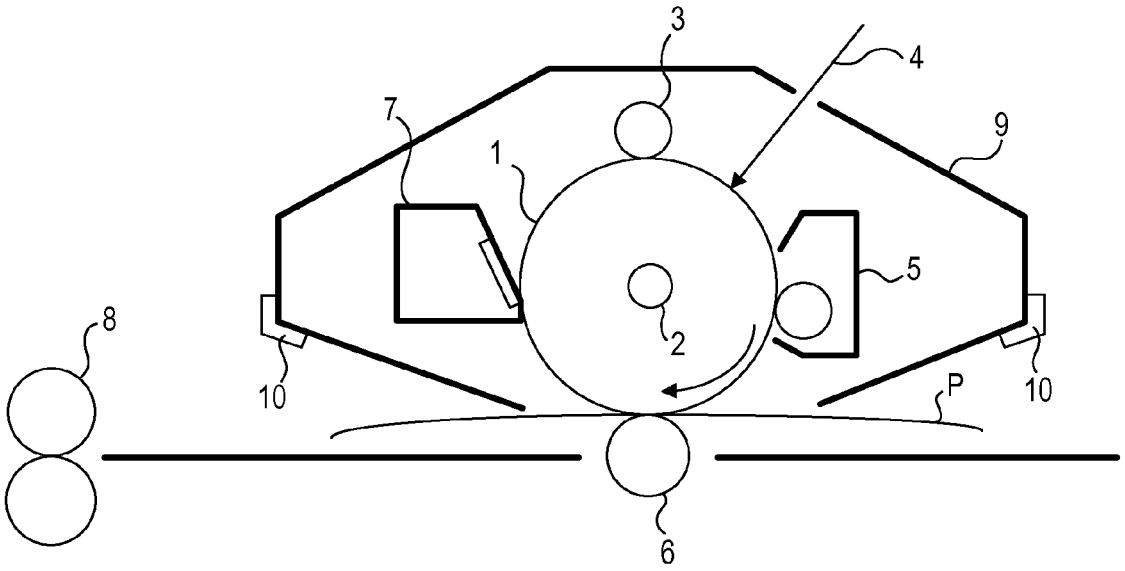
FIG. 3 is a diagram illustrating an outline constitution of an electrophotographic apparatus having a process cartridge having an electrophotographic photosensitive member.

FIG. 3 illustrates an outline constitution of an electrophotographic apparatus having a process cartridge having an electrophotographic photosensitive member.

In FIG. 3, reference numeral 1 denotes a cylindrical electrophotographic photosensitive member, which is rotationally driven at a predetermined peripheral speed in the arrow direction around a shaft 2 as a center. A surface (peripheral surface) of the rotationally driven electrophotographic photosensitive member 1 is uniformly charged at a predetermined positive or negative potential by a charging unit 3 (primary charging unit: charging roller or the like). Then, the surface is subjected to irradiation light (image-irradiation light) 4 from a light irradiation unit (not illustrated) such as slit light irradiation or laser beam scanning light irradiation. Electrostatic latent images corresponding to objective images are successively formed on the surface of the electrophotographic photosensitive member 1 in such a manner.

The electrostatic latent images formed on the surface of the electrophotographic photosensitive member 1 are developed with a toner contained in a developer of a developing unit 5 to thereby make toner images. Then, the toner images formed and carried on the surface of the electrophotographic photosensitive member 1 are successively transferred to a transfer material (paper or the like) P by a transferring bias from a transfer unit (transfer roller or the like) 6. The transfer material P is delivered from a transfer material feed unit (not illustrated) and fed to between the electrophotographic photosensitive member 1 and the transfer unit 6 (to a contacting part) synchronously with the rotation of the electrophotographic photosensitive member 1.

The transfer material P having the transferred toner images is separated from the surface of the electrophotographic photosensitive member 1, introduced to a fixing unit 8 to be subjected to image fixation, and printed out as an image-formed matter (print, copy) outside the apparatus.

The surface of the electrophotographic photosensitive member 1 after the toner image transfer is subjected to removal of the untransferred developer (toner) by a cleaning unit (cleaning blade or the like) 7 to be thereby cleaned. Then, the surface is subjected to a charge-neutralizing treatment with irradiation light (not illustrated) from a light irradiation unit (not illustrated), and thereafter used repeatedly for image formation. As illustrated in FIG. 3, in the case where the charging unit 3 is a contacting charging unit using a charging roller or the like, the light irradiation is not necessarily needed.

A plurality of some constituting elements out of constituting elements including the electrophotographic photosensitive member 1, the charging unit 3, the developing unit 5, the transfer unit 6 and the cleaning unit 7 described above may be selected and accommodated in a container and integrally constituted as a process cartridge; and the process cartridge may be constituted detachably from an electrophotographic apparatus body of a copying machine, a laser beam printer or the like. In FIG. 3, the electrophotographic photosensitive member 1, the charging unit 3, the developing unit 5 and the cleaning unit 7 are integrally supported and made as a cartridge to thereby make a process cartridge 9 attachable to and detachable from an electrophotographic apparatus body by using a guiding unit 10 such as rails of the electrophotographic apparatus body.

EXAMPLES

Hereinafter, the present invention will be described in more detail by way of Examples. "Parts" in the Examples indicate "parts by mass."

First, synthesis examples of electron transporting compounds relevant to the present invention will be described.

Synthesis Example 1

5.4 parts of naphthalenetetracarboxylic dianhydride (made by Tokyo Chemical Industry Co., Ltd.), 4 parts of 2-methyl-6-ethylaniline (made by Tokyo Chemical Industry Co., Ltd.), and 3 parts of 2-amino1-butanol were added to 200 parts of dimethylacetamide, and stirred at room temperature for 1 hour in a nitrogen atmosphere to thereby prepare a solution. After the preparation of the solution, the solution was refluxed for 8 hours; and deposits were filtered off, and subjected to recrystallization with ethyl acetate to thereby obtain 1.0 part of a compound A101.

Synthesis Example 2

5.4 parts of naphthalenetetracarboxylic dianhydride (made by Tokyo Chemical Industry Co., Ltd.) and parts of 2-aminobutyric acid (made by Tokyo Chemical Industry Co., Ltd.) were added to 200 parts of dimethylacetamide, and stirred at room temperature for 1 hour in a nitrogen atmosphere to thereby prepare a solution. After the preparation of the solution, the solution was refluxed for 8 hours; and deposits were filtered off, and subjected to recrystallization with ethyl acetate to thereby obtain 4.6 parts of a compound A129.

Synthesis Example 3

5.4 parts of naphthalenetetracarboxylic dianhydride, 4.5 parts of 2,6-diethylaniline (made by Tokyo Chemical Industry Co., Ltd.), and 4 parts of 4-aminobenzenethiol were added to 200 parts of dimethylacetamide, and stirred at room temperature for 1 hour in a nitrogen atmosphere to thereby prepare a solution. After the preparation of the solution, the solution was refluxed for 8 hours; and deposits were filtered off, and subjected to recrystallization with ethyl acetate to thereby obtain 1.3 parts of a compound A114.

Synthesis Example 4

2.8 parts of 4-(hydroxymethyl)phenylboron, made by Sigma-Aldrich Corp., and 7.4 parts of 3,6-dibromo-9,10-phenanthrenedione synthesized from phenanthrenequinone, made by Sigma-Aldrich Japan KK., in a nitrogen atmosphere by a synthesis method described in Chem. Educator, No. 6, 227-234 (2001) were added to a mixed solvent of 100 parts of toluene and 50 parts of ethanol; 100 parts of a 20% sodium carbonate aqueous solution was dropwise added thereto; 0.55 part of tetrakis(triphenylphosphine) palladium (0) was thereafter added; and refluxing was thereafter carried out for 2 hours. After the reaction, an organic phase was extracted with chloroform, washed with water, and then dried with anhydrous sodium sulfate. The solvent was removed under reduced pressure; and a residue was then refined by silica gel chromatography to thereby obtain 3.2 parts of a compound A216.

Synthesis Example 5

7.4 parts of 2,7-dibromo-9,10-phenanthrolinequinone was synthesized in a nitrogen atmosphere from 2.8 parts of 3-aminophenylboronic acid monohydrate, and phenanthrolinequinone (Sigma-Aldrich Japan KK) as in the Synthesis Example 4. 7.4 parts of the 2,7-dibromo-9,10-phenanthrolinequinone was added to a mixed solvent of 100 parts of toluene and 50 parts of ethanol;

100 parts of a 20% sodium carbonate aqueous solution was dropwise added thereto; 0.55 part of tetrakis(triphenylphosphine) palladium (0) was thereafter added; and refluxing was thereafter carried out for 2 hours. After the reaction, an organic phase was extracted with chloroform, washed with water, and then dried with anhydrous sodium sulfate. The solvent was removed under reduced pressure; and a residue was then refined by silica gel chromatography to thereby obtain 2.2 parts of a compound A316.

Synthesis Example 6

7.4 parts of perylenetetracarboxylic dianhydride (made by Tokyo Chemical Industry Co., Ltd.), 4 parts of 2,6-diethylaniline (made by Tokyo Chemical Industry Co., Ltd.), and 4 parts of 2-aminophenylethanol were added to 200 parts of dimethylacetamide, and stirred at room temperature for 1 hour in a nitrogen atmosphere to thereby prepare a solution. After the preparation of the solution, the solution was refluxed for 8 hours; and deposits were filtered off, and subjected to recrystallization with ethyl acetate to thereby obtain 5.0 parts of a compound A803.

Synthesis Example 7

5.4 parts of naphthalenetetracarboxylic dianhydride and 5.2 parts of leucinol were added to 200 parts of dimethylacetamide, stirred at room temperature for 1 hour in a nitrogen atmosphere, and thereafter refluxed for 7 hours. After dimethylacetamide was removed under reduced pressure distillation, the resultant was subjected to recrystallization with ethyl acetate to thereby obtain 5.0 parts of a compound A168.

Synthesis Example 8

5.4 parts of naphthalenetetracarboxylic dianhydride, 2.6 parts of leucinol and 2.7 parts of 2-(2-aminoethylthio)ethanol were added to 200 parts of dimethylacetamide, stirred at room temperature for 1 hour in a nitrogen atmosphere, and thereafter refluxed for 7 hours. After dimethylacetamide was removed under reduced pressure distillation from an obtained dark brown solution, the resultant was dissolved in an ethyl acetate/toluene mixed solution.

The solution was separated by silica gel column chromatography (developing solvent: ethyl acetate/toluene); and a fraction containing an objective substance was concentrated; and an obtained crystal was subjected to recrystallization with a toluene/hexane mixed solvent to thereby obtain 2.5 parts of a compound A163.

Then, the manufacture and evaluation of electrophotographic photosensitive members will be described.

Example 1

An aluminum cylinder (JIS-A3003, an aluminum alloy) of 260.5 mm in length and 30 mm in diameter was made to be a support (conductive support).

Then, 50 parts of a titanium oxide particle coated with an oxygen-deficient tin oxide (powder resistivity: 120 Ω·cm, coverage factor of tin oxide: 40%), 40 parts of a phenol resin (Plyophen J-325, made by DIC Corporation, resin solid content: 60%), and 50 parts of methoxypropanol were placed in a sand mill using a glass bead of 1 mm in diameter, and subjected to a dispersion treatment for 3 hours to thereby prepare a coating liquid (dispersion liquid) for a conductive layer. The coating liquid for a conductive layer was immersion coated on the support, and the obtained coating film was dried and heat polymerized for 30 min at 150° C. to thereby form a conductive layer having a thickness of 16 μm.

The average particle diameter of the titanium oxide particle coated with an oxygen-deficient tin oxide in the coating liquid for a conductive layer was measured by a centrifugal precipitation method using tetrahydrofuran as a dispersion medium at a rotation frequency of 5,000 rpm by using a particle size distribution analyzer (trade name: CAPA700) made by HORIBA Ltd. As a result, the average particle diameter was 0.31 μm.

Then, 4 parts of the compound (A101), 7.3 parts of the crosslinking agent (B1:blocking group (H1)=5.1:2.2 (mass ratio)), 0.9 part of the resin (D1) and 0.05 part of dioctyltin laurate as a catalyst were dissolved in a mixed solvent of 100 parts of dimethylacetoamide and 100 parts of methyl ethyl ketone to thereby prepare a coating liquid for an electron transporting layer. The coating liquid for an electron transporting layer was immersion coated on the conductive layer, and the obtained coating film was heated for 40 min at 160° C. to be polymerized to thereby form an electron transporting layer (undercoating layer) as a cured layer having a thickness of 0.53 μm.

The content of the electron transporting substance with respect to the total mass of the electron transporting substance of a coating liquid for an electron transporting layer, the crosslinking agent and the resin was 33% by mass.

Then, 10 parts of a hydroxylgallium phthalocyanine crystal (charge generating substance) having a crystal form exhibiting strong peaks at Bragg angles (2θ±0.2°) of 7.5°, 9.9°, 12.5°, 16.3°, 18.6°, 25.1° and 28.3° in CuKα characteristic X-ray diffractometry, 5 parts of a polyvinyl butyral resin (trade name: Eslec BX-1, made by Sekisui Chemical Co., Ltd.) and 250 parts of cyclohexanone were placed in a sand mill using a glass bead of 1 mm in diameter, and subjected to a dispersion treatment for 1.5 hours. Then, 250 parts of ethyl acetate was added thereto to thereby prepare a coating liquid for a charge generating layer. The coating liquid for a charge generating layer was immersion coated on the electron transporting layer, and the obtained coating film was dried for 10 min at 100° C. to thereby form a charge generating layer having a thickness of 0.15 μm.

Then, 8 parts of an amine compound (hole transporting substance) represented by the following structural formula (9), and 10 parts of a polyester resin (I) having a repeating structural unit represented by the following formula (10-1) and a repeating structural unit represented by the following formula (10-2) in a proportion of 5/5 and having a weight-average molecular weight (Mw) of 100,000 were dissolved in a mixed solvent of 40 parts of dimethoxymethane and 60 parts of o-xylene to thereby prepare a coating liquid for a hole transporting layer. The coating liquid for a hole transporting layer was immersion coated on the charge generating layer, and the obtained coating film was dried for 40 min at 120° C. to thereby form a hole transporting layer having a thickness of 15 μm.

(9)

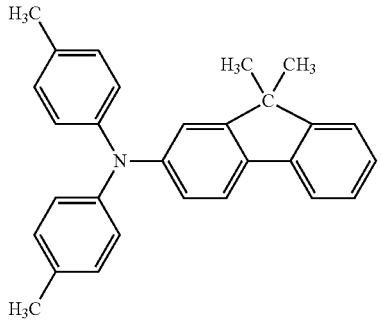

(10-1)

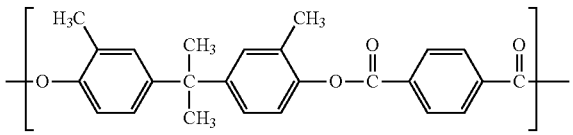

(10-2)

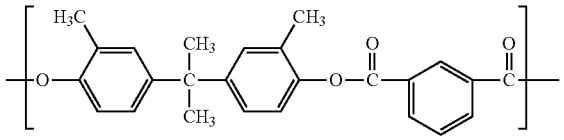

In such a manner, an electrophotographic photosensitive member for evaluating the positive memory and the potential variation was manufactured. Further as in the above, one more electrophotographic photosensitive member was manufactured, and made as an electrophotographic photosensitive member for determination.

(Determination Test)

The electrophotographic photosensitive member for determination was immersed for 5 min in a mixed solvent of 40 parts of dimethoxymethane and 60 parts of o-xylene to thereby peel a hole transporting layer, and thereafter, further immersed for 5 min in a cyclohexanone solvent to thereby peel a charge generating layer as well. Thereafter, the resultant was dried for 10 min at 100° C. No components of the hole transporting layer and the charge generating layer were confirmed to be left remaining on the surface of an electron transporting layer by using an FTIR-ATR method. This electrophotographic photosensitive member was allowed to stand at a temperature of 25° C. in an environment of a humidity of 50% RH for 24 hours; and thereafter, the center portion (a position of 130 mm from the edge) of the electrophotographic photosensitive member was cut out into 1 cm-square to thereby fabricate a sample for ESCA measurement.

The ESCA measurement, as described above, was carried out by etching the sample at every 3 min from the measurement of a surface of an electron transporting layer by Ion gun C60 (hereinafter, also referred to as C60), and thereafter repeating the measurement of ratios of the each atom until the measurement reached a conductive layer (until Ti which titanium oxide particles had started to be detected) to thereby analyze the ratios of the each atom in the depth direction by C60. 10 points in total consisting of an upper end point and a lower end point of the electron transporting layer, and 8 points dividing the electron transporting layer equally into 9 parts in the depth direction were selected from the etching time until 30 min; and ratios (atomic %) of the number of carbon atoms, ratios (atomic %) of the number of nitrogen atoms and ratios (atomic %) of the number of oxygen atoms acquired at the respective measurement points, and the standard deviations, σ(C), σ(N) and σ(O), of the ratios of the each atom calculated therefrom, are shown in Table 11. In addition to the measurement of carbon atoms, nitrogen atoms and oxygen atoms as atoms constituting the electron transporting layer (cured layer), also the measurement was carried out for atoms including halogen atoms such as fluorine atoms, chlorine atoms and bromine atoms, silicon atoms, phosphorus atoms and sulfur atoms; and the sum (constituting proportion) of the ratio of the number of carbon atoms, the ratio of the number of nitrogen atoms and the ratio of the number of oxygen atoms based on the ratio of all atoms except hydrogen atoms was measured as a total content ratio (atomic %). The results are shown in Table 12.

Alternatively, without peeling a hole transporting layer and a charge generating layer of the electrophotographic photosensitive member for determination by using solvents, the center portion (a position of 130 mm from the edge) of the electrophotographic photosensitive member was cut out into 1 cm-square to thereby fabricate a sample for ESCA measurement. The sample was analyzed for the ratios of the each atom in the depth direction by ESCA similarly from above the charge generating layer, and results similar to the case where the charge generating layer and the hole transporting layer were peeled were acquired. In this case, the determination of being a surface of the electron transporting layer was made at the time point when the detection of gallium atoms of the charge generating substance started to disappear.

TABLE 11

| | Etching Time (min) | | | | | | | | | | | | Standard Deviation |
|---|---|---|---|---|---|---|---|---|---|---|---|---|---|
| | 0 | 3 | 6 | 9 | 12 | 15 | 18 | 21 | 24 | 27 | 33 | 36 | (σ) |
| Ratio of Carbon Element (%) | 73.5 | 72.6 | 73.1 | 73.6 | 72.9 | 73.3 | 73.5 | 74.4 | 73.7 | 74.0 | 68.2 | 39.6 | 0.5 |
| Ratio of Nitrogen Element (%) | 11 | 12.9 | 12.6 | 12.4 | 12 | 12 | 11.3 | 11.1 | 11.1 | 11.3 | 9.6 | 5.6 | 0.7 |
| Ratio of Oxygen Element (%) | 15.5 | 14.5 | 14.3 | 14.0 | 15.1 | 14.7 | 15.2 | 14.5 | 15.2 | 14.7 | 18.0 | 34.4 | 0.5 |
| Ratio of Titanium Element (%) | 0.0 | 0.0 | 0.0 | 0.0 | 0.0 | 0.0 | 0.0 | 0.0 | 0.0 | 0.0 | 4.2 | 20.4 | — |

(Evaluations of the Positive Memory and the Potential Variation)

An electrophotographic photosensitive member manufactured for evaluating the positive memory and the potential variation was mounted on a remodeled apparatus (pre-light irradiation: off, primary charging: roller contacting DC charging, process speed: 120 mm/sec, laser light irradiation) of a laser beam printer (trade name: LBP-2510) made by Canon Corp.; and the evaluations of the potential variation and the printed-out image (positive memory) were carried out. Details are as follows.

1. Positive Memory

A process cartridge for a cyan color of the laser beam printer was remodeled, and a potential probe (model: 6000B-8, made by Trek Japan KK) was mounted on a development position; and the manufactured electrophotographic photosensitive member was mounted, and the potential of the center portion of the electrophotographic photosensitive member was measured under an environment of a temperature of 23° C. and a humidity of 50% RH by using a surface electrometer (model: 344, made by Trek Japan KK). The charging potential and the irradiation light intensity were adjusted so that the dark area potential (Vd) of the surface potential of the electrophotographic photosensitive member became −600 V and the light area potential (Vl) thereof became −200 V. Then, +300 V as DC charging by an external power source (high-voltage power source, Model 610C, made by Trek Japan KK) was applied for 5 min on the electrophotographic photosensitive member by a charging roller while the electrophotographic photosensitive member was being rotated in the laser beam printer. With the charging voltage and the irradiation light intensity having established the dark area potential (Vd) and the light area potential (Vl) before the application of the positive charge (+300 V), the dark area potential and the light area potential were measured at 5 min after the application of the positive charge (+300 V). Thereby, a light area potential difference before and after the application of the positive charge was measured as ΔVl as a positive memory. The results are shown in Table 12.

Then, the electrophotographic photosensitive member was mounted on the process cartridge for a cyan color of the laser beam printer, and the process cartridge was mounted on a process cartridge station for cyan, and images were printed out before and after the application of the positive charge. One sheet of a halftone image was printed out for each of before and after the application of the positive charge.

Figure 4:
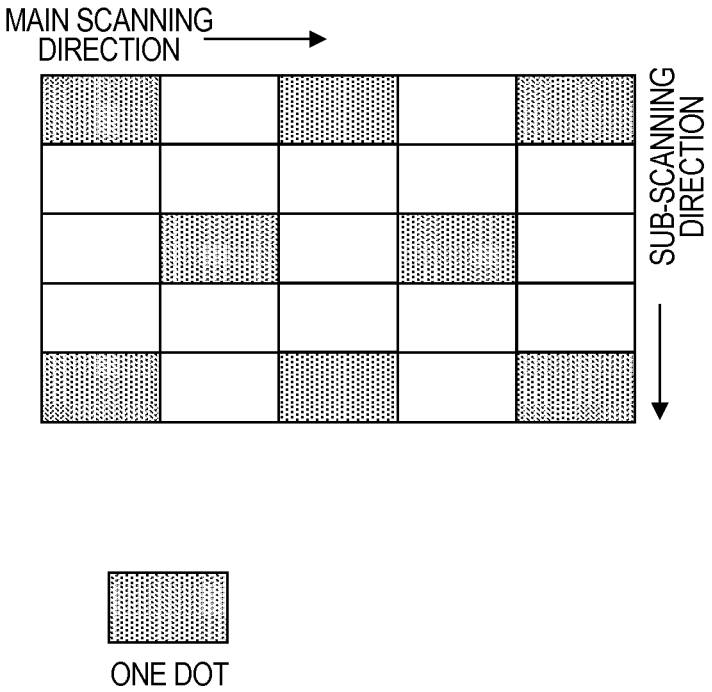
FIG. 4 is a diagram to describe a one-dot keima (similar to knight's move) pattern image.

The halftone image was a halftone image of a one-dot keima (similar to knight's move) pattern as illustrated in FIG. 4. The evaluation of the positive memory image was carried out by the measurement of a density difference between the image density of a halftone image of a one-dot keima pattern before the application of the positive charge and the image density of a halftone image of a one-dot keima pattern after the application of the positive charge. The density differences of 10 points in one sheet of a halftone image of a one-dot keima pattern were measured by a spectrodensitometer (trade name: X-Rite 504/508, made by X-Rite Inc.). The average of the 10 points in total was calculated. Similarly also for a halftone image which had not been subjected to the application of the positive charge, the average value of the densities of 10 points in total was calculated. The image density differences between the both are shown in Table 12. It is found that a higher density of a halftone image caused a stronger positive memory. It is meant that the smaller density difference (Macbeth density difference), the more suppressed the positive memory. A positive memory image density difference of 0.10 or more gave a level thereof having a visually obvious difference, and a ghost image density difference of less than 0.10 gave a level thereof having no visually obvious difference.

2. Potential Variation

A process cartridge for a cyan color of the laser beam printer was remodeled, and a potential probe (model: 6000B-8, made by Trek Japan KK) was mounted on the development position; and the potential of the center portion of the electrophotographic photosensitive member was measured under an environment of a temperature of 23° C. and a humidity of 5% RH by using a surface electrometer (model: 344, made by Trek Japan KK). The charging potential and the irradiation light intensity were adjusted so that the dark area potential (Vd) became −600 V and the light area potential (Vl) became −200 V. The electrophotographic photosensitive member was repeatedly used at the adjusted irradiation light intensity in that state (the state in which the potential probe was at the place where a developing unit would have been) for 2,000 sheets continuously. Vd and Vl after the 2,000-sheets are shown in Table 12.

Examples 2 to 5

Electrophotographic photosensitive members were manufactured and evaluated as in Example 1, except for altering the thickness of the electron transporting layer from 0.53 μm to 0.38 μm (Example 2), 0.25 μm (Example 3), 0.20 μm (Example 4) and 0.15 μm (Example 5). The results are shown in Table 12.

Example 6

An electrophotographic photosensitive member was manufactured and evaluated as in Example 1, except for forming an electron transporting layer as follows. The results are shown in Table 12.

4 parts of the electron transporting substance (A101), 5.5 parts of the isocyanate compound (B1:blocking group (H1)=5.1:2.2 (mass ratio)), 0.3 part of the resin (D1) and 0.05 part of dioctyltin laurate as a catalyst were dissolved in a mixed solvent of 100 parts of dimethylacetoamide and 100 parts of methyl ethyl ketone to thereby prepare a coating liquid for an electron transporting layer. The coating liquid for an electron transporting layer was immersion coated on the conductive layer, and the obtained coating film was heated for 40 min at 160° C. to be polymerized to thereby form an electron transporting layer as a cured layer having a thickness of 0.61 μm.

Examples 7 to 9

Electrophotographic photosensitive members were manufactured and evaluated as in Example 6, except for altering the thickness of the electron transporting layer from 0.61 μm to 0.52 μm (Example 7), 0.40 μm (Example 8) and 0.26 μm (Example 9). The results are shown in Table 12.

Example 10

An electrophotographic photosensitive member was manufactured and evaluated as in Example 1, except for forming an electron transporting layer as follows. The results are shown in Table 12.

5 parts of the electron transporting substance (A101), 2.3 parts of the amine compound (C1-3), 3.3 parts of the resin (D1) and 0.1 part of dodecylbenzenesulfonic acid as a catalyst were dissolved in a mixed solvent of 100 parts of dimethylacetoamide and 100 parts of methyl ethyl ketone to thereby prepare a coating liquid for an electron transporting layer. The coating liquid for an electron transporting layer was immersion coated on the conductive layer, and the obtained coating film was heated for 40 min at 160° C. to be cured to thereby form an electron transporting layer as a cured layer having a thickness of 0.51 μm.

Examples 11 and 12

Electrophotographic photosensitive members were manufactured and evaluated as in Example 10, except for altering the thickness of the electron transporting layer from 0.51 μm to 0.45 μm (Example 11) and 0.34 μm (Example 12). The results are shown in Table 12.

Example 13

An electrophotographic photosensitive member was manufactured and evaluated as in Example 1, except for forming an electron transporting layer as follows. The results are shown in Table 12.

(Electron Transporting Layer)

5 parts of the electron transporting substance (A101), 1.75 parts of the amine compound (C1-3), 2 parts of the resin (D1) and 0.1 part of dodecylbenzenesulfonic acid as a catalyst were dissolved in a mixed solvent of 100 parts of dimethylacetoamide and 100 parts of methyl ethyl ketone to thereby prepare a coating liquid for an electron transporting layer. The coating liquid for an electron transporting layer was immersion coated on the conductive layer, and the obtained coating film was heated for 40 min at 160° C. to be polymerized to thereby form an electron transporting layer as a cured layer having a thickness of 0.70 μm.

Examples 14 to 16

Electrophotographic photosensitive members were manufactured and evaluated as in Example 13, except for altering the thickness of the electron transporting layer from 0.70 μm to 0.58 μm (Example 14), 0.50 μm (Example 15) and 0.35 μm (Example 16). The results are shown in Table 12.

Examples 17 to 32

Electrophotographic photosensitive members were manufactured and evaluated as in Example 9, except for altering the electron transporting substance (A101) of Example 9 as shown in Table 12. The results are shown in Table 12.

Examples 33 to 47

Electrophotographic photosensitive members were manufactured and evaluated as in Example 16, except for altering the electron transporting substance (A101) of Example 16 as shown in Tables 12 and 13. The results are shown in Tables 12 and 13.

Examples 48 to 53

Electrophotographic photosensitive members were manufactured and evaluated as in Example 8, except for altering the crosslinking agent of Example 8 and the thickness of an electron transporting layer as shown in Table 13. The results are shown in Table 13.

Examples 54 and 55

Electrophotographic photosensitive members were manufactured and evaluated as in Example 16, except for altering the crosslinking agent of Example 16 as shown in Table 13. The results are shown in Table 13.

Example 56

An electrophotographic photosensitive member was manufactured and evaluated as in Example 1, except for forming an electron transporting layer as follows. The results are shown in Table 13.

4 parts of the electron transporting substance (A101), 4 parts of the amine compound (C1-9), 1.5 parts of the resin (D1) and 0.2 part of dodecylbenzenesulfonic acid as a catalyst were dissolved in a mixed solvent of 100 parts of dimethylacetoamide and 100 parts of methyl ethyl ketone to thereby prepare a coating liquid for an electron transporting layer. The coating liquid for an electron transporting layer was immersion coated on the conductive layer, and the obtained coating film was heated for 40 min at 160° C. to be polymerized to thereby form an electron transporting layer as a cured layer having a thickness of 0.35 μm.

Examples 57 and 58

Electrophotographic photosensitive members were manufactured and evaluated as in Example 56, except for altering the crosslinking agent of Example 56 as shown in Table 13. The results are shown in Table 13.

Examples 59 to 62

Electrophotographic photosensitive members were manufactured and evaluated as in Example 9, except for altering the resin of Example 9 as shown in Table 13. The results are shown in Table 13.

Example 63

An electrophotographic photosensitive member was manufactured and evaluated as in Example 1, except for forming an electron transporting layer as follows. The results are shown in Table 13.

6 parts of the electron transporting substance (A124), 2.1 parts of the amine compound (C1-3), 1.2 parts of the resin (D21) and 0.1 part of dodecylbenzenesulfonic acid as a catalyst were dissolved in a mixed solvent of 100 parts of dimethylacetoamide and 100 parts of methyl ethyl ketone to thereby prepare a coating liquid for an electron transporting layer. The coating liquid for an electron transporting layer was immersion coated on the conductive layer, and the obtained coating film was heated for 40 min at 160° C. to be polymerized to thereby form an electron transporting layer as a cured layer having a thickness of 0.80 μm.

Examples 64 and 65

Electrophotographic photosensitive members were manufactured and evaluated as in Example 63, except for altering the electron transporting substance (A124) of Example 63 as shown in Table 13. The results are shown in Table 13.

Example 66

An electrophotographic photosensitive member was manufactured and evaluated as in Example 1, except for forming an electron transporting layer as follows. The results are shown in Table 13.

6 parts of the electron transporting substance (A125), 2.1 parts of the amine compound (C1-3), 0.5 part of the resin (D21) and 0.1 part of dodecylbenzenesulfonic acid as a catalyst were dissolved in a mixed solvent of 100 parts of dimethylacetoamide and 100 parts of methyl ethyl ketone to thereby prepare a coating liquid for an electron transporting layer. The coating liquid for an electron transporting layer was immersion coated on the conductive layer, and the obtained coating film was heated for 40 min at 160° C. to be polymerized to thereby form an electron transporting layer as a cured layer having a thickness of 2.10 μm.

Example 67

An electrophotographic photosensitive member was manufactured and evaluated as in Example 1, except for forming an electron transporting layer as follows. The results are shown in Table 13.

6.5 parts of the electron transporting substance (A125), 2.1 parts of the amine compound (C1-3), 0.4 part of the resin (D21) and 0.1 part of dodecylbenzenesulfonic acid as a catalyst were dissolved in a mixed solvent of 100 parts of dimethylacetoamide and 100 parts of methyl ethyl ketone to thereby prepare a coating liquid for an electron transporting layer. The coating liquid for an electron transporting layer was immersion coated on the conductive layer, and the obtained coating film was heated for 40 min at 160° C. to be polymerized to thereby form an electron transporting layer as a cured layer having a thickness of 2.10 μm.

Example 68

An electrophotographic photosensitive member was manufactured and evaluated as in Example 66, except for altering the thickness of the electron transporting layer from 2.10 μm to 1.55 μm. The results are shown in Table 13.

Example 69

An electrophotographic photosensitive member was manufactured and evaluated as in Example 1, except for forming an electron transporting layer as follows. The results are shown in Table 13.

3.6 parts of the electron transporting substance (A404), 7.0 parts of the isocyanate compound (B1:blocking group (H1)=5.1:2.2 (mass ratio)), 1.3 parts of the resin (D11) and 0.05 part of dioctyltin laurate as a catalyst were dissolved in a mixed solvent of 100 parts of dimethylacetoamide and 100 parts of methyl ethyl ketone to thereby prepare a coating liquid for an electron transporting layer. The coating liquid for an electron transporting layer was immersion coated on the conductive layer, and the obtained coating film was heated for 40 min at 160° C. to be polymerized to thereby form an electron transporting layer as a cured layer having a thickness of 0.53 μm.

Examples 70 to 77

Electrophotographic photosensitive members were formed and evaluated as in Example 69, except for altering the kinds of the electron transporting substance, the crosslinking agent and the resin of Example 69 to kinds shown in Table 13. The results are shown in Table 13.

Examples 78 and 79

Electrophotographic photosensitive members were manufactured and evaluated as in Example 69, except for altering the kinds of the electron transporting substance, the crosslinking agent and the resin of Example 69 to kinds shown in Table 13, and altering the thickness of the electron transporting layer to 1.20 μm. The results are shown in Table 13.

Example 80

An electrophotographic photosensitive member was manufactured and evaluated as in Example 63, except for altering the thickness of the electron transporting layer from 0.80 μm to 3.30 μm. The results are shown in Table 13.

Example 81

An electrophotographic photosensitive member was manufactured and evaluated as in Example 64, except for altering the thickness of the electron transporting layer from 0.80 μm to 3.80 μm. The results are shown in Table 13.

Example 82

An electrophotographic photosensitive member was manufactured and evaluated as in Example 66, except for altering the thickness of the electron transporting layer from 2.10 μm to 4.50 μm. The results are shown in Table 13.

Examples 83 to 85

Electrophotographic photosensitive members were formed and evaluated as in Example 69, except for altering the kinds of the electron transporting substance, the crosslinking agent and the resin of Example 69 to kinds shown in Table 13. The results are shown in Table 13.

Example 86

An electrophotographic photosensitive member was manufactured and evaluated for the positive memory as in Example 1, except for altering the preparation of the coating liquid for a conductive layer, the coating liquid for an undercoating layer and the coating liquid for a hole transporting layer in Example 1, as follows. The results are shown in Table 14.

The preparation of a coating liquid for a conductive layer was altered as follows. 214 parts of a titanium oxide ($TiO_2$) particle coated with an oxygen-deficient tin oxide ($SnO_2$) as a metal oxide particle, 132 parts of a phenol resin (trade name: Plyophen J-325) as a binding resin, and 98 parts of 1-methoxy-2-propanol as a solvent were placed in a sand mill using 450 parts of a glass bead of 0.8 mm in diameter, and subjected to a dispersion treatment under the conditions of a rotation frequency of 2,000 rpm, a dispersion treatment time of 4.5 hours and a set temperature of a cooling water of 18° C. to thereby obtain a dispersion liquid. The glass bead was removed from the dispersion liquid by a mesh (mesh opening: 150 μm).

A silicone resin particle (trade name: Tospearl 120, made by Momentive Performance Materials Inc., average particle diameter: 2 μm) as a surface-roughening material was added to the dispersion liquid after the removal of the glass bead so as to become 10% by mass with respect to the total mass of the metal oxide particle and the binding resin in the dispersion liquid; and a silicone oil (trade name: SH28PA, made by Dow Corning Toray Co., Ltd.) as a leveling agent was added to the dispersion liquid so as to become 0.01% by mass with respect to the total mass of the metal oxide particle and the binding resin in the dispersion liquid; and the resultant mixture was stirred to thereby prepare a coating liquid for a conductive layer. The coating liquid for a conductive layer was immersion coated on a support, and the obtained coating film was dried and heat cured for 30 min at 150° C. to thereby form a conductive layer having a thickness of 30 μm.

Then, the preparation of a coating liquid for an undercoating layer was altered as follows. 6.2 parts of the compound (A168), 7 parts of the crosslinking agent (B1:blocking group (H5)=5.1:2.9 (mass ratio)), 1.1 parts of the resin (B25) and 0.05 part of dioctyltin laurate as a catalyst were dissolved in a mixed solvent of 100 parts of dimethylacetoamide and 100 parts of methyl ethyl ketone to thereby prepare a coating liquid for an undercoating layer. The coating liquid for an undercoating layer was immersion coated on the conductive layer, and the obtained coating film was heated for 40 min at 160° C. to be cured (polymerized) to thereby form an undercoating layer as a cured layer having a thickness of 0.52 μm.

Then, the preparation of a coating liquid for a hole transporting layer was altered as follows. 9 parts of a hole transporting substance having a structure represented by the above formula (9), 1 part of a hole transporting substance having a structure represented by the following formula (18), 3 parts of a polyester resin F (weight-average molecular weight: 90,000) having a repeating structure represented by the following formula (24) and having a repeating structure represented by the following formula (26) and a repeating structure represented by the following formula (25), in a ratio of 7:3, and 7 parts of a polyester resin I (weight-average molecular weight: 120,000) containing a repeating structure represented by the above formula (10-1) and a repeating structure represented by the above formula (10-2) in a ratio of 5:5 were dissolved in a mixed solvent of 30 parts of dimethoxymethane and 50 parts of o-xylene to thereby prepare a coating liquid for a hole transporting layer. Here, the content of the repeating structural unit represented by the following formula (24) in the polyester resin F was 10% by mass, and the content of the repeating structural units represented by the following formulae (25) and (26) therein was 90% by mass.

(18)

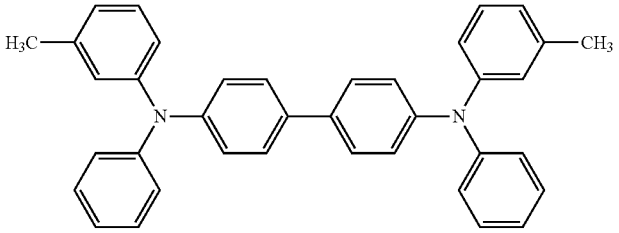

(24)

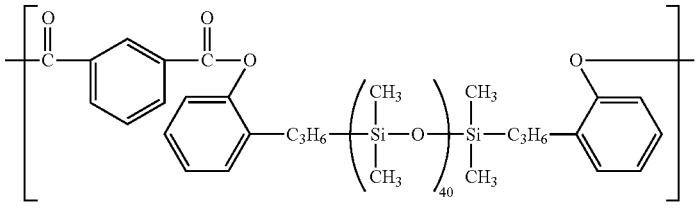

(25)

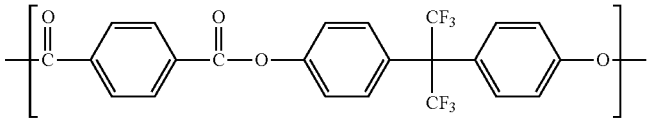

-continued (26)

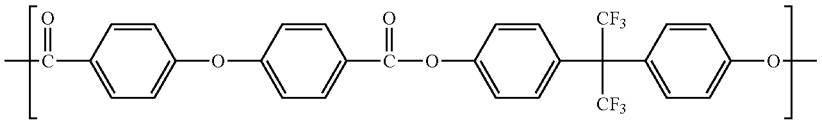

The coating liquid for a hole transporting layer was immersion coated on the charge generating layer, and dried for 1 hour at 120° C. to thereby form a hole transporting layer having a thickness of 16 μm. The formed hole transporting layer was confirmed to have a domain structure in which a matrix containing the charge transporting substance and the polyester resin I contained the polyester resin F.

Example 87

An electrophotographic photosensitive member was manufactured and evaluated for the positive memory as in Example 86, except for altering the preparation of the coating liquid for a hole transporting layer in Example 86, as follows. The results are shown in Table 14.

The preparation of a coating liquid for a hole transporting layer was altered as follows. 9 parts of the hole transporting substance having a structure represented by the above formula (9), 1 part of the hole transporting substance having a structure represented by the above formula (18), 10 parts of a polycarbonate resin J (weight-average molecular weight: 70,000) having a repeating structure represented by the following formula (29), and 0.3 part of a polycarbonate resin K (weight-average molecular weight: 40,000) having a repeating structure represented by the following formula (29), a repeating structure represented by the following formula (30) and a structure of at least one terminal represented by the following formula (31) were dissolved in a mixed solvent of 30 parts of dimethoxymethane and 50 parts of orthoxylene to thereby prepare a coating liquid for a hole transporting layer. The total mass of the structure represented by the following formulae (30) and (31) in the polycarbonate resin K was 30% by mass. The coating liquid for a hole transporting layer was immersion coated on the charge generating layer, and dried for 1 hour at 120° C. to thereby form a hole transporting layer having a thickness of 16 μm.

(29)

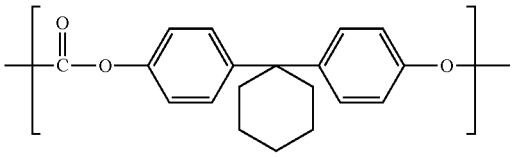

(30)

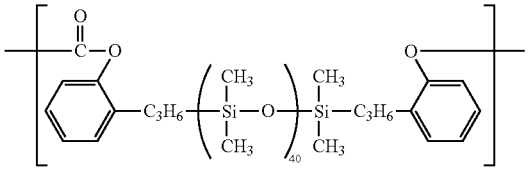

-continued (31)

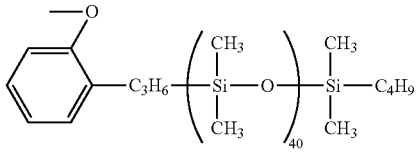

Example 88

An electrophotographic photosensitive member was manufactured and evaluated for the positive memory as in Example 87, except for using 10 parts of the polyester resin I (weight-average molecular weight: 120,000) in place of 10 parts of the polycarbonate resin J (weight-average molecular weight: 70,000) in the preparation of the coating liquid for a hole transporting layer of Example 87. The results are shown in Table 14.

Examples 89 to 91

Electrophotographic photosensitive members were manufactured and evaluated for the positive memory as in Examples 86 to 88, except for altering the preparation of the coating liquids for a conductive layer in Examples 86 to 88, as follows. The results are shown in Table 14.

The preparation of a coating liquid for a conductive layer was altered as follows. 207 parts of a titanium oxide ($TiO_2$) particle coated with a tin oxide ($SnO_2$) doped with phosphorus (P) as a metal oxide particle, 144 parts of a phenol resin (trade name: Plyophen J-325) as a binding resin, and 98 parts of 1-methoxy-2-propanol as a solvent were placed in a sand mill using 450 parts of a glass bead of 0.8 mm in diameter, and subjected to a dispersion treatment under the conditions of a rotation frequency of 2,000 rpm, a dispersion treatment time of 4.5 hours and a set temperature of a cooling water of 18° C. to thereby obtain a dispersion liquid. The glass bead was removed from the dispersion liquid by a mesh (mesh opening: 150 μm).

A silicone resin particle (trade name: Tospearl 120) as a surface-roughening material was added to the dispersion liquid after the removal of the glass bead so as to become 15% by mass with respect to the total mass of the metal oxide particle and the binding resin in the dispersion liquid; and a silicone oil (trade name: SH28PA) as a leveling agent was added to the dispersion liquid so as to become 0.01% by mass with respect to the total mass of the metal oxide particle and the binding resin in the dispersion liquid; and the resultant mixture was stirred to thereby prepare a coating liquid for a conductive layer. The coating liquid for a conductive layer was immersion coated on a support, and the obtained coating film was dried and heat cured for 30 min at 150° C. to thereby form a conductive layer having a thickness of 30 μm.

Examples 92 and 93

Electrophotographic photosensitive members were manufactured and evaluated for the positive memory as in Example 1, except for altering the kind and the content of the electron transporting substance in Example 86 to kinds and contents shown in Table 14. The results are shown in Table 14.

TABLE 12

| Example | Electron Transporting Substance Kind | Electron Transporting Substance Molecular Weight | Crosslinking Agent Kind | Crosslinking Agent Molecular Weight | Resin | Thickness of Electron Transporting Layer (μm) | Standard Deviation of 10 Measurement Values (%) σ (C) | σ (N) | σ (O) | Total Content of C, N and O Atoms (atomic %) | Positive Memory Vl Potential Difference | Positive Memory Vl Density Difference | Potential After 2,000-Sheets Repeated Use Vd | Vl |
|---|---|---|---|---|---|---|---|---|---|---|---|---|---|---|
| 1 | A101 | 456.49 | B1: H1 | 762 | D1 | 0.53 | 0.5 | 0.7 | 0.5 | 99.9 | 6 | 0.02 | −600 | −200 |
| 2 | A101 | 456.49 | B1: H1 | 762 | D1 | 0.38 | 0.5 | 0.7 | 0.5 | 99.9 | 6 | 0.02 | −600 | −200 |
| 3 | A101 | 456.49 | B1: H1 | 762 | D1 | 0.25 | 0.5 | 0.7 | 0.5 | 99.9 | 5 | 0.02 | −600 | −200 |
| 4 | A101 | 456.49 | B1: H1 | 762 | D1 | 0.20 | 0.5 | 0.7 | 0.5 | 99.9 | 5 | 0.01 | −600 | −200 |
| 5 | A101 | 456.49 | B1: H1 | 762 | D1 | 0.15 | 0.5 | 0.7 | 0.5 | 99.9 | 4 | 0.01 | −600 | −200 |
| 6 | A101 | 456.49 | B1: H1 | 762 | D1 | 0.61 | 0.6 | 0.7 | 0.5 | 99.9 | 5 | 0.02 | −600 | −200 |
| 7 | A101 | 456.49 | B1: H1 | 762 | D1 | 0.52 | 0.6 | 0.7 | 0.5 | 99.9 | 5 | 0.02 | −600 | −200 |
| 8 | A101 | 456.49 | B1: H1 | 762 | D1 | 0.40 | 0.6 | 0.7 | 0.5 | 99.9 | 4 | 0.01 | −600 | −200 |
| 9 | A101 | 456.49 | B1: H1 | 762 | D1 | 0.26 | 0.6 | 0.7 | 0.5 | 99.9 | 4 | 0.01 | −600 | −200 |
| 10 | A101 | 456.49 | C1-3 | 558 | D1 | 0.51 | 0.4 | 0.7 | 0.6 | 99.9 | 6 | 0.02 | −600 | −200 |
| 11 | A101 | 456.49 | C1-3 | 558 | D1 | 0.45 | 0.4 | 0.7 | 0.6 | 99.9 | 5 | 0.01 | −600 | −200 |
| 12 | A101 | 456.49 | C1-3 | 558 | D1 | 0.34 | 0.4 | 0.7 | 0.6 | 99.9 | 5 | 0.02 | −600 | −200 |
| 13 | A101 | 456.49 | C1-3 | 558 | D19 | 0.70 | 0.5 | 0.7 | 0.5 | 99.9 | 6 | 0.02 | −600 | −200 |
| 14 | A101 | 456.49 | C1-3 | 558 | D20 | 0.58 | 0.5 | 0.7 | 0.5 | 99.9 | 5 | 0.02 | −600 | −200 |
| 15 | A101 | 456.49 | C1-3 | 558 | D20 | 0.50 | 0.5 | 0.7 | 0.5 | 99.9 | 4 | 0.02 | −600 | −200 |
| 16 | A101 | 456.49 | C1-3 | 558 | D20 | 0.35 | 0.5 | 0.7 | 0.5 | 99.9 | 3 | 0.01 | −600 | −200 |
| 17 | A106 | 473.43 | B1: H1 | 762 | D1 | 0.46 | 0.5 | 0.6 | 0.5 | 99.9 | 6 | 0.02 | −600 | −200 |
| 18 | A107 | 504.36 | B1: H1 | 762 | D1 | 0.46 | 0.7 | 0.7 | 0.4 | 92.7 | 5 | 0.02 | −600 | −200 |
| 19 | A110 | 422.47 | B1: H1 | 762 | D1 | 0.46 | 0.5 | 0.7 | 0.5 | 99.9 | 6 | 0.02 | −600 | −200 |
| 20 | A124 | 410.42 | B1: H1 | 762 | D1 | 0.46 | 0.6 | 0.6 | 0.7 | 99.9 | 6 | 0.02 | −600 | −200 |
| 21 | A125 | 478.45 | B1: H1 | 762 | D1 | 0.46 | 0.7 | 0.7 | 0.5 | 99.9 | 5 | 0.02 | −600 | −200 |
| 22 | A135 | 506.51 | B1: H1 | 762 | D1 | 0.46 | 0.6 | 0.7 | 0.6 | 99.9 | 5 | 0.02 | −600 | −200 |
| 23 | A136 | 410.42 | B1: H1 | 762 | D1 | 0.46 | 0.6 | 0.7 | 0.3 | 99.9 | 5 | 0.02 | −600 | −200 |
| 24 | A146 | 438.39 | B1: H1 | 762 | D1 | 0.46 | 0.4 | 0.5 | 0.7 | 99.9 | 5 | 0.02 | −600 | −200 |
| 25 | A216 | 420 | B1: H1 | 762 | D1 | 0.46 | 0.7 | 1.0 | 0.8 | 99.9 | 8 | 0.03 | −600 | −204 |
| 26 | A316 | 392 | B1: H1 | 762 | D1 | 0.46 | 1.0 | 1.0 | 0.7 | 99.9 | 10 | 0.04 | −600 | −205 |
| 27 | A423 | 442.46 | B1: H1 | 762 | D1 | 0.46 | 0.8 | 0.9 | 1.0 | 99.9 | 9 | 0.04 | −600 | −204 |
| 28 | A522 | 410.47 | B1: H1 | 762 | D1 | 0.46 | 0.9 | 1.0 | 0.9 | 99.9 | 9 | 0.04 | −600 | −204 |
| 29 | A616 | 342.34 | B1: H1 | 762 | D1 | 0.46 | 1.0 | 1.0 | 0.7 | 99.9 | 10 | 0.04 | −600 | −205 |
| 30 | A726 | 548 | B1: H1 | 762 | D1 | 0.46 | 0.8 | 0.9 | 0.8 | 99.9 | 8 | 0.03 | −600 | −204 |
| 31 | A831 | 830.87 | B1: H1 | 762 | D1 | 0.46 | 0.5 | 0.9 | 0.8 | 98.1 | 8 | 0.03 | −600 | −203 |
| 32 | A919 | 364.35 | B1: H1 | 762 | D1 | 0.46 | 0.7 | 1.0 | 1.0 | 99.9 | 10 | 0.04 | −600 | −205 |
| 33 | A106 | 473.43 | C1-3 | 558 | D20 | 0.35 | 0.5 | 0.7 | 0.7 | 99.9 | 4 | 0.01 | −600 | −200 |
| 34 | A113 | 489.5 | C1-3 | 558 | D20 | 0.35 | 0.6 | 0.7 | 0.6 | 99.9 | 3 | 0.01 | −600 | −200 |
| 35 | A116 | 456.45 | C1-3 | 558 | D20 | 0.35 | 0.7 | 0.5 | 0.6 | 99.9 | 4 | 0.01 | −600 | −200 |
| 36 | A120 | 456.49 | C1-3 | 558 | D20 | 0.35 | 0.4 | 0.6 | 0.7 | 99.9 | 3 | 0.01 | −600 | −200 |
| 37 | A124 | 410.42 | C1-3 | 558 | D20 | 0.35 | 0.7 | 0.5 | 0.5 | 99.9 | 3 | 0.01 | −600 | −200 |
| 38 | A136 | 410.42 | C1-3 | 558 | D20 | 0.35 | 0.6 | 0.7 | 0.7 | 99.9 | 4 | 0.01 | −600 | −200 |
| 39 | A217 | 448 | C1-3 | 558 | D20 | 0.35 | 1.0 | 1.0 | 0.7 | 99.9 | 9 | 0.03 | −600 | −204 |
| 40 | A306 | 315.33 | C1-3 | 558 | D20 | 0.35 | 0.8 | 1.0 | 0.8 | 99.9 | 10 | 0.04 | −600 | −205 |
| 41 | A306 | 315.33 | C1-3 | 558 | D20 | 0.35 | 1.0 | 0.7 | 0.7 | 99.9 | 8 | 0.03 | −600 | −204 |
| 42 | A404 | 412.44 | C1-3 | 558 | D20 | 0.35 | 0.8 | 1.0 | 0.7 | 99.9 | 9 | 0.04 | −600 | −204 |
| 43 | A510 | 313.39 | C1-3 | 558 | D20 | 0.35 | 0.5 | 0.9 | 0.7 | 99.9 | 8 | 0.03 | −600 | −203 |

TABLE 13

| Example | Electron Transporting Substance Kind | Electron Transporting Substance Molecular Weight | Crosslinking Agent Kind | Crosslinking Agent Molecular Weight | Resin | Thickness of Electron Transporting Layer (μm) | Standard Deviation of 10 Measurement Values (%) σ (C) | σ (N) | σ (O) | Total Content of C, N and O Atoms (atomic %) | Positive Memory Vl Potential Difference | Positive Memory Vl Density Difference | Potential After 2,000-Sheets Repeated Use Vd | Vl |
|---|---|---|---|---|---|---|---|---|---|---|---|---|---|---|
| 44 | A602 | 264.3 | C1-3 | 558 | D20 | 0.35 | 0.9 | 0.6 | 0.9 | 99.9 | 8 | 0.03 | −600 | −204 |
| 45 | A709 | 300.26 | C1-3 | 558 | D20 | 0.35 | 0.5 | 1.0 | 1.0 | 99.9 | 10 | 0.04 | −600 | −205 |
| 46 | A807 | 628.5 | C1-3 | 558 | D21 | 0.35 | 0.6 | 0.8 | 1.0 | 99.9 | 9 | 0.04 | −600 | −204 |
| 47 | A902 | 238.2 | C1-3 | 558 | D21 | 0.35 | 0.7 | 0.6 | 1.0 | 99.9 | 8 | 0.04 | −600 | −204 |
| 48 | A101 | 456.49 | B1: H2 | 762 | D1 | 0.26 | 0.7 | 0.5 | 0.5 | 99.9 | 5 | 0.02 | −600 | −200 |
| 49 | A101 | 456.49 | B1: H3 | 762 | D1 | 0.26 | 0.4 | 0.6 | 0.5 | 99.9 | 5 | 0.02 | −600 | −200 |
| 50 | A101 | 456.49 | B4: H5 | 800 | D1 | 0.26 | 0.4 | 0.5 | 0.5 | 99.9 | 6 | 0.02 | −600 | −200 |
| 51 | A101 | 456.49 | B5: H1 | 858.54 | D1 | 0.26 | 0.6 | 0.5 | 0.6 | 99.9 | 6 | 0.02 | −600 | −200 |
| 52 | A101 | 456.49 | B7: H1 | 897.76 | D1 | 0.26 | 0.7 | 0.5 | 0.5 | 99.9 | 5 | 0.02 | −600 | −200 |
| 53 | A101 | 456.49 | B15: H5 | 878 | D1 | 0.26 | 0.6 | 0.7 | 0.5 | 99.9 | 5 | 0.02 | −600 | −200 |
| 54 | A101 | 456.49 | C1-1 | 306 | D20 | 0.35 | 0.4 | 0.5 | 0.5 | 99.9 | 4 | 0.01 | −600 | −200 |
| 55 | A101 | 456.49 | C1-7 | 558 | D20 | 0.35 | 0.5 | 0.5 | 0.5 | 99.9 | 4 | 0.01 | −600 | −200 |

TABLE 13-continued

| Example | Electron Transporting Substance Kind | Electron Transporting Substance Molecular Weight | Crosslinking Agent Kind | Crosslinking Agent Molecular Weight | Resin | Thickness of Electron Transporting Layer (μm) | Standard Deviation of 10 Measurement Values (%) σ (C) | σ (N) | σ (O) | Total Content of C, N and O Atoms (atomic %) | Positive Memory Vl Potential Difference | Positive Memory Vl Density Difference | Potential After 2,000-Sheets Repeated Use Vd | Vl |
|---|---|---|---|---|---|---|---|---|---|---|---|---|---|---|
| 56 | A101 | 456.49 | C1-9 | 378 | D1 | 0.35 | 0.5 | 0.7 | 0.5 | 99.9 | 5 | 0.02 | −600 | −200 |
| 57 | A101 | 456.49 | C2-1 | 353 | D1 | 0.35 | 0.6 | 0.5 | 0.7 | 99.9 | 5 | 0.02 | −600 | −200 |
| 58 | A101 | 456.49 | C3-3 | 363.5 | D1 | 0.35 | 0.7 | 0.6 | 0.5 | 99.9 | 5 | 0.02 | −600 | −200 |
| 59 | A101 | 456.49 | B1: H1 | 762 | D3 | 0.26 | 0.4 | 0.7 | 0.7 | 99.9 | 5 | 0.02 | −600 | −200 |
| 60 | A101 | 456.49 | B1: H1 | 762 | D5 | 0.26 | 0.6 | 0.6 | 0.6 | 99.9 | 5 | 0.02 | −600 | −200 |
| 61 | A101 | 456.49 | B1: H1 | 762 | D22 | 0.26 | 0.7 | 0.7 | 0.7 | 99.9 | 6 | 0.04 | −600 | −200 |
| 62 | A101 | 456.49 | B1: H1 | 762 | D23 | 0.26 | 0.6 | 0.7 | 0.7 | 99.9 | 6 | 0.04 | −600 | −200 |
| 63 | A124 | 410.4 | C1-3 | 558 | D21 | 0.80 | 0.5 | 0.5 | 0.6 | 99.9 | 3 | 0.01 | −600 | −200 |
| 64 | A130 | 450.6 | C1-3 | 558 | D21 | 0.80 | 0.4 | 0.6 | 0.5 | 99.9 | 4 | 0.01 | −600 | −200 |
| 65 | A156 | 444.44 | C1-3 | 558 | D21 | 0.80 | 0.4 | 0.5 | 0.6 | 99.9 | 3 | 0.01 | −600 | −200 |
| 66 | A125 | 478.5 | C1-3 | 558 | D21 | 2.10 | 0.7 | 0.7 | 0.6 | 99.9 | 5 | 0.02 | −600 | −200 |
| 67 | A125 | 478.5 | C1-3 | 558 | D21 | 2.10 | 0.7 | 0.5 | 0.6 | 99.9 | 5 | 0.02 | −600 | −200 |
| 68 | A125 | 478.5 | C1-3 | 558 | D21 | 1.55 | 0.7 | 0.5 | 0.6 | 99.9 | 6 | 0.02 | −600 | −200 |
| 69 | A404 | 412.44 | B1: H1 | 762 | D11 | 0.53 | 0.8 | 1.3 | 1.3 | 99.9 | 14 | 0.06 | −596 | −209 |
| 70 | A514 | 434.36 | B1: H1 | 762 | D24 | 0.53 | 0.7 | 1.3 | 1.0 | 99.9 | 13 | 0.05 | −595 | −207 |
| 71 | A101 | 456.49 | B1: H1 | 762 | D18 | 0.53 | 1.0 | 1.3 | 1.2 | 99.9 | 14 | 0.06 | −596 | −209 |
| 72 | A101 | 456.49 | B1: H1 | 762 | D18 | 0.53 | 0.9 | 1.2 | 1.1 | 99.9 | 14 | 0.05 | −596 | −208 |
| 73 | A101 | 456.49 | B20: H1 | 1267.5 | D23 | 0.53 | 0.8 | 1.3 | 1.1 | 99.9 | 14 | 0.06 | −596 | −209 |
| 74 | A310 | 456.49 | B20: H1 | 1267.5 | D14 | 0.53 | 0.7 | 1.3 | 1.2 | 94.4 | 13 | 0.05 | −595 | −207 |
| 75 | A423 | 442.46 | B20: H5 | 1267.5 | D4 | 0.53 | 1.0 | 1.3 | 0.9 | 99.9 | 14 | 0.06 | −596 | −209 |
| 76 | A316 | 392 | B20: H1 | 1250.4 | D11 | 0.53 | 0.9 | 1.5 | 1.4 | 99.9 | 17 | 0.07 | −592 | −218 |
| 77 | A404 | 412.44 | B20: H5 | 1250.4 | D24 | 0.53 | 1.2 | 1.5 | 1.4 | 99.9 | 18 | 0.07 | −592 | −217 |
| 78 | A830 | 574.54 | B20: H5 | 1250.4 | D18 | 1.20 | 1.4 | 1.4 | 1.5 | 99.9 | 20 | 0.08 | −591 | −218 |
| 79 | A514 | 434.36 | B20: H1 | 1250.4 | D18 | 1.20 | 1.0 | 1.5 | 1.5 | 99.9 | 19 | 0.08 | −590 | −219 |
| 80 | A124 | 410.42 | C1-3 | 558 | D21 | 3.30 | 0.5 | 0.7 | 0.6 | 99.9 | 5 | 0.02 | −600 | −200 |
| 81 | A130 | 478.45 | C1-3 | 558 | D21 | 3.80 | 0.4 | 0.6 | 0.7 | 99.9 | 6 | 0.02 | −600 | −200 |
| 82 | A125 | 506.51 | C1-3 | 558 | D21 | 4.50 | 0.5 | 0.7 | 0.6 | 99.9 | 5 | 0.02 | −600 | −200 |
| 83 | A831 | 830.87 | B12: H1 | 924.85 | D23 | 0.53 | 0.9 | 1.0 | 0.7 | 98.4 | 8 | 0.03 | −600 | −204 |
| 84 | A608 | 202 | C1-1 | 306 | D14 | 0.53 | 0.8 | 1.0 | 0.8 | 99.9 | 10 | 0.04 | −600 | −205 |
| 85 | A135 | 506.51 | B12: H2 | 966.85 | D4 | 0.53 | 1.0 | 0.7 | 0.7 | 99.9 | 9 | 0.04 | −600 | −204 |

TABLE 14

| Example | Electron Transporting Substance Kind | Electron Transporting Substance Molecular Weight | Crosslinking Agent Kind | Crosslinking Agent Molecular Weight | Resin | Thickness of Electron Transporting Layer | Standard Deviation of 10 Measurement Values (%) σ (C) | σ (N) | σ (O) | Total Content of C, N and O Atoms (atomic %) | Positive Memory Vl Potential Difference | Positive Memory Vl Density Difference | 2,000-Sheets Repeated Use Vd | Vl |
|---|---|---|---|---|---|---|---|---|---|---|---|---|---|---|
| 86 | A168 | 466.5 | B1: H5 | 792 | D25 | 0.52 | 0.4 | 0.6 | 0.5 | 99.9 | 5 | 0.02 | −600 | −200 |
| 87 | A168 | 466.5 | B1: H5 | 792 | D25 | 0.52 | 0.4 | 0.6 | 0.5 | 99.9 | 5 | 0.02 | −600 | −200 |
| 88 | A168 | 466.5 | B1: H5 | 792 | D25 | 0.52 | 0.4 | 0.6 | 0.5 | 99.9 | 4 | 0.01 | −600 | −200 |
| 89 | A168 | 466.5 | B1: H5 | 792 | D25 | 0.52 | 0.4 | 0.6 | 0.5 | 99.9 | 6 | 0.02 | −600 | −201 |
| 90 | A168 | 466.5 | B1: H5 | 792 | D25 | 0.52 | 0.4 | 0.6 | 0.5 | 99.9 | 5 | 0.02 | −600 | −200 |
| 91 | A168 | 466.5 | B1: H5 | 792 | D25 | 0.52 | 0.4 | 0.6 | 0.5 | 99.9 | 5 | 0.01 | −600 | −200 |
| 92 | A163 | 470.5 | B1: H5 | 792 | D25 | 0.51 | 0.5 | 0.6 | 0.4 | 96.6 | 4 | 0.01 | −600 | −200 |
| 93 | A163 | 470.5 | B1: H5 | 792 | D25 | 0.51 | 0.5 | 0.6 | 0.4 | 96.6 | 5 | 0.02 | −600 | −200 |

Comparative Example 1

An electrophotographic photosensitive member was manufactured and evaluated as in Example 1, except for forming an electron transporting layer as follows. The results are shown in Table 15.

4.0 parts of the electron transporting substance (A225), 3 parts of hexamethylene diisocyanate and 4 parts of the resin (D1) were dissolved in a mixed solvent of 100 parts of dimethylacetoamide and 100 parts of methyl ethyl ketone to thereby prepare a coating liquid for an electron transporting layer. The coating liquid for an electron transporting layer was immersion coated on the conductive layer, and the obtained coating film was heated for 40 min at 160° C. to be polymerized to thereby form an electron transporting layer having a thickness of 1.00 μm.

Comparative Example 2

An electrophotographic photosensitive member was manufactured and evaluated as in Example 1, except for forming an electron transporting layer as follows. The results are shown in Table 15.

5 parts of the electron transporting substance (A124), 2.5 parts of 2,4-toluene diisocyanate and 2.5 parts of a poly(p-hydroxystyrene) (trade name: Malkalinker, made by Maruzen Petrochemical Co., Ltd.) were dissolved in a mixed solvent of 100 parts of dimethylacetoamide and 100 parts of methyl ethyl ketone to thereby prepare a coating liquid for an electron transporting layer. The coating liquid for an electron transporting layer was immersion coated on the conductive layer, and the obtained coating film was heated for 40 min at 160° C. to be polymerized to thereby form an electron transporting layer having a thickness of 0.4 μm.

Comparative Example 3

An electrophotographic photosensitive member was manufactured and evaluated as in Example 1, except for forming an electron transporting layer as follows. The results are shown in Table 15.

7 parts of the electron transporting substance (A124), 2.0 parts of 2,4-toluene diisocyanate and 1 part of "Malkalinker" were dissolved in a mixed solvent of 100 parts of dimethylacetoamide and 100 parts of methyl ethyl ketone to thereby prepare a coating liquid for an electron transporting layer. The coating liquid for an electron transporting layer was immersion coated on the conductive layer, and the obtained coating film was heated for 40 min at 160° C. to be polymerized to thereby form an electron transporting layer having a thickness of 0.4 μm.

Comparative Example 5

An electrophotographic photosensitive member was manufactured and evaluated as in Example 1, except for forming an electron transporting layer as follows. The results are shown in Table 16.

5 parts of the electron transporting substance (A101) and 2.4 parts of a melamine resin (Yuban 20HS, made by Mitsui Chemicals Inc.) were dissolved in a mixed solvent of 50 parts of tetrahydrofuran and 50 parts of methoxypropanol to thereby prepare a coating liquid for an electron transporting layer. The coating liquid for an electron transporting layer was immersion coated on the conductive layer, and the obtained coating film was heated for 60 min at 150° C. to be polymerized to thereby form an electron transporting layer having a thickness of 1.00 μm.

Comparative Example 6

An electrophotographic photosensitive member was manufactured and evaluated as in Comparative Example 5, except for altering the thickness of the electron transporting layer from 1.00 μm to 0.50 μm. The results are shown in Table 16.

TABLE 15

| Comparative Example | Electron Transporting Substance Kind | Electron Transporting Substance Molecular Weight | Crosslinking Agent Kind | Crosslinking Agent Molecular Weight | Resin | Thickness of Electron Transporting Layer (μm) | Standard Deviation of 10 Measurement Values (%) σ (C) | σ (N) | σ (O) | Positive Memory Vl Potential Difference | Positive Memory Vl Density Difference | Potential After 2,000-Sheets Repeated Use Vd | Vl |
|---|---|---|---|---|---|---|---|---|---|---|---|---|---|
| 1 | A225 | 472.6 | hexamethylene diisocyanate | — | D1 | 1.00 | 1.3 | 1.8 | 1.6 | 27 | 0.12 | −580 | −235 |
| 2 | A124 | 410.4 | 2,4-toluene diisocyanate | — | poly(p-hydroxy-styrene) | 0.40 | 1.2 | 1.6 | 1.7 | 25 | 0.11 | −581 | −233 |
| 3 | A124 | 410.4 | 2,4-toluene diisocyanate | — | poly(p-hydroxy-styrene) | 0.40 | 1.1 | 1.7 | 1.6 | 23 | 0.10 | −582 | −231 |

Comparative Example 4

An electrophotographic photosensitive member was manufactured and evaluated as in Example 1, except for forming an electron transporting layer as follows. The results are shown in Table 16.

5 parts of the electron transporting substance (A922), 13.5 parts of an isocyanate compound (Sumidule 3173, made by Sumitomo Bayer Urethane Co., Ltd.), 10 parts of a butyral resin (BM-1, made by Sekisui Chemical Co., Ltd.) and 0.005 part of dioctyltin laurate as a catalyst were dissolved in a solvent of 120 parts of methyl ethyl ketone to thereby prepare a coating liquid for an electron transporting layer. The coating liquid for an electron transporting layer was immersion coated on the conductive layer, and the obtained coating film was heated for 40 min at 170° C. to be polymerized to thereby form an electron transporting layer having a thickness of 1.0 μm.

Comparative Example 7

An electrophotographic photosensitive member was manufactured and evaluated as in Comparative Example 5, except for altering the melamine resin of the electron transporting layer to the phenol resin (Plyophen J-325, made by DIC Corporation). The results are shown in Table 16.

Comparative Example 8

An electrophotographic photosensitive member was manufactured and evaluated as in Example 1, except for forming an electron transporting layer as follows. The results are shown in Table 16.

5 parts of the electron transporting substance represented by the following formula (12), 5 parts of trimethylolpropane triacrylate (Kayarad TMPTA, Nippon Kayaku Co., Ltd.) and 0.1 part of AIBN (2,2-azobisisobutyronitrile) were dissolved in 190 parts of tetrahydrofuran to thereby prepare a coating liquid for an electron transporting layer. The coating liquid for an electron transporting layer was immersion coated on the conductive layer, and the obtained coating film was heated for 30 min at 150° C. to be polymerized to thereby form an electron transporting layer having a thickness of 0.8 μm.

(12)

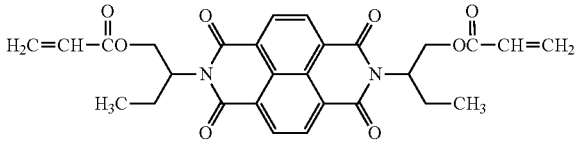

Comparative Example 9

An electrophotographic photosensitive member was manufactured and evaluated as in Example 1, except for forming an electron transporting layer as follows. The results are shown in Table 16.

5 parts of the electron transporting substance represented by the above formula (12) and 5 parts of a compound represented by the following formula (13) were dissolved in a mixed solvent of 60 parts of toluene to thereby prepare a coating liquid for an electron transporting layer. The coating liquid for an electron transporting layer was immersion coated on the conductive layer, and the obtained coating film was irradiated with electron beams under the conditions of an acceleration voltage of 150 kV and an irradiation dose of 10 Mrad to be polymerized to thereby form an electron transporting layer having a thickness of 1.00 μm.

(13)

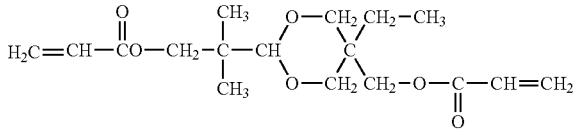

Comparative Example 10

An electrophotographic photosensitive member was manufactured and evaluated as in Example 1, except for forming an electron transporting layer as follows. The results are shown in Table 16.

An electron transporting layer of 0.32 μm was formed by using a block copolymer described in example 1 of National Publication of International Patent Application No. 2009-505156 and represented by the following formula, a blocked isocyanate compound and a vinyl chloride-vinyl acetate copolymer.

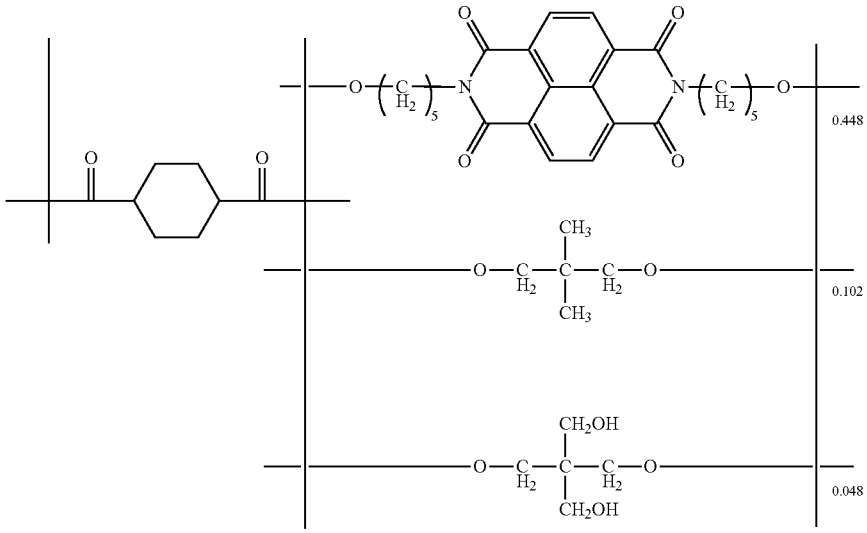

Comparative Example 11

An electrophotographic photosensitive member was manufactured and evaluated as in Example 1, except for forming an electron transporting layer as follows. The results are shown in Table 16.

5 parts of the electron transporting substance (A101) and 5 parts of a polycarbonate resin (Z200, made by Mitsubishi Gas Chemical Co., Inc.) were dissolved in a mixed solvent of 50 parts of dimethylacetoamide and 50 parts of chlorobenzene to thereby prepare a coating liquid for an electron transporting layer. The coating liquid for an electron transporting layer was immersion coated on the conductive layer, and the obtained coating film was heated for 30 min at 120° C. to be polymerized to thereby form an electron transporting layer having a thickness of 1.00 μm.

Comparative Example 12

An electrophotographic photosensitive member was manufactured and evaluated as in Example 1, except for forming an electron transporting layer as follows. The results are shown in Table 16.

5 parts by weight of an electron transporting substance (pigment) represented by the following structural formula (15) was added to a solution in which 5 parts of the resin (D1)

was dissolved in a mixed solvent of 200 parts of methyl ethyl ketone, and was subjected to a dispersion treatment for 3 hours using a sand mill to thereby prepare a coating liquid for an electron transporting layer. The coating liquid for an electron transporting layer was immersion coated on the conductive layer, and the obtained coating film was heated for 10 min at 100° C. to thereby form an electron transporting layer having a thickness of 1.5 μm.

(15)

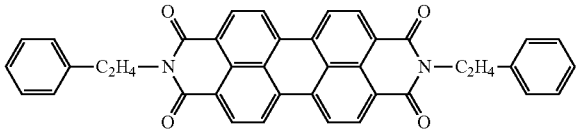

Comparative Example 13

An electrophotographic photosensitive member was manufactured and evaluated as in Example 1, except for forming an electron transporting layer as follows. The results are shown in Table 16.

An electron transporting layer (a constitution described in example 1 of Japanese Patent Application Laid-Open No. 2006-030698) was formed by using a zinc oxide pigment having been subjected to a surface treatment with a silane coupling agent, alizarin (A922), a blocked isocyanate and a butyral resin, to thereby form an electron transporting layer of 25 μm.

Comparative Example 14

An electrophotographic photosensitive member was manufactured and evaluated as in Example 1, except for forming an electron transporting layer as follows. The results are shown in Table 16.

10 parts of a mixture of compounds having structures represented by the following formulae (11-1) and (11-2) was dissolved in a mixed solvent of 30 parts of N-methyl-2-pyrrolidone and 60 parts of cyclohexanone to thereby prepare a coating liquid for an electron transporting layer. The coating liquid for an electron transporting layer was immersion coated on the conductive layer, and the obtained coating film was heated for 30 min at 150° C. to be polymerized to thereby form an electron transporting layer having a structure represented by the following formula (11-3) and having a thickness of 0.20 μm.

(11-1)

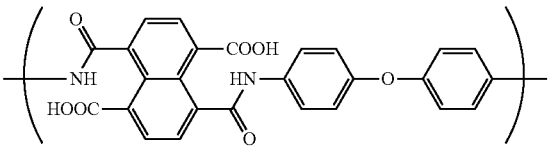

-continued (11-2)

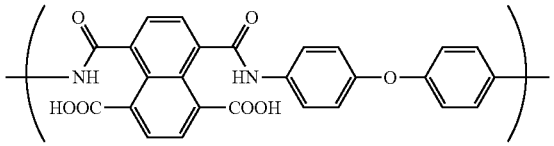

(11-3)

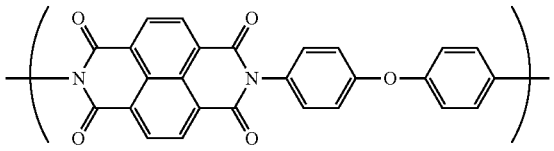

Comparative Example 15

An electrophotographic photosensitive member was manufactured and evaluated as in Example 1, except for forming an electron transporting layer as follows. The results are shown in Table 16.

10 parts of an electron transporting substance represented by the following formula (12) was dissolved in a mixed solvent of 60 parts of toluene to thereby prepare a coating liquid for an electron transporting layer. The coating liquid for an electron transporting layer was immersion coated on the conductive layer, and the obtained coating film was irradiated with electron beams under the conditions of an acceleration voltage of 150 kV and an irradiation dose of 10 Mrad to be polymerized to thereby form an electron transporting layer having a thickness of 1.0 μm.

Comparative Example 16

An electrophotographic photosensitive member was manufactured and evaluated as in Example 1, except for forming an electron transporting layer as follows. The results are shown in Table 16.

An electron transporting layer was formed by using a particle of a copolymer containing an electron transporting substance described in example 1 of Japanese Patent No. 4,594,444, to thereby form an electron transporting layer having a thickness of 1.00 μm.

Comparative Example 17

An electrophotographic photosensitive member was manufactured and evaluated as in Example 1, except for forming an electron transporting layer as follows. The results are shown in Table 16.

An electron transporting layer was formed by using a coating liquid for an electron transporting layer in which a polymer of an electron transporting substance described in example 1 of Japanese Patent Application Laid-Open No. 2004-093801 was dissolved in a solvent, to thereby form an electron transporting layer having a thickness of 2.00 μm.

TABLE 16

| Comparative Example | Thickness of Electron Transporting Layer (μm) | Standard Deviation of 10 Measurement Values (%) σ (C) | σ (N) | σ (O) | Positive Memory Vl Potential Difference | Density Difference | Potential After 2,000-Sheets Repeated Use Vd | Vl |
|---|---|---|---|---|---|---|---|---|
| 4 | 1.00 | 1.7 | 2.2 | 2.0 | 38 | 0.14 | −572 | −247 |
| 5 | 1.00 | 2.1 | 2.5 | 2.2 | 40 | 0.15 | −571 | −246 |
| 6 | 0.50 | 2.1 | 2.5 | 2.2 | 37 | 0.13 | −575 | −242 |
| 7 | 1.00 | 1.9 | 2.4 | 2.3 | 39 | 0.15 | −571 | −248 |
| 8 | 0.80 | 1.4 | 2.0 | 1.8 | 29 | 0.12 | −581 | −234 |
| 9 | 1.00 | 1.5 | 2.3 | 2.2 | 35 | 0.14 | −575 | −244 |
| 10 | 0.32 | 1.2 | 1.8 | 2.0 | 30 | 0.12 | −581 | −236 |
| 11 | 1.00 | 2.1 | 2.5 | 2.2 | 42 | 0.15 | −571 | −250 |
| 12 | 1.50 | 1.8 | 2.3 | 2.2 | 39 | 0.14 | −573 | −247 |
| 13 | 25.00 | 2.2 | — | 2.3 | 28 | 0.13 | −573 | −210 |
| 14 | 0.20 | 0.8 | 1.6 | 1.1 | 16 | 0.11 | −595 | −210 |
| 15 | 1.00 | 1.1 | 1.6 | 0.9 | 17 | 0.11 | −595 | −210 |
| 16 | 1.00 | 0.8 | 1.7 | 1.6 | 24 | 0.11 | −591 | −218 |
| 17 | 2.00 | 1.0 | 1.4 | 1.6 | 21 | 0.11 | −595 | −215 |

It is clear from the comparison of the Examples to Comparative Examples 1 to 9 that even in the case where an electron transporting layer contained a cured substance obtained by polymerizing a composition containing an electron transporting substance having polymerizable functional groups, a thermoplastic resin having polymerizable functional groups and a crosslinking agent, the electron transporting layer not satisfying the expressions (1) to (3) according to the present invention did not exhibit a sufficient effect of reducing the positive memory and a sufficient suppression of the potential variation in some cases as compared to the case of satisfying the ranges of the expressions (1) to (3). In Comparative Examples 5 to 9, since no resin was present, the bonding of crosslinking agents progressed much, thereby causing the cohesion of an electron transporting substance, and conceivably resulting in not satisfying the expressions (1) to (3). It is also clear from the comparison of the Examples to Comparative Example 10 that even the electron transporting layer described in National Publication of International Patent Application No. 2009-505156 could not exhibit a sufficient effect of reducing the positive memory in some cases. This is conceivably because since the electron transporting substance was a high-molecular weight polymer, the cohesion of the components was generated in the electron transporting layer, and the expressions (1) to (3) were not satisfied, thus being liable to generate the positive memory.

It is shown from the comparison of the Examples to Comparative Examples 10 to 13 that the case of containing much of an electron transporting substance having no polymerizable functional groups and a metal oxide did not satisfy the expressions (1) to (3), and could not exhibit a sufficient effect of reducing the positive memory and a sufficient suppression of the potential variation. It is conceivable that in an electron transporting layer containing an electron transporting substance having no polymerizable functional groups, the electron transporting substance dissolved out in a photosensitive layer, and the concentration of the electron transporting substance in the electron transporting layer at the interface with a charge generating layer largely decreased.

It is clear according to Comparative Examples 14 to 17 that the case of constituting an electron transporting layer composed of only an electron transporting substance did not satisfy the ranges of the expressions (1) to (3), and could not provide a sufficient reduction of the positive memory in some cases.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2012-147157, filed Jun. 29, 2012, 2013-093091, filed Apr. 25, 2013 and 2013-130997, filed Jun. 21, 2013, which are hereby incorporated by reference herein in their entirety.

What is claimed is:

1. An electrophotographic photosensitive member comprising:

a support;

an electron transporting layer formed on the support; and a photosensitive layer formed on the electron transporting layer, wherein the electron transporting layer comprises a polymerized product of a composition comprising:

an electron transporting substance having a polymerizable functional group and having a molecular weight of 1,000 or less;

a crosslinking agent having a molecular weight of 1,000 or less; and a thermoplastic resin having a structural unit represented by the following formula (D), (D)

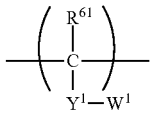

in the formula (D), $R^{61}$ represents a hydrogen atom or an alkyl group, $Y^1$ represents a single bond, an alkylene group or a phenylene group, and $W^1$ represents a hydroxy group, a thiol group, an amino group, a carboxyl group or a methoxy group, wherein the crosslinking agent is an isocyanate compound or an amine compound, and the electron transporting substance is a compound represented by one of the following formulae (A1) to (A9):

(A1)

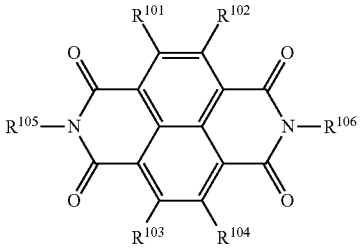

(A2)

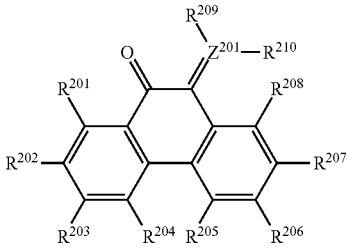

(A3)

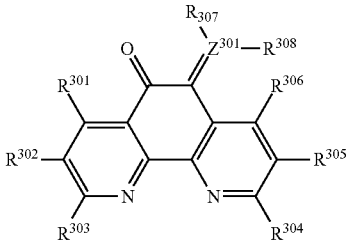

(A4)

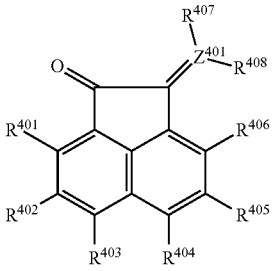

(A5)

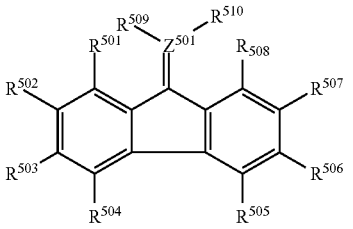

(A6)

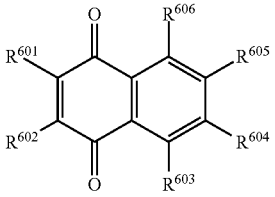

-continued (A7)

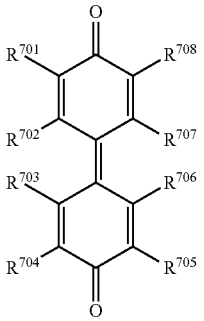

(A8)

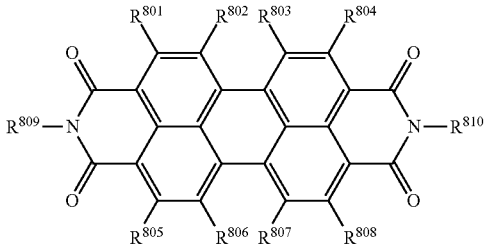

(A9)

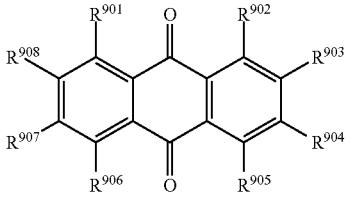

in the formulae (A1) to (A9), $R^{101}$ to $R^{106}$, $R^{201}$ to $R^{210}$, $R^{301}$ to $R^{308}$, $R^{401}$ to $R^{408}$, $R^{501}$ to $R^{510}$, $R^{601}$ to $R^{606}$, $R^{701}$ to $R^{708}$, $R^{801}$ to $R^{810}$ and $R^{901}$ to $R^{908}$ each independently represent a monovalent group represented by the following formula (A), a hydrogen atom, a cyano group, a nitro group, a halogen atom, an alkoxycarbonyl group, a substituted or unsubstituted alkyl group, a substituted or unsubstituted aryl group or a substituted or unsubstituted heterocycle, one of carbon atoms in the main chain of the alkyl group may be replaced by O, S, NH or $NR^{1001}$ ($R^{1001}$ is an alkyl group), the substituent of the substituted alkyl group is an alkyl group, an aryl group, an alkoxycarbonyl group, or a halogen atom, the substituents of the substituted aryl group or the substituted heterocyclic group are a halogen atom, a nitro group, a cyano group, an alkyl group and a halogen-substituted alkyl group, $Z^{201}$, $Z^{301}$, $Z^{401}$ and $Z^{501}$ each independently represent a carbon atom, a nitrogen atom or an oxygen atom, where $Z^{201}$ is an oxygen atom, $R^{209}$ and $R^{210}$ are not present, where $Z^{201}$ is a nitrogen atom, $R^{210}$ is not present, $Z^{301}$ is an oxygen atom, $R^{307}$ and $R^{308}$ are not present, where $Z^{301}$ is a nitrogen atom, $R^{308}$ is not present, where $Z^{401}$ is an oxygen atom, $R^{407}$ and $R^{408}$ are not present, where $Z^{401}$ is a nitrogen atom, $R^{408}$ is not present, where $Z^{501}$ is an oxygen atom, $R^{509}$ and $R^{510}$ are not present, where $Z^{501}$ is a nitrogen atom, $R^{510}$ is not present, $$-(\alpha)_l-(\beta)_m-\gamma \quad \text{(A)}$$

in the formula (A), at least one of α, β and γ is a group having a substituent, and the substituent is at least one group selected from the group consisting of a hydroxy group, a thiol group, an amino group, a carboxyl group and a methoxy group, l and m are each independently 0 or 1, and the sum of l and m is 0 to 2, α represents an alkylene group having 1 to 6 atoms in the main chain, an alkylene group having 1 to 6 atoms in the main chain and being substituted with an alkyl group having 1 to 6 carbon atoms, an alkylene group having 1 to 6 atoms in the main chain and being substituted with a benzyl group, an alkylene group having 1 to 6 atoms in the main chain and being substituted with an alkoxycarbonyl group, or an alkylene group having 1 to 6 atoms in the main chain and being substituted with a phenyl group, and these groups may have at least one substituent selected from the group consisting of a hydroxy group, a thiol group, an amino group, a carboxyl group and a methoxy group, one of carbon atoms in the main chain of the alkylene group may be replaced by O, S, NH or $NR^{19}$ ($R^{19}$ is an alkyl group), β represents a phenylene group, a phenylene group substituted with an alkyl having 1 to 6 carbon atoms, a nitro-substituted phenylene group, a halogen-substituted phenylene group or an alkoxy group-substituted phenylene group, and these groups may have at least one substituent selected from the group consisting of a hydroxy group, a thiol group, an amino group, a carboxyl group and a methoxy group, γ represents a hydrogen atom, an alkyl group having 1 to 6 atoms in the main chain, or an alkyl group having 1 to 6 atoms in the main chain and being substituted with an alkyl group having 1 to 6 carbon atoms, and these groups may have at least one substituent selected from the group consisting of a hydroxy group, a thiol group, an amino group, a carboxyl group and a methoxy group, one of carbon atoms in the main chain of the alkyl group may be replaced by O, S, NH or $NR^{1003}$ ($R^{1003}$ is an alkyl group), and wherein the electron transporting layer comprises carbon atoms, nitrogen atoms and oxygen atoms; and the electron transporting layer satisfies the following expressions (1) to (3):

$$\sigma(C) \leq 1.5 \quad (1),$$

$$\sigma(N) \leq 1.5 \quad (2), \text{ and}$$

$$\sigma(O) \leq 1.5 \quad (3),$$

where, in the expressions (1) to (3),

σ(C) represents a standard deviation of 10 values of a ratio (atomic %) of the number of carbon atoms based on the number of all atoms except hydrogen atoms in the electron transporting layer, the 10 values being obtained by X-ray photoelectron spectroscopy (ESCA) at 10 points;

σ(N) represents a standard deviation of 10 values of a ratio (atomic %) of the number of nitrogen atoms based on the number of all atoms except hydrogen atoms in the electron transporting layer, the 10 values being obtained by X-ray photoelectron spectroscopy (ESCA) at 10 points; and σ(O) represents a standard deviation of 10 values of a ratio (atomic %) of the number of oxygen atoms based on the number of all atoms except hydrogen atoms in the electron transporting layer, the 10 values being obtained by X-ray photoelectron spectroscopy (ESCA) at 10 points, the 10 points consisting of an upper end point and a lower end point of the electron transporting layer, and 8 points dividing the electron transporting layer equally into 9 parts in the depth direction.

2. The electrophotographic photosensitive member according to claim 1, wherein the respective standard deviations, σ(C), σ(N) and σ(O) satisfy the following expressions (4) to (6):

$$\sigma(C) \leq 1.0 \quad (4),$$

$$\sigma(N) \leq 1.0 \quad (5), \text{ and}$$

$$\sigma(O) \leq 1.0 \quad (6).$$

3. The electrophotographic photosensitive member according to claim 1, wherein a sum of the ratio of the number of carbon atoms, the ratio of the number of nitrogen atoms and the ratio of the number of oxygen atoms in the electron transporting layer is 90% or more and 100% or less (excluding hydrogen atoms having no measurement sensitivity in ESCA).

4. The electrophotographic photosensitive member according to claim 1, wherein the thermoplastic resin has a weight-average molecular weight of 5,000 or more and 400,000 or less.

5. The electrophotographic photosensitive member according to claim 1, wherein the thermoplastic resin has a weight-average molecular weight of 5,000 or more and 300,000 or less.

6. The electrophotographic photosensitive member according to claim 1, wherein the crosslinking agent is a compound having 3 to 6 of an isocyanate group, a blocked isocyanate group or a group represented by $—CH_2OR^1$ ($R^1$ represents a hydrogen atom or an alkyl group).

7. A process cartridge comprising an electrophotographic photosensitive member according to claim 1 and at least one unit selected from the group consisting of a charging unit, a developing unit, a transfer unit and a cleaning unit, integrally supported therein, wherein the process cartridge is attachable to and detachable from an electrophotographic apparatus.

8. An electrophotographic apparatus comprising an electrophotographic photosensitive member according to claim 1, a charging unit, a light irradiation unit, a developing unit and a transfer unit.

* * * * *